US006594837B2

(12) United States Patent
Khait

(10) Patent No.: US 6,594,837 B2
(45) Date of Patent: Jul. 22, 2003

(54) SERVICE BED

(76) Inventor: George Khait, 612 Westline Dr., Alameda, CA (US) 94501

( * ) Notice: Subject to any disclaimer, the term of this patent is extended or adjusted under 35 U.S.C. 154(b) by 0 days.

(21) Appl. No.: 09/822,629

(22) Filed: Mar. 30, 2001

(65) Prior Publication Data

US 2002/0023297 A1 Feb. 28, 2002

Related U.S. Application Data

(60) Provisional application No. 60/193,860, filed on Mar. 30, 2000.

(51) Int. Cl.[7] ..... A61G 7/00

(52) U.S. Cl. ..... 5/600; 5/5; 5/487

(58) Field of Search ..... 5/600, 487, 488, 5/611, 612, 81.1 HS, 81.1

(56) References Cited

U.S. PATENT DOCUMENTS

| | | | | |
|---|---|---|---|---|
| 545,741 A | | 9/1895 | Shutters | |
| 1,318,271 A | * | 10/1919 | Ford | 5/600 |
| 1,793,006 A | | 2/1931 | O'Neill | |
| 1,877,610 A | | 9/1932 | Steiner | |
| 3,343,183 A | | 9/1967 | Sannes | |
| 3,388,406 A | | 6/1968 | Scrivener | |
| 3,466,679 A | | 9/1969 | Hess | |
| 3,641,600 A | | 2/1972 | Oats | |
| 3,810,263 A | | 5/1974 | Taylor et al. | |
| 3,924,281 A | | 12/1975 | Gibbs | |
| 3,946,450 A | | 3/1976 | Staggs | |
| 4,003,704 A | | 1/1977 | Zurolo et al. | |
| 4,042,985 A | | 8/1977 | Raczkowski | |
| 4,270,234 A | | 6/1981 | James | |
| 4,843,665 A | | 7/1989 | Cockel et al. | |
| 4,926,513 A | | 5/1990 | Oats | |
| 4,945,585 A | | 8/1990 | Stewart | |
| 5,023,967 A | | 6/1991 | Ferrand | |
| 5,138,729 A | | 8/1992 | Ferrand | |
| 5,265,296 A | * | 11/1993 | Abbas et al. | 5/488 |
| 5,279,010 A | | 1/1994 | Ferrand | |
| 5,323,500 A | | 6/1994 | Roe | |
| 5,345,629 A | | 9/1994 | Ferrand | |
| 5,718,009 A | | 2/1998 | Lin | |
| 5,906,016 A | | 5/1999 | Ferrand | |
| 5,906,017 A | | 5/1999 | Ferrand | |
| 5,913,773 A | | 6/1999 | Cox | |
| 6,006,378 A | | 12/1999 | Hayashi | |

FOREIGN PATENT DOCUMENTS

| | | |
|---|---|---|
| DE | 2623933 | 12/1977 |
| DE | 2720734 | 11/1978 |
| DE | 3438956 | 5/1985 |
| FR | 1400068 | 4/1965 |
| GB | 2130482 | 6/1984 |
| WO | WO 86/00221 | 1/1986 |

* cited by examiner

*Primary Examiner*—Heather Shackelford
*Assistant Examiner*—Fredrick Conley
(74) *Attorney, Agent, or Firm*—George W. Wasson; Mark Blumenkrantz

(57) ABSTRACT

A service bed comprising a chassis, a guide mechanism movably supported by the chassis, and a mattress having an undulation formed by routing the mattress through the guide mechanism. The guide mechanism includes dispensing and collecting rollers for installing at least one first stratum between the mattress and the occupant of the service bed and for removing at least one second stratum installed between the mattress and the occupant.

35 Claims, 59 Drawing Sheets

MOTION–SUBSYSTEM DATA STRUCTURE

| |
|---|
| MOTION TIME LIMIT |
| CURRENT POSITION |
| MAXIMUM POSITION |
| DESIRED POSITION |
| MOTION FLAG |
| INTERLOCKING CONDITIONS |
| ○ ○ ○ |
| |

561

FIG.53

SERVICE BED

CROSS-REFERENCE TO RELATED APPLICATIONS

This application claims the benefit of U.S. Provisional Application No. 60/193,860, filed Mar. 30, 2000.

BACKGROUND

With the population of bedridden patients estimated to be several million in the United States alone, care for the bed bound presents a number of significant problems in the health-care industry worldwide.

The daily care regimen for a bed-bound patient includes a plurality of routines, such as toileting, bathing, changing of the bed sheets, immobility-related disease prevention and treatment procedures, physical observation, and remedial procedures, to name a few. Some of these routines must be performed several times a day. In view of the regular nature of the aforementioned care regimen, it is saliently problematic that conventional methods of attending to the bedridden are mentally and physically stressful for the patient, physically-challenging for the caregiver, and are fiscally and temporally inefficient. For example, a procedure to change the bed sheets requires the attendant to move the patient to one side of the bed and then to the other side to enable removal of the old sheets and the installation of the fresh ones. These actions not only bring unnecessary discomfort to the patient, both in the physical and the psychological sense, but may also promote injury to the patient's skin due to friction, which unavoidably occurs between the skin and the bed sheets. The procedure is also physically-strenuous for the care-provider, often causing back injuries and carpal-tunnel syndrome. Other routine procedures, such as toileting, bathing, immobility-related disease prevention and treatment procedures, physical observation, and remedial procedures administered to bed-bound patients present even greater difficulties for patients and their attendants alike. Because of compromises that inevitably result in attending to the bed bound in view of the foregoing concerns, other undesirable factors such as heat and moisture may never be sufficiently minimized in the health-care equation. Moreover, conventional methods of care giving are inefficient due to being time-consuming and labor-intensive, thus substantially increasing the cost of heath care for the bedridden patients.

A related concern associated with caring for bed-bound patients is the formation of decubitus ulcers, otherwise known as pressure or bed sores. Bed sores result from long periods of immobility during which the weight of the person's skeleton presses against the underlying tissues, cutting off circulation thereto and causing those tissues to die. Additional factors that contribute to formation of bed sores include heat, moisture, and friction, all of which are associated with conventional methods of caring for bedridden patients, as discussed above. Heat increases the body's need for nutrients due to accelerated metabolism. Moisture (urine, feces, and other body fluids) weakens the skin and may lead to infection. Frictional forces tear the skin, aggravating ulceration. Bedsores become infected easily, causing considerable discomfort for the patient and substantially complicating the patient's health care, and may even be life-threatening. Medical studies have shown that complete relief of pressure for specific periods of time may often prevent ulceration of at-risk areas and permit restoration of circulation and cellular metabolism in affected areas of the body. However, conventional techniques of providing pressure relief generally cannot be administered without discomfort to the patient and considerable time and effort on the part of the caregiver.

Information regarding attempts to address the foregoing concerns can be found in U.S. Pat. Nos. 6,006,378; 5,906,017; 5,906,016; 5,345,629; 5,323,500; 5,279,010; 5,138,729; and 5,023,967, among others. However, the teachings of the references from the preceding list have not been successful in resolving all of the previously-mentioned problems.

Hence, a need exists for a bed or platform for servicing bedridden patients that: would allow the bed sheets to be changed quickly, substantially without moving or disturbing the patient, substantially without friction relative to the patient's skin, and substantially without physical effort on the part of the caregiver; would permit toileting, bathing, immobility-related disease-prevention and treatment procedures, physical observation, and remedial procedures to be performed without moving or disturbing the patient and without physical effort on the part of the caregiver; would help prevent bed sores from forming and help treat already-existing bedsores; would provide the caregiver direct access to any peripheral area of the patient's body; would be sufficiently comfortable so that patients can rest; would be simple to maintain and inexpensive to manufacture; and would significantly reduce the costs of health care for bedridden patients.

SUMMARY

A service bed is disclosed that: allows the bed sheets to be changed quickly, substantially without moving or disturbing the patient, substantially without friction relative to the patient's skin, and substantially without physical effort on the part of the caregiver; permits toileting, bathing, immobility-related disease-prevention and treatment procedures, physical observation, and remedial procedures to be performed without moving or disturbing the patient and without physical effort on the part of the caregiver; helps prevent bed sores from forming and helps treat already-existing bedsores; provides the caregiver direct access to any peripheral area of the patient's body; is sufficiently comfortable so that patients can rest; is simple to maintain and inexpensive to manufacture; and significantly reduces the costs of health care for bedridden patients. In one embodiment of the invention, the service bed comprises a chassis, a guide mechanism movably supported by the chassis, and a mattress having an undulation formed by routing the mattress through the guide mechanism. The guide mechanism includes dispensing and collecting rollers for installing at least one first stratum between the mattress and the occupant of the service bed and for removing at least one second stratum installed between the mattress and the occupant.

These and other features, aspects, and advantages of the service bed in its various embodiments will become apparent after consideration of the ensuing description, the accompanying drawings, and the appended claims.

BRIEF DESCRIPTION OF THE DRAWINGS

The service bed in its various embodiments is illustrated by way of example, and not by way of limitation, in the figures of the accompanying drawings, where:

FIG. 53 represents a motion-subsystem data structure utilized by the control system of FIG. 48.

For purposes of illustration, these figures are not necessarily drawn to scale. In all of the figures, like components are designated by like reference numerals.

DETAILED DESCRIPTION

Throughout the following description, specific details are set forth in order to provide a more thorough understanding of the invention. However, the invention may be practiced without these particulars. In other instances, well known elements have not been shown or described to avoid unnecessarily obscuring the invention. Accordingly, the specification and drawings are to be regarded in an illustrative, rather than a restrictive, sense.

Figure 1:
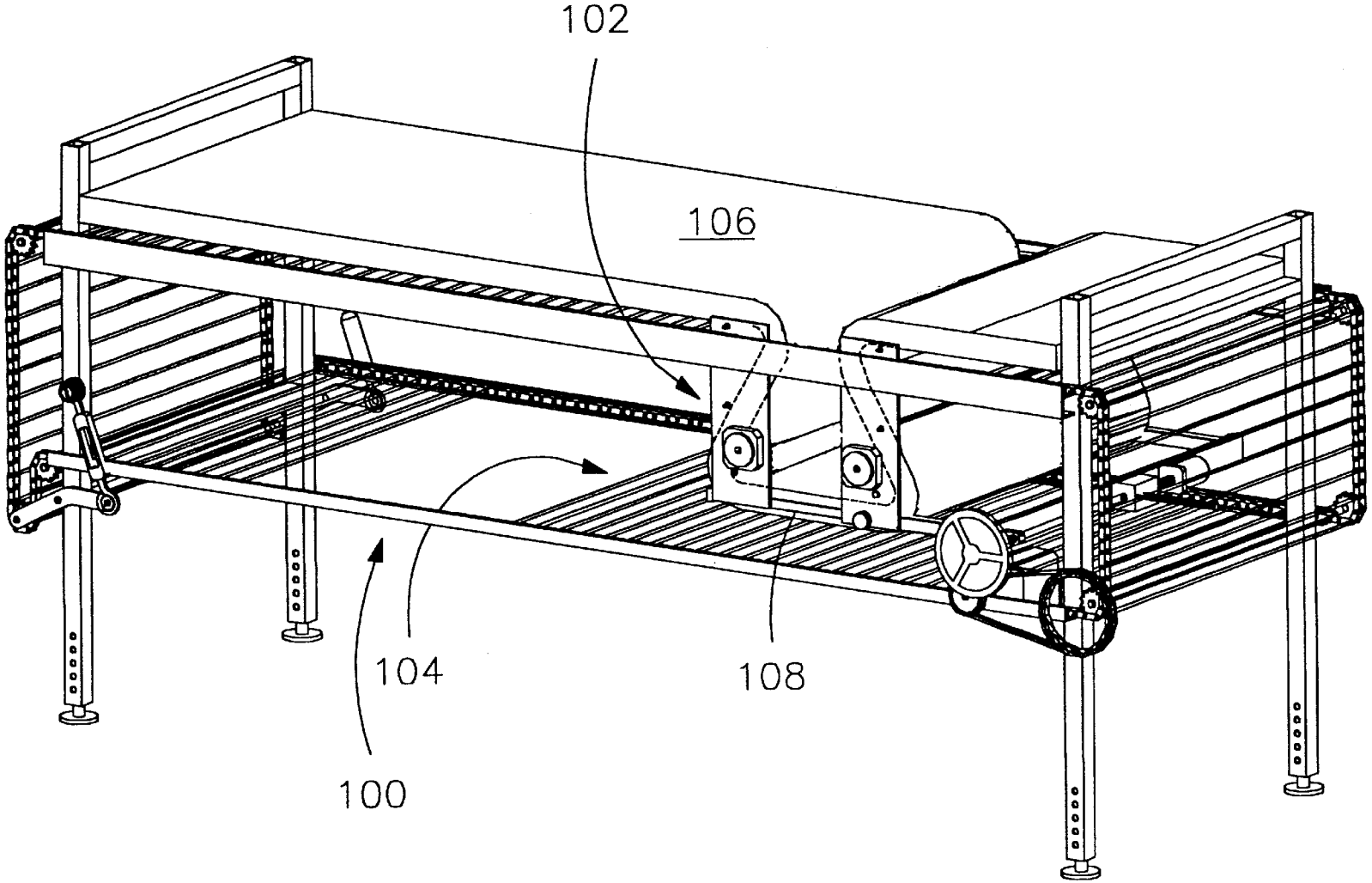
FIG. 1 is a perspective view of the service bed in accordance with one embodiment of the present invention.

FIG. 1 is a perspective view of the service bed or platform for supporting an occupant according to one embodiment of the present invention. The bed comprises a chassis 100, a guide mechanism 102 supported by the chassis and continuously movable with respect thereto, a carrier 104 movably mounted on chassis 100, and a mattress 106 supported by carrier 104 and having an undulation 108 formed by routing the mattress through guide mechanism 102.

Figure 2:
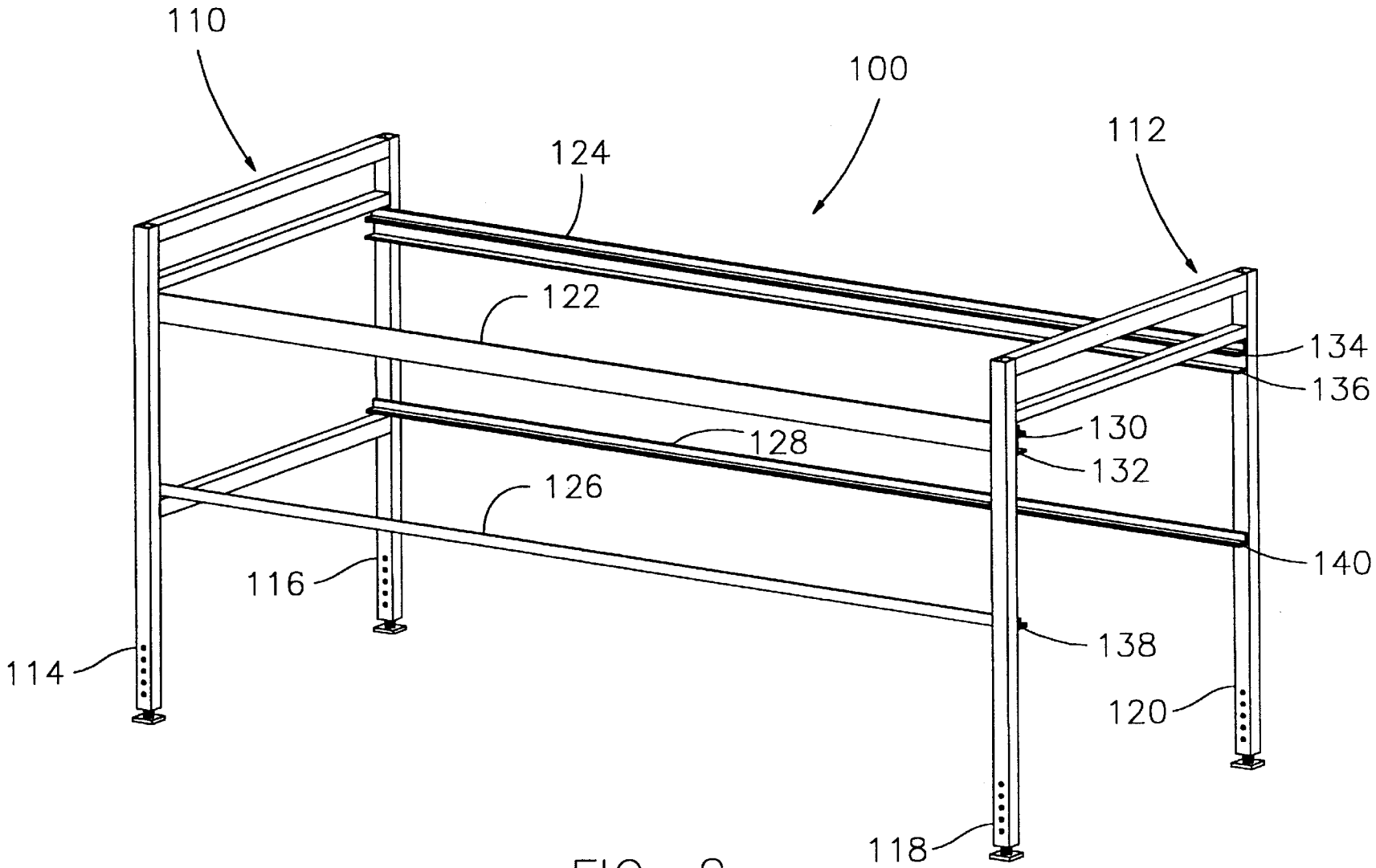
FIG. 2 is a perspective view of the chassis of the service bed of FIG. 1.
Figure 2A:
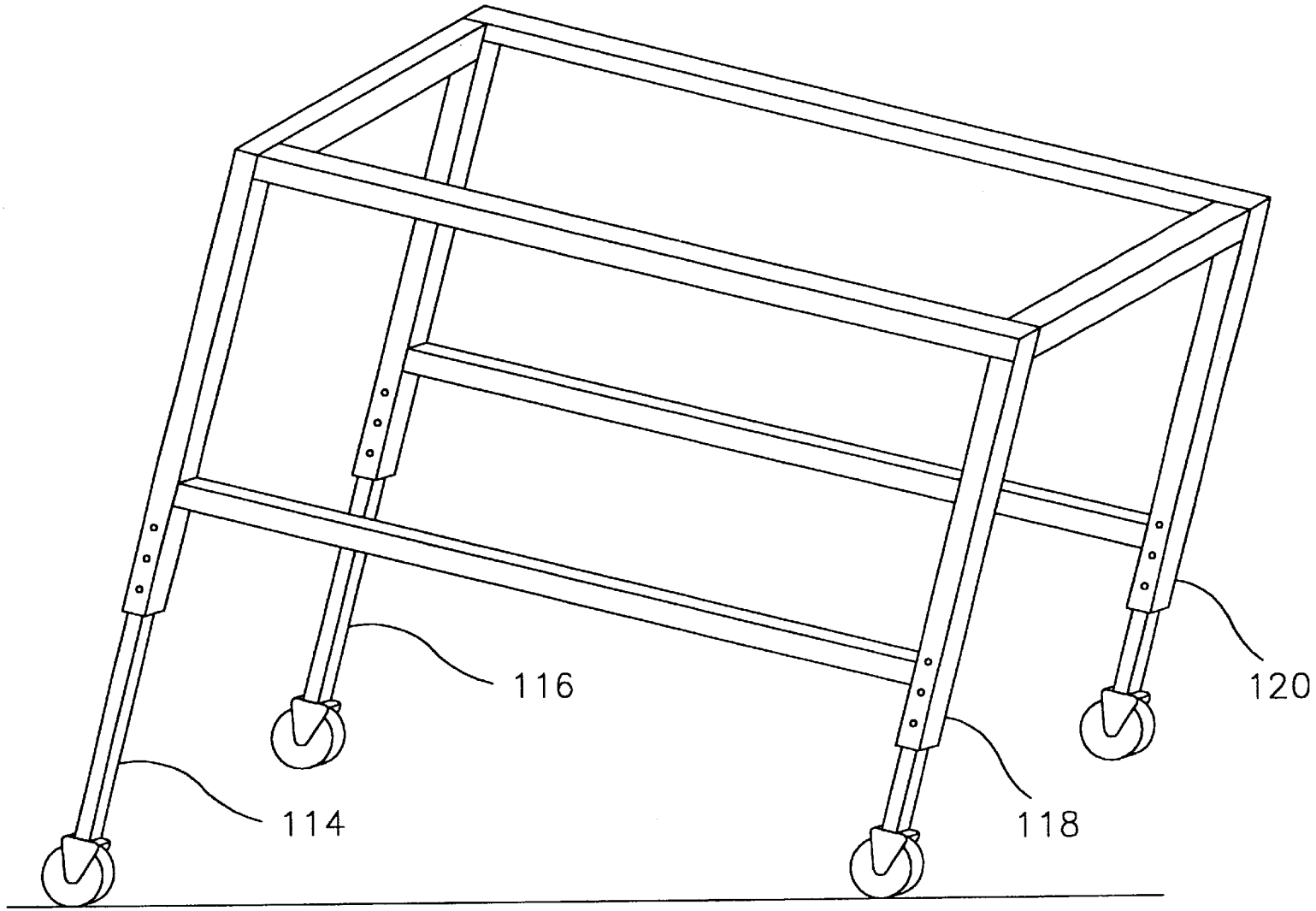
FIG. 2A is a perspective view of the chassis of FIG. 2A with its legs adjusted in a particular configuration.
Figure 2B:
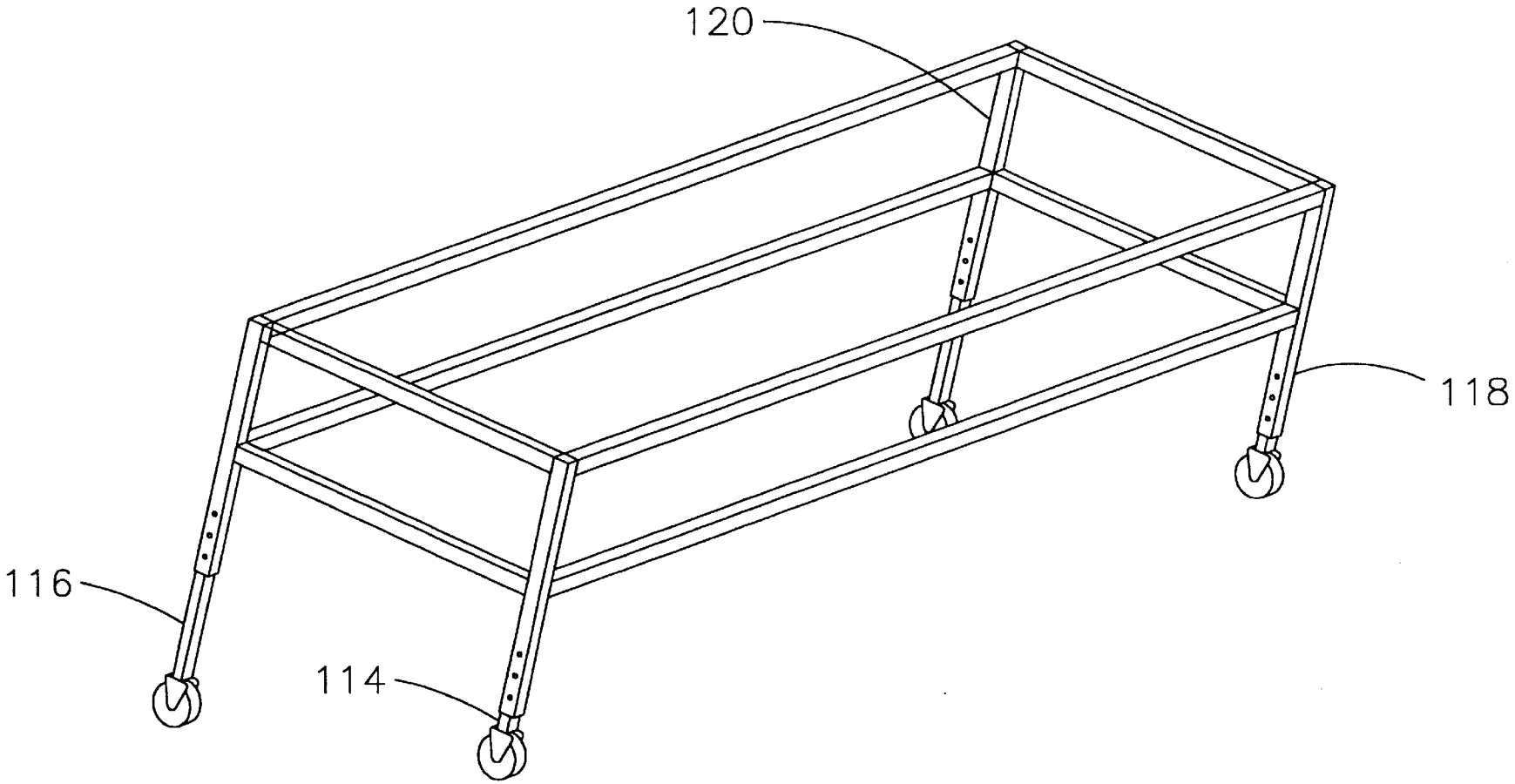
FIG. 2B is a perspective view of the chassis of FIG. 2 with its legs adjusted in another configuration.

FIG. 2 is a perspective view of chassis 100. The chassis includes end members 110 and 112, comprising adjustable legs 114, 116 and 118, 120, respectively. The legs can be adjusted in pairs to change the attitude of the chassis, as shown in FIGS. 2A and 2B. Referring back to FIG. 2, chassis 100 further includes top side rails 122, 124 and bottom side rails 126, 128. The top and the bottom side rails are connected to end members 110 and 112. Top side rail 122 includes guiding channels 130 and 132, whereas top side rail 124 includes guiding channels 134 and 136. Additionally, bottom side rail 126 has a guiding channel 138 and bottom side rail 128 has a guiding channel 140.

Figure 3:
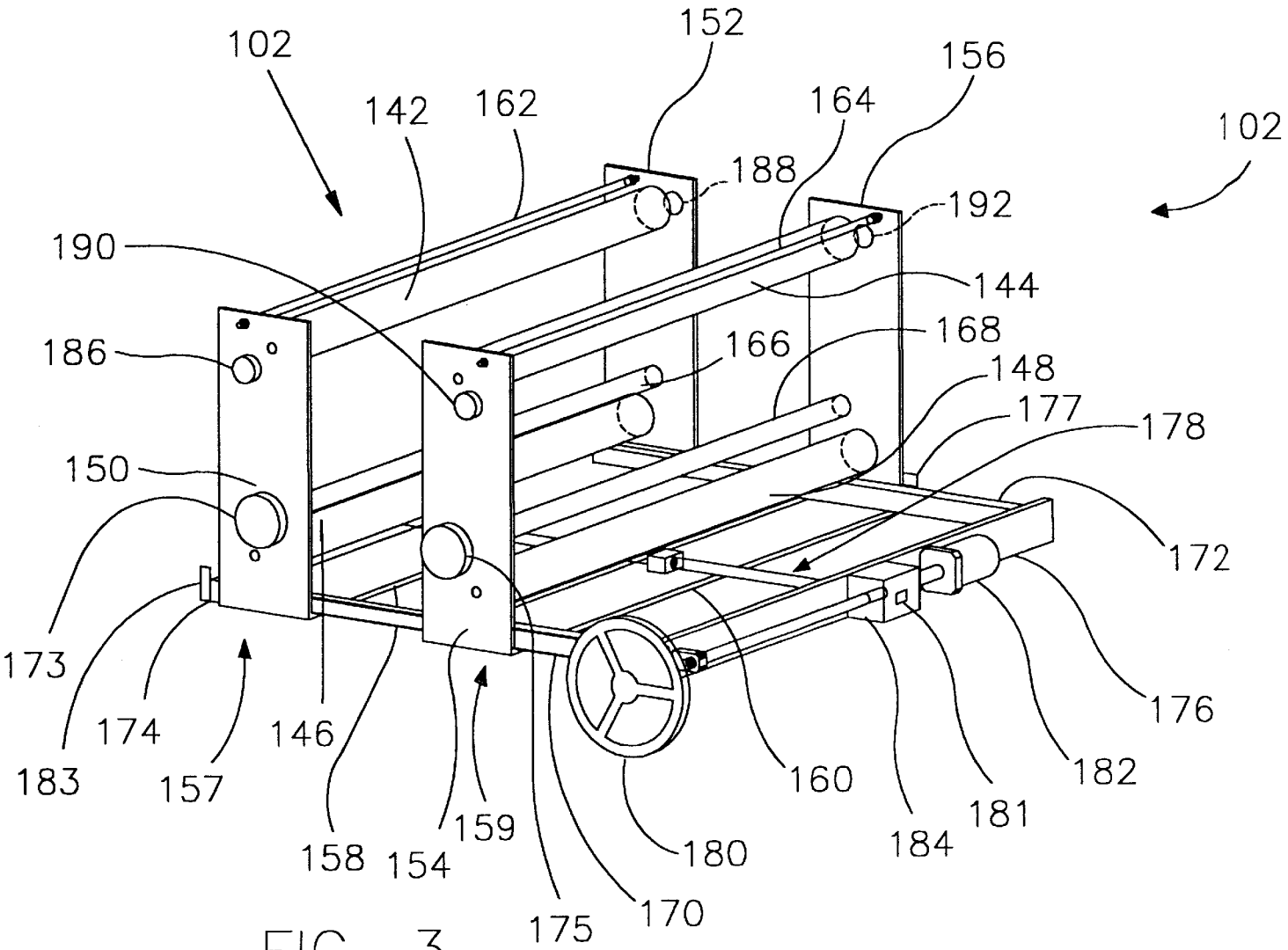
FIG. 3 is a perspective view illustrating one embodiment of the guide mechanism of the service bed of FIG. 1.

FIG. 3 is a perspective view of guide mechanism 102. The guide mechanism includes a plurality of guides, namely guide rollers 142, 144, 146, and 148, rotationally supported by mounting plates 150, 152, 154, and 156. Mounting plates 150 and 152 are rigidly connected by a cross-member 158. Together, mounting plates 150, 152 and cross-member 158 comprise a u-shaped member 157. Mounting plates 154 and 156 are rigidly connected by a cross-member 160. Together, mounting plates 154, 156 and cross member 160 comprise a u-shaped member 159. Mounting rods 162 and 164 (one or both of which may be used, as described below) are attached to mounting plates 150, 152 and 154, 156, respectively. Dispensing and collecting rollers 166 and 168 are rotatably and demountably supported by mounting plates 150, 152 and 154, 156, respectively. The rotation of dispensing and collecting rollers 166 and 168 is accomplished by electric motors 173 and 175, respectively.

Figure 4:
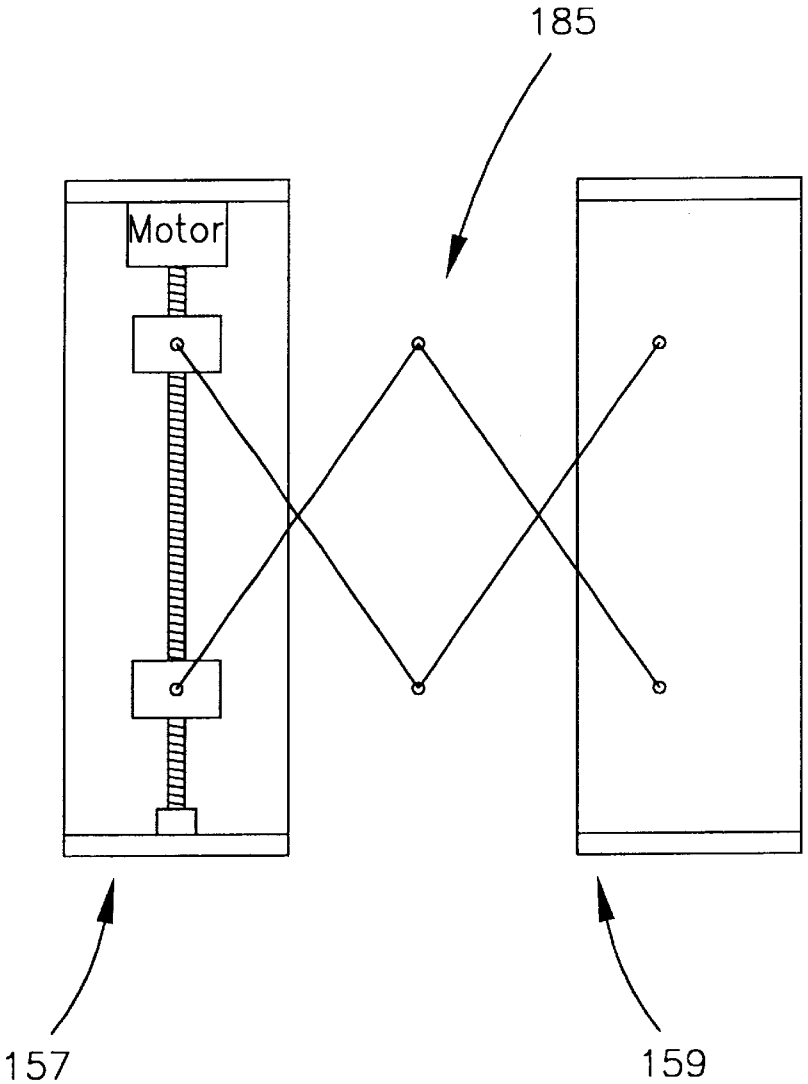
FIG. 4 is a schematic view illustrating another embodiment of the guide mechanism of the service bed of FIG. 1.
Figure 5:
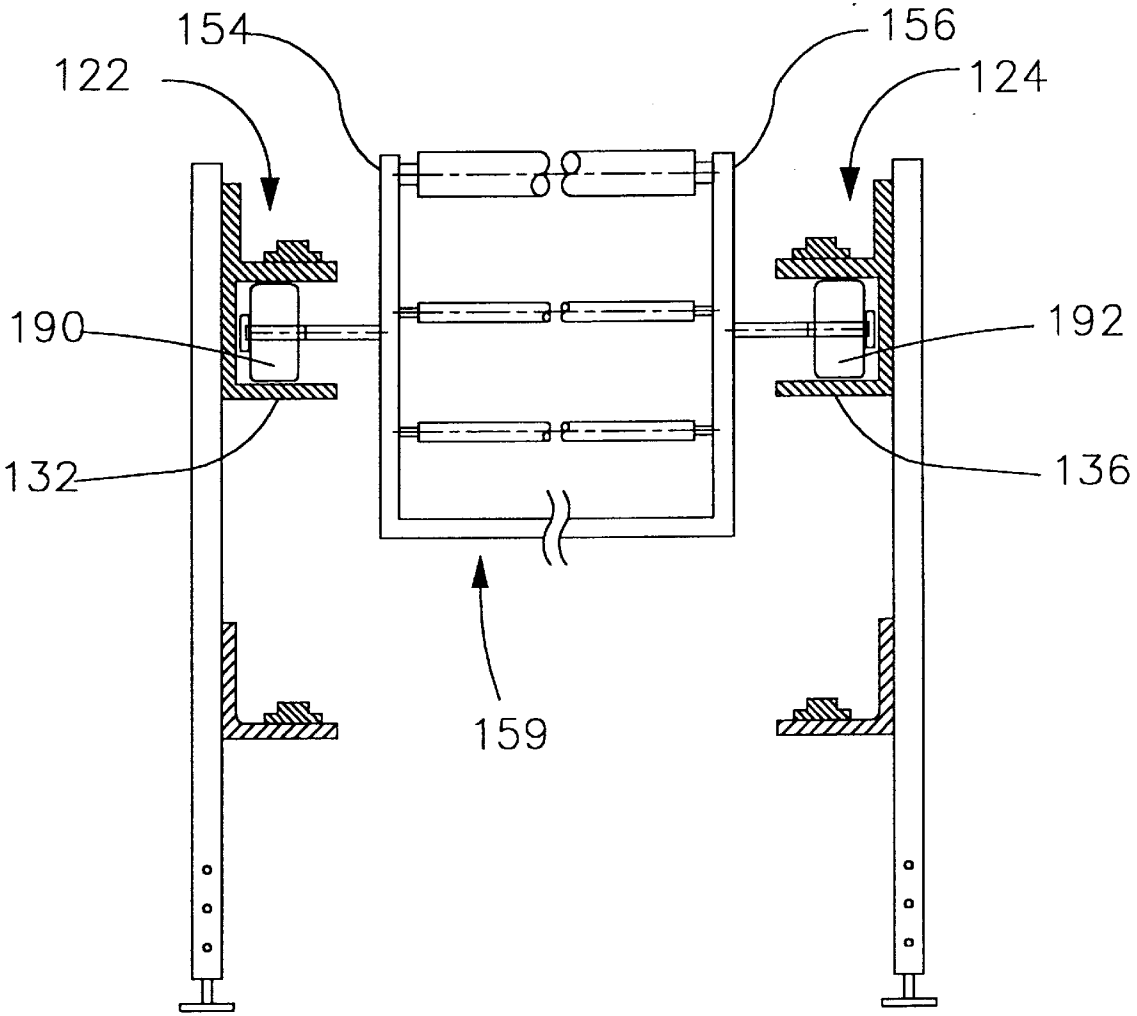
FIG. 5 is a schematic transverse sectional view of the service bed of FIG. 1 illustrating the mounting of the guide mechanism to the chassis.

Guide mechanism 102 further includes rails 170 and 172, interconnected by cross-members 174 and 176. A limit switch 177 is attached to mounting plate 156. U-shaped member 157 is rigidly attached to rails 170 and 172, e.g., with welds (not shown). U-shaped member 159 is slidably attached to rails 170 and 172 and is continuously movable relative to u-shaped member 157 by a conventional lead-screw mechanism 178. The lead screw mechanism may be activated by a drive such as a hand crank 180 and/or a conventional electric motor 182. Lead screw mechanism 178 is coupled to the drive via a conventional ninety-degree gearbox 184. Alternatively, the lead screw mechanism may be replaced by a linear actuator 185 (FIG. 4), many variations of which are possible. Referring back to FIG. 3, unshaped members 157 and 159 include bearings 186, 188 and 190, 192, respectively. As illustrated in FIG. 5, the bearings are movably positioned in guiding channels 132 and 136 of top side rails 122 and 124, respectively (only bearings 190 and 192 are represented in FIG. 5). Limit switches 181 and 183 (FIG. 3) are attached to gearbox 184 and cross-member 174, respectively.

Figure 6:
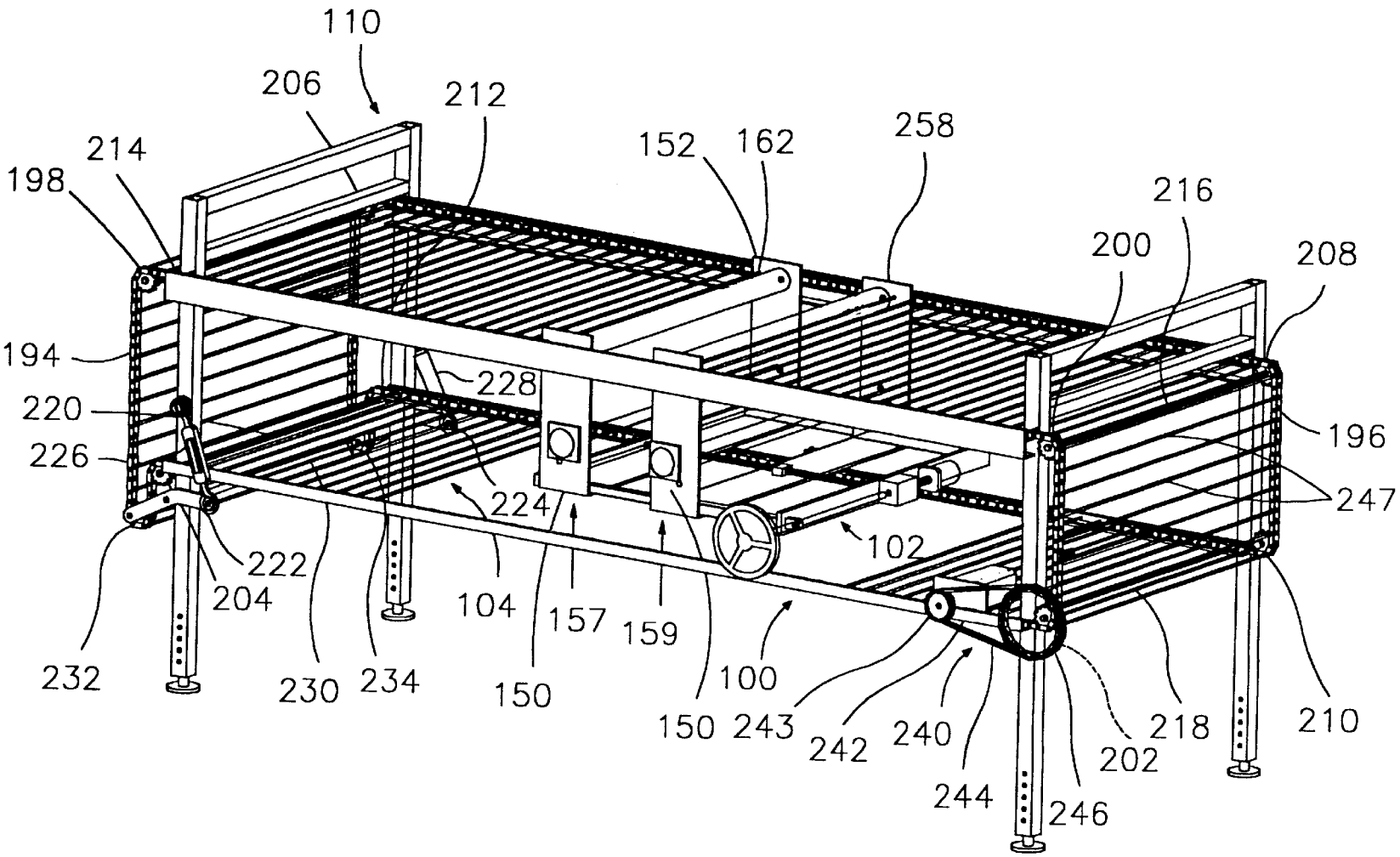
FIG. 6 is a perspective view illustrating one embodiment of the carrier of the service bed of FIG. 1.

FIG. 6 is a perspective view of carrier 104 movably supported on chassis 100. Carrier 104 has a drive train comprising flexible mechanical elements such as continuous roller chains 194 and 196 engaging idler sprockets 198, 200, 204 and 206, 208, 212, respectively, as well as drive sprockets 202 and 210, respectively. Those skilled in the art will appreciate that the roller chains may be replaced with flexible mechanical elements of a number of different types, e.g., toothed belts. The sprockets are rigidly mounted on shafts 214, 216, 218, and 220, rotatably attached to chassis 100. The slack in chains 194 and 196 is taken up by automatic chain tensioners 222 and 224, respectively, pivotally attached to end member 110 and having biasing adjusters, such as tension springs 226 and 228. The chain tensioners rotationally support a shaft 230, which carries sprockets 232 and 234, engaging chains 194 and 196, respectively.

Chains 194 and 196 are attached to unshaped member 157 using mounting rod 162, which passes through mounting plates 150, 152 and serves as an anchor pin for corresponding links of chains 194 and 196. Thus, the chains and guide mechanism 102 are coupled together and move as an integral unit relative to chassis 100 when shaft 218 is engaged by a drive mechanism 240. The drive mechanism may include a motor 242, attached to chassis 100. The motor has a drive sprocket 243, coupled via a chain 244 to a driven sprocket 246 that is rigidly attached to shaft 218, which also supports drive sprockets 202 and 210, as stated previously. Motor 242 may be replaced with a hand crank (not shown). Other conventional means of engaging shaft 218, e.g., a gear drive (not shown), may be utilized.

Figure 7A:
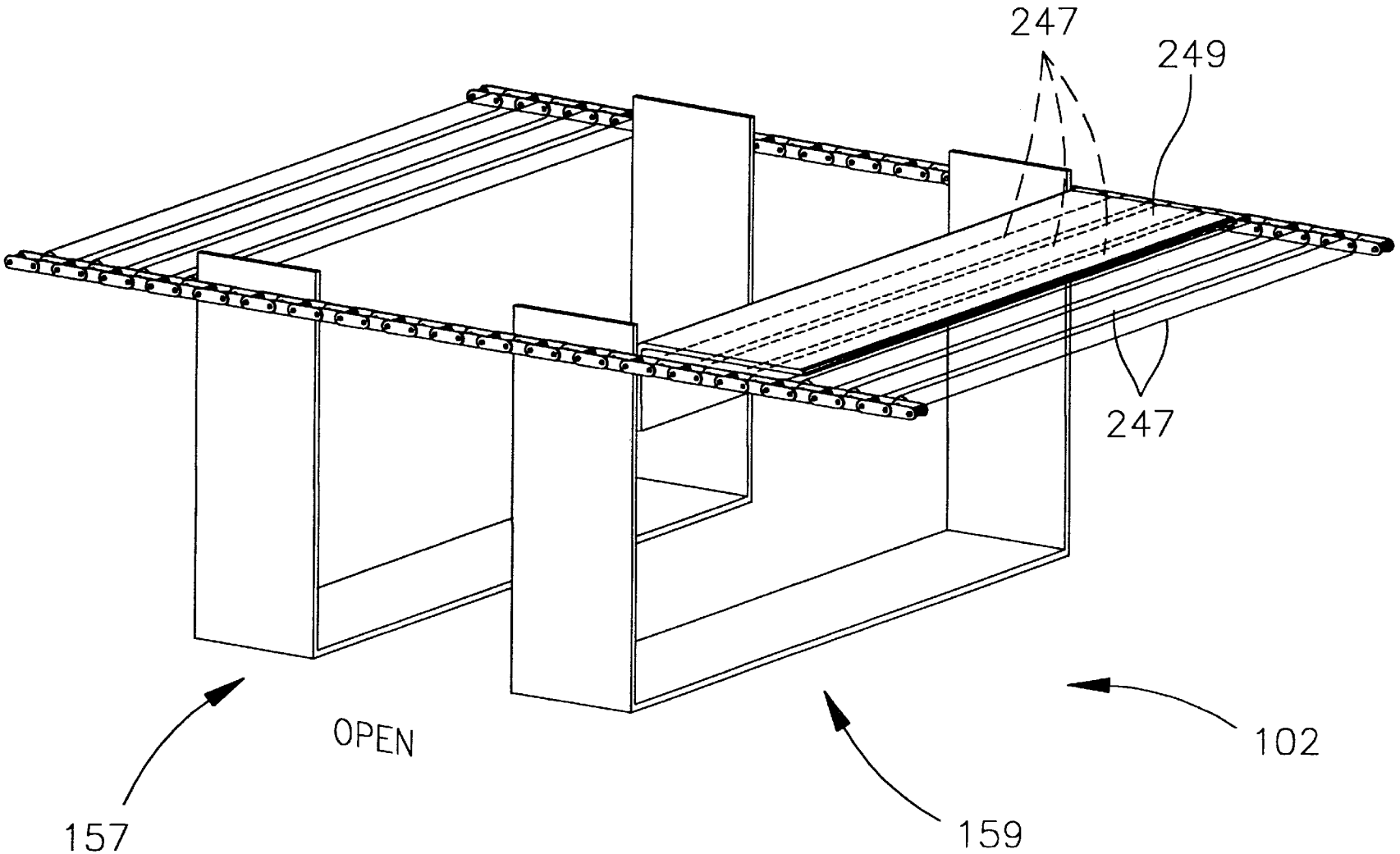
FIG. 7A is a schematic perspective view illustrating the guide mechanism of FIG. 3 in an open configuration.
Figure 7B:
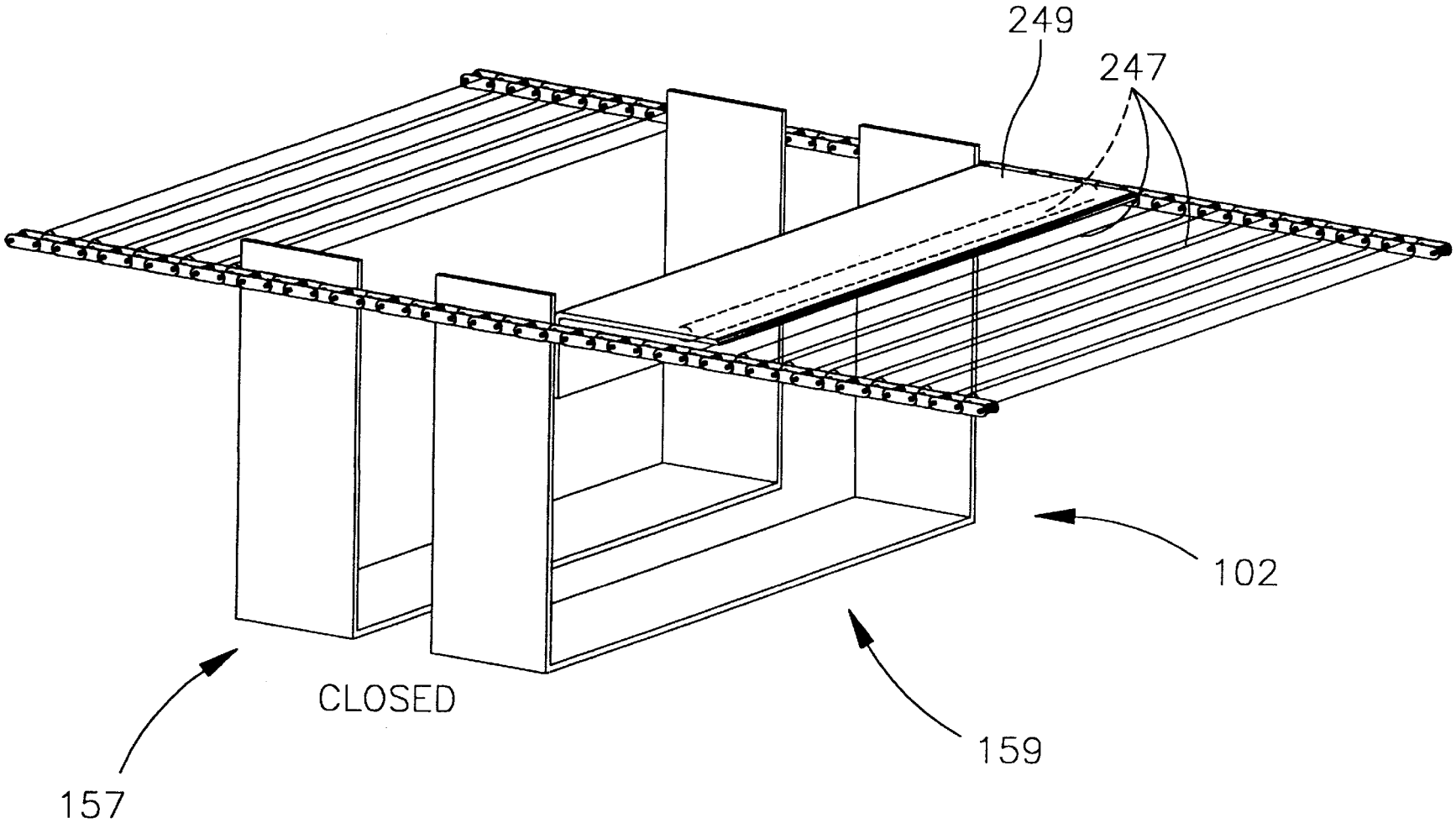
FIG. 7B is a schematic perspective view illustrating the guide mechanism of FIG. 3 in a closed configuration.

Carrier 104 further includes a plurality of bearing elements or bridges, comprising, e.g., supporting rollers 247, rotatably attached to chains 194 and 196. As apparent from FIGS. 7A and 7B, a cover plate 249, affixed to u-shaped member 159 and overlapping at least one roller 247 when guide mechanism 102 is in the closed position (FIG. 7B), compensates for the gap that is formed between member 159 and the leading roller 247 due to the movement of member 159 toward member 157.

Figure 8:
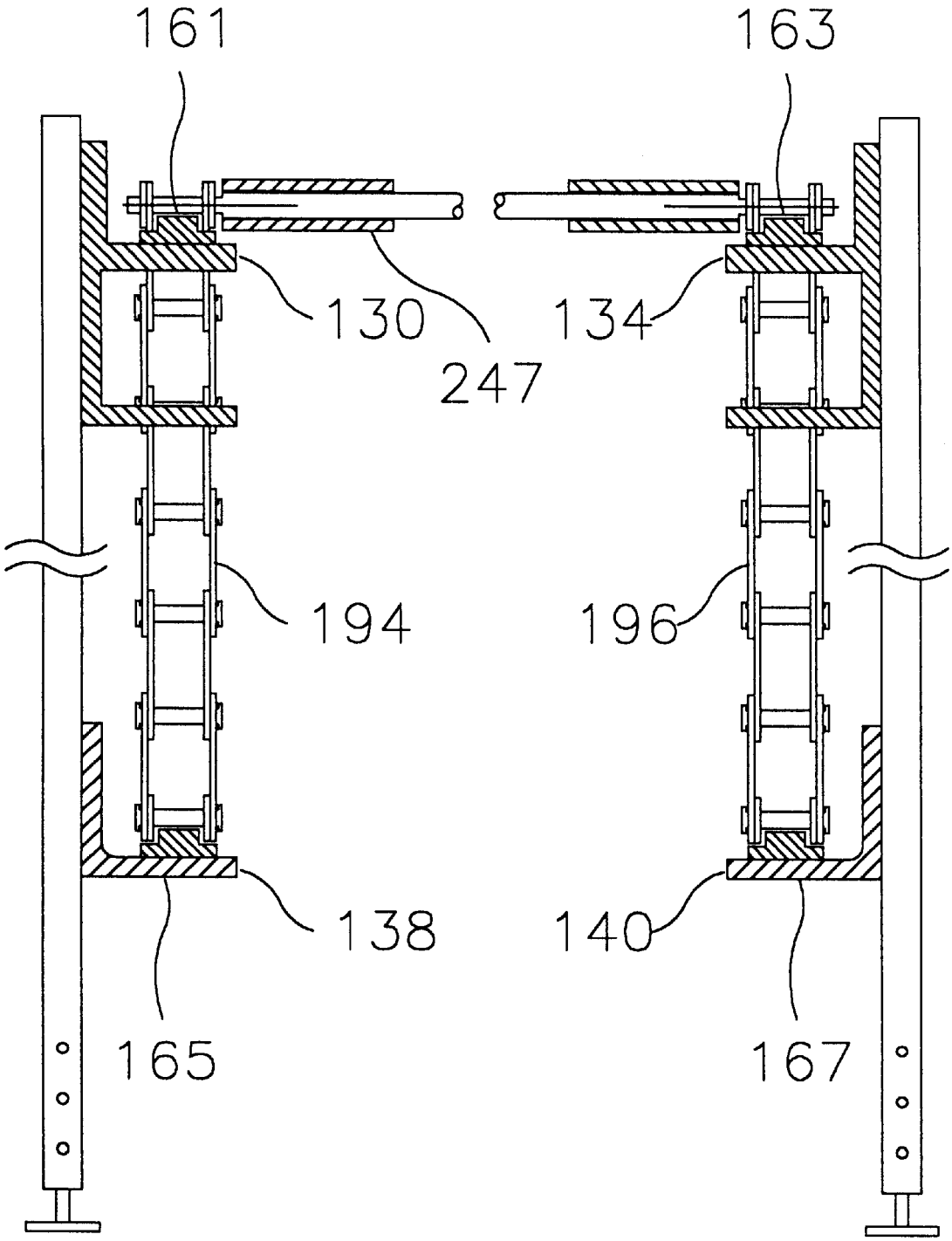
FIG. 8 is a schematic transverse sectional view of the service bed of FIG. 1 illustrating the mounting of the carrier to the chassis.

FIG. 8 illustrates the manner in which chains 194 and 196 are supported by guiding channels 130, 138 and 134, 140, respectively. To guide the chains, tracks 161, 163, 165, and 167 are provided within the channels. To minimize the wear of the chains as well as friction, the tracks may be made of a low-friction material, e.g., ultra-high molecular weight plastic.

Figure 9:
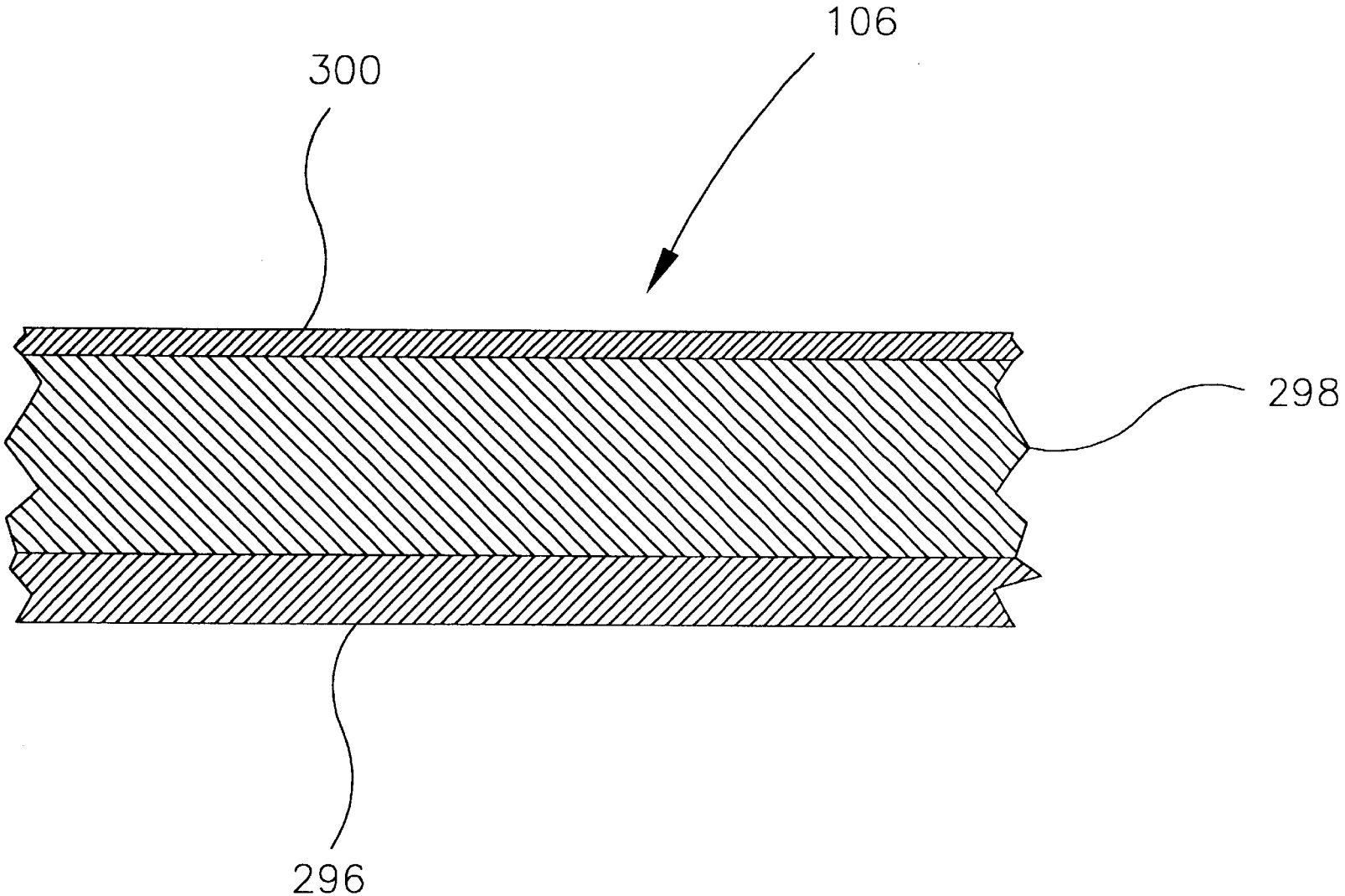
FIG. 9 is a sectional view illustrating the mattress of the service bed of FIG. 1.
Figure 10:
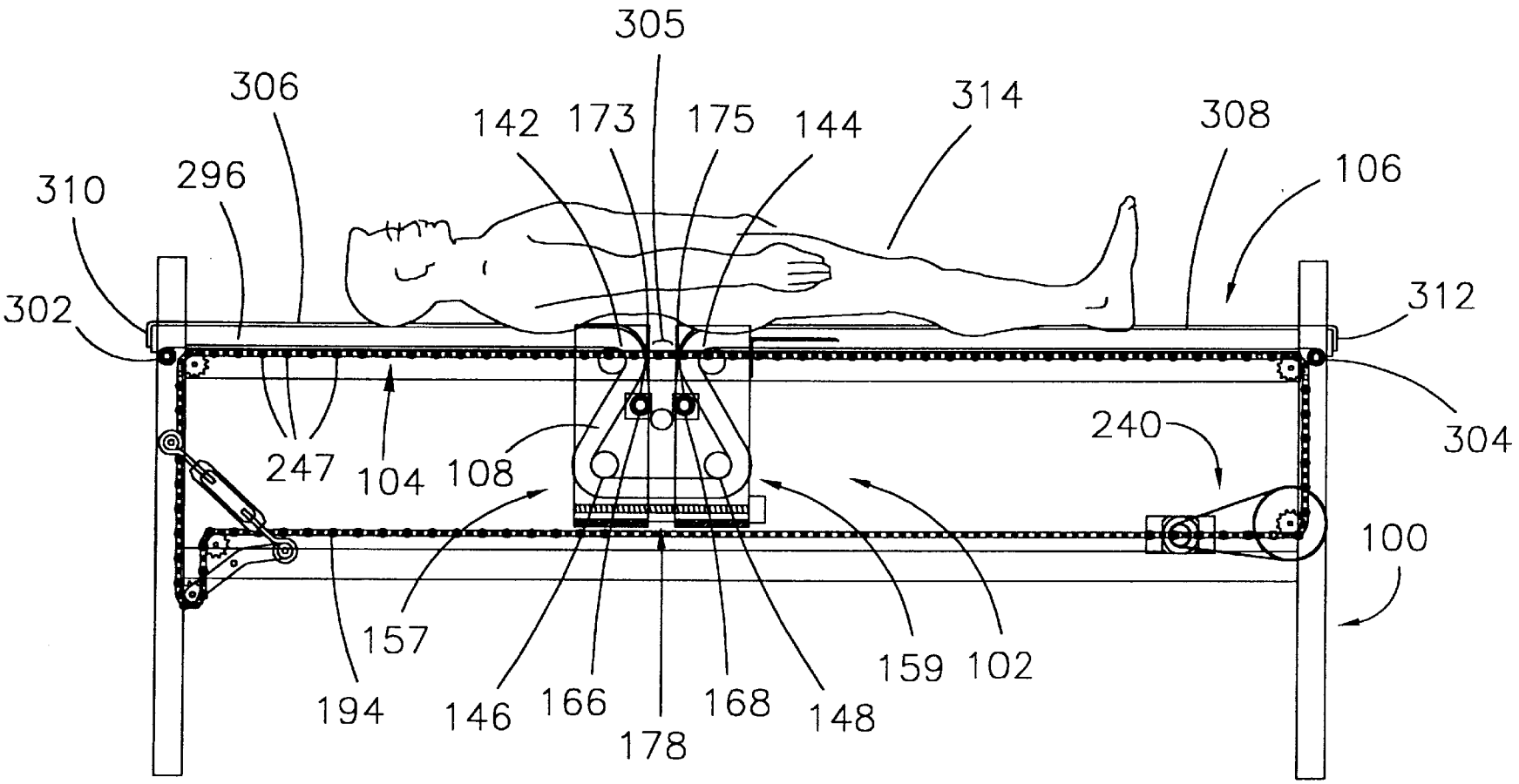
FIGS. 10–12 are schematic side views of the service bed of FIG. 1 illustrating the procedure encompassing deposition and removal of the strata.

FIG. 9 illustrates a cross section of mattress 106 according to one embodiment of the present invention. The mattress includes a base layer 296, made of, e.g., thin reinforced rubber sheet, a cushioning layer 298, made of, e.g., foam, and a liquid-proof layer 300, made of, e.g., plastic material having antibacterial properties. Layers 296, 298, and 300 may or may not be made integral with each other. Cushioning layer 298 may be encapsulated by liquid-proof layer 300 (not shown). The thickness of layer 298 may be from about 12.7 mm (0.5 inches) to about 30.5 cm (12 inches). It is apparent from FIG. 1 that carrier 104 supports mattress 106 and is movable relative thereto. FIG. 10 illustrates that the longitudinal ends of layer 296 of the mattress are attached to chassis 100 via tensioners 302 and 304. The tensioners may be used to remove any slack in mattress 106 and also to vary the cushioning properties thereof. The tensioners may have rotary or linear configurations, and may be adjustable either manually or with the use of electric motors (not shown). Those skilled in the art will appreciate that a single tensioner may be utilized. It is also possible to omit tensioners 302 and 304 altogether by attaching the ends of the mattress directly to the chassis so that base layer 296 is in tension. Undulation 108 of mattress 106 is formed by routing the mattress over guide roller 142, under guide rollers 146 and 148, and over guide roller 144. Undulation 108 has a variable span 305. Mattress 106 supports strata 306 and 308 (e.g., linen sheets), two ends of which are coupled with dispensing and collecting rollers 166 and 168, respectively, using, e.g., hook-and-loop fasteners. The opposite ends of strata 306 and 308 are attached to chassis 100 along mounting regions 310 and 312, e.g., with hook and loop fasteners (not shown).

The service bed according to the above-described embodiment of the invention may be used to implement a variety of essential medical and nursing procedures. For example, the service bed allows strata 306 and 308 (e.g., linen sheets), shown in FIG. 10, to be removed and installed substantially without moving or disturbing an occupant 314 of the bed and without frictional movement (i.e., rubbing) of the strata or any components of the bed relative to the occupant. The method of removing and installing the strata is generally implemented by collecting at least one stratum, located between occupant 314 and mattress 106, into a valley or space defined by undulation 108 formed in the mattress and by dispensing, between the occupant and the mattress, at least one other stratum from the aforementioned valley as the undulation is moved under the patient from one end of the bed to the other. The method of removing and installing the strata encompasses, among other procedures, a linen change for a bed-bound patient. The service bed according to the above-described embodiment of the present invention allows the linen to be changed without expending the considerable time and effort traditionally required for such a task and without causing the patient to suffer physical and psychological discomfort associated with conventional methods of changing linen currently employed for bed-bound patients.

Many of the procedures amenable to implementation by the service bed according to the above-described embodiment of the invention (FIG. 10), including that of removing and installing the strata, are associated with the movement of guide mechanism 102 relative to occupant 314. It should be understood that whenever guide mechanism 102 is under the occupant, span 305 should be adjusted within a specific range having a lower and an upper limit. At the lower limit, span 305 should be such that substantially no friction exists between stratum 306 and stratum 308 during the movement of guide mechanism 102. At the upper limit, span 305 should be such that the sagging of occupant 314 into the valley formed by undulation 108 is controllable. Even though it is appropriate to maintain the size of span 305 within the above-described range under most conditions, other criteria may govern the size of the span. For example, in some cases, the minimum size of span 305 should be such that no contact exists between stratum 306 and stratum 308 to prevent cross-contamination of the strata as well as unnecessary wear of the strata due to friction therebetween. In the above situation, the minimum size of the span may have to be somewhat greater than the size of the span corresponding to the lower limit of the aforementioned range. The size of span 305 is controlled by lead-screw mechanism 178, as has been previously described with reference to FIG. 3.

Figure 11:
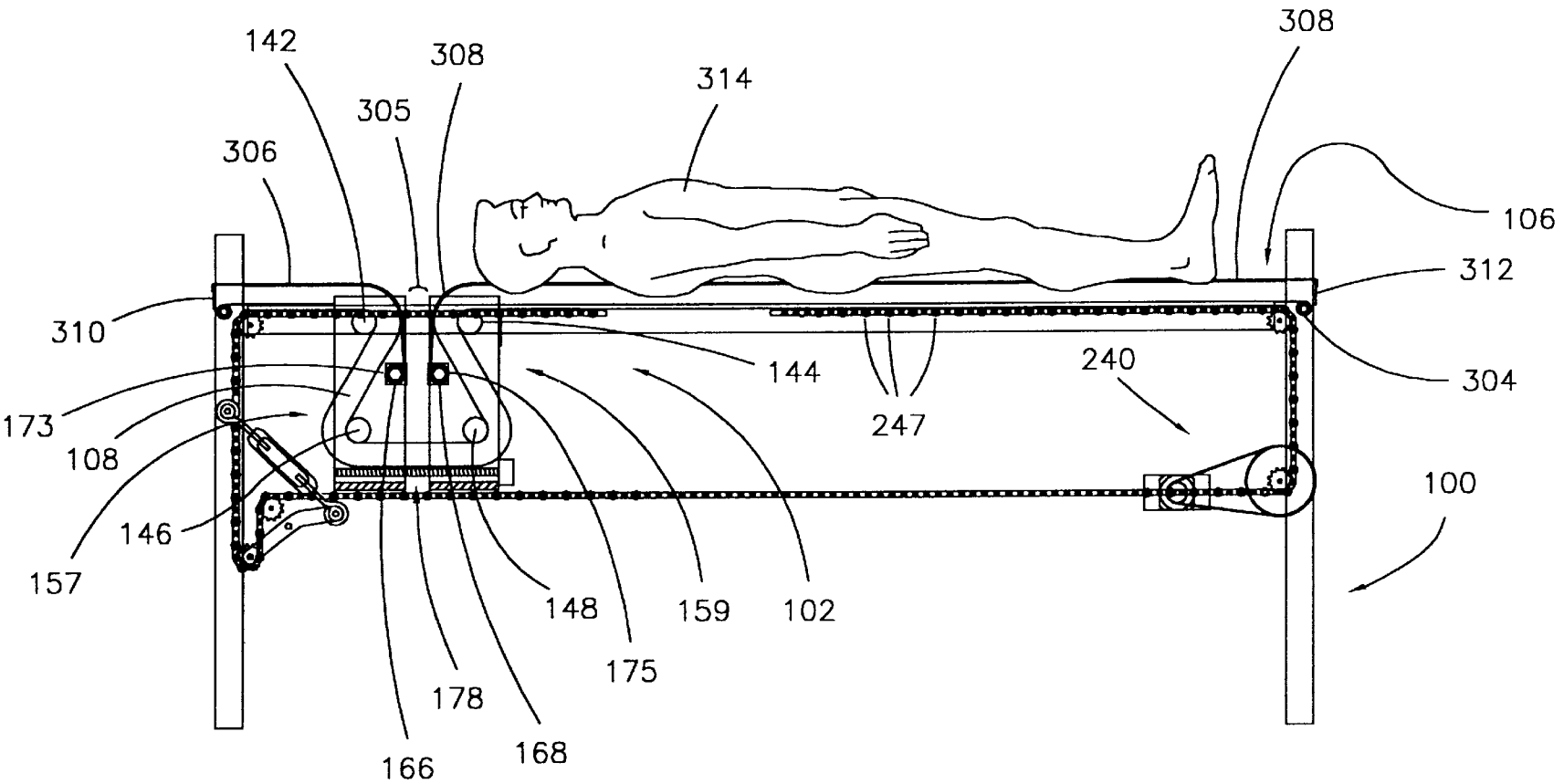

The details of the procedure for removing and installing the strata are described with reference to FIGS. 10–12. To remove stratum 306 (and replace it with a new one, if required), drive mechanism 240 is caused to engage chain 194 and chain 196 (which is not visible in FIGS. 10–12), translating guide mechanism 102 from an arbitrary initial position, e.g., as illustrated in FIG. 10, to the left end of the bed beyond occupant 314, as shown in FIG. 11. During the movement of the guide mechanism, friction between mattress 106 and guide rollers 142, 144, 146, and 148 causes guide rollers 142 and 144 to roll along the bottom surface of the mattress and guide rollers 146 and 148 to roll along the top surface of the mattress. Mattress 106 is born by supporting rollers 247 that roll along the bottom surface of mattress 106 as chains 194 and 196 translate relative to the mattress. The rolling motion of the guide rollers and the supporting rollers relative to the mattress permits guide mechanism 102 to translate smoothly with respect to chassis 100. The movement of guide mechanism 102 with respect to the chassis causes undulation 108 to propagate along the mattress. As guide mechanism 102 moves toward the left end of the bed, stratum 306 is collected (i.e., wound) onto roller 166, which is rotated by motor 173, whereas roller 168, containing stratum 308, unwinds responsive to the movement of the guide mechanism, dispensing stratum 308 between occupant 314 and mattress 106 without frictional movement of stratum 308 relative to the occupant. While roller 168 unwinds, motor 175 may be activated to provide limited torsional opposition to the rotation of the roller, whereby stratum 308 is maintained in tension to prevent wrinkling of the stratum. Those skilled in the art will appreciate that strata 306 and 308 may be wound on rollers 166 and 168, respectively, such that directions of rotation of motors 173 and 175 will remain the same regardless of whether guide mechanism 102 is traveling from right to left or vice versa. Alternatively, the strata may be wound in a manner that requires the directions of motor rotation to be reversible in accordance with the direction of movement of guide mechanism 102.

When guide mechanism 102 reaches the left end of the bed, the guide mechanism triggers conventional limit switches (not shown). The signals produced by the switches cause drive mechanism 240 to shut down, thus halting the movement of guide mechanism 102.

Once guide mechanism 102 reaches the left end of the bed (FIG. 11) and comes to a stop, stratum 306, substantially all of which has been collected onto roller 166, may be accessed from the sides of the guide mechanism or from the top thereof in order to be removed. To provide sufficient access to stratum 306, lead-screw mechanism 178 is activated to increase span 305 of the undulation by translating unshaped member 159, which supports guide rollers 144 and 148, away from u-shaped member 157, which supports guide rollers 142 and 146. To remove stratum 306, the end thereof, removably attached to chassis 100 along mounting region 310, e.g., using hook and loop closures or other conventional fastening means, is first decoupled from the chassis. Roller 166, on which substantially all of stratum 306 has been collected, is then demounted from u-shaped member 157. A new stratum 306 may then be wound onto roller 166 and the roller reinstalled into unshaped member 157. Alternatively, a new roller 166, on which a new stratum 306 has been prewound, may be installed into the u-shaped member 157. The free end of new stratum 306 is then attached to chassis 100 along mounting region 310.

As has been discussed above, before a new stratum 306 (e.g., a linen sheet) is installed, span 305 of undulation 108 should be adjusted such that a sufficient distance between new stratum 306 and stratum 308 exists to prevent cross-contamination of the strata (thus maintaining sanitary conditions) and to avoid unnecessary wear of the strata due to friction therebetween.

Figure 12:
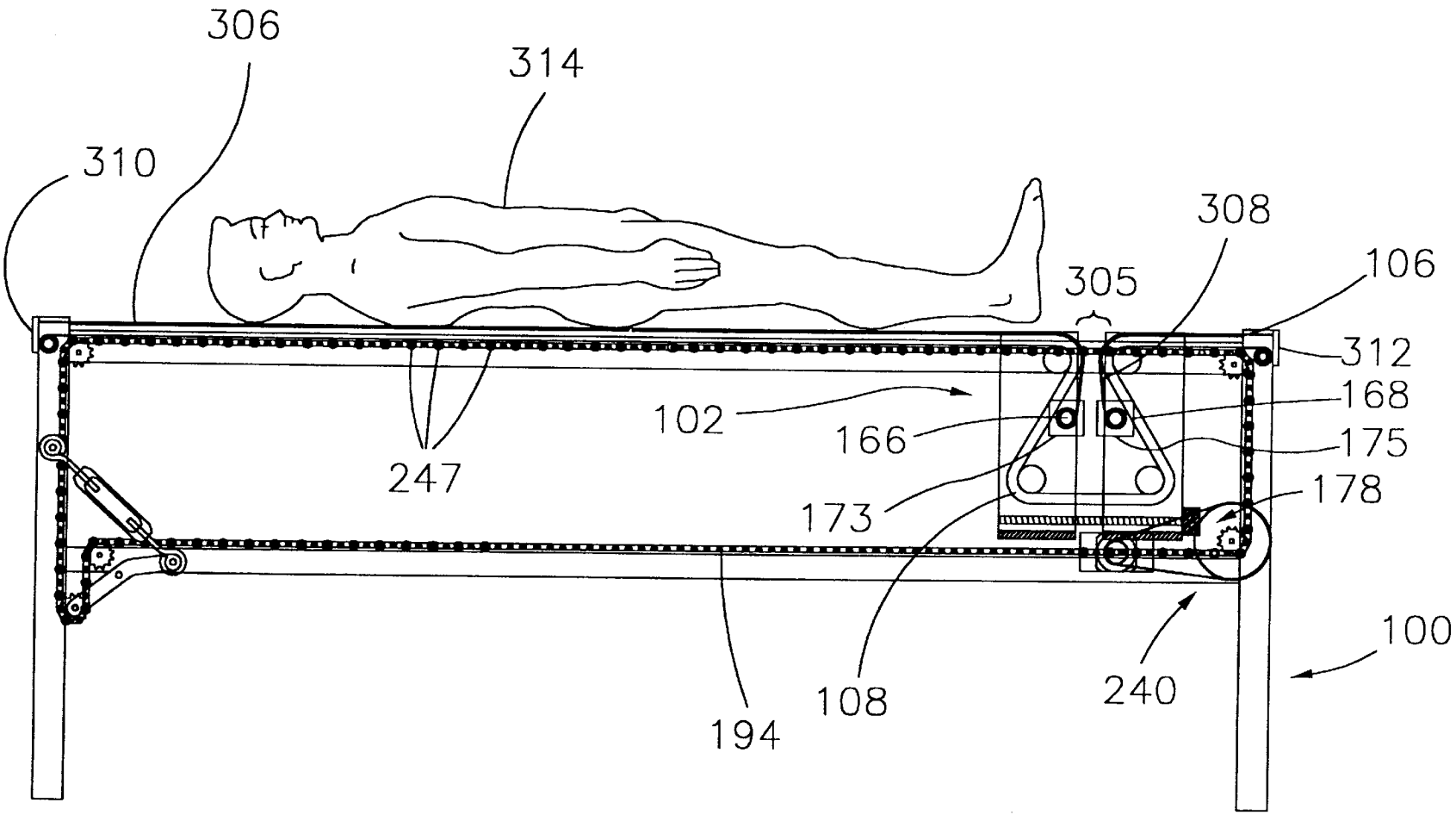

To remove stratum 308 (and replace it with a new one, if required), drive mechanism 240 is caused to engage chain 194 and chain 196 (which is not visible in FIGS. 10–12), translating guide mechanism 102 to the right end of the bed beyond occupant 314, as shown in FIG. 12. As guide mechanism 102 moves toward the right end of the bed, stratum 308 is collected onto roller 168, which is rotated by motor 175, whereas roller 166, containing stratum 306, unwinds responsive to the movement of the guide mechanism, dispensing stratum 306 between occupant 314 and mattress 106 without frictional movement of stratum 306 relative the occupant. While roller 166 unwinds, motor 173 may be activated to provide limited torsional opposition to the rotation of the roller, so that the tension of stratum 306 is maintained to prevent wrinkling of the stratum. When guide mechanism 102 reaches the right end of the bed, the guide mechanism triggers conventional limit switches (not shown). The signals produced by the switches cause drive mechanism 240 to shut down, halting the movement of guide mechanism 102.

Once guide mechanism 102 reaches the right end of the bed and comes to a stop, stratum 308 may be removed (and replaced, if required) in substantially the same way as stratum 306, as described above. It should be understood that it is not necessary to position guide mechanism 102 beyond occupant 314 to be able to remove and replace strata 306 and 308. Even if guide mechanism 102 is positioned under the head or the foot region of the occupant, the corresponding stratum can still be removed (and a new stratum installed) if the head or the feet of the occupant are displaced a small distance from the mattress, e.g., by the hand of a care giver.

It should be noted that any time guide mechanism 102 is positioned under occupant 314, span 305 of undulation 108 is adjusted so that no part of occupant 314 protrudes into the span sufficiently to cause uncontrolled sagging of the occupant into the valley formed by undulation 108.

Figure 13:
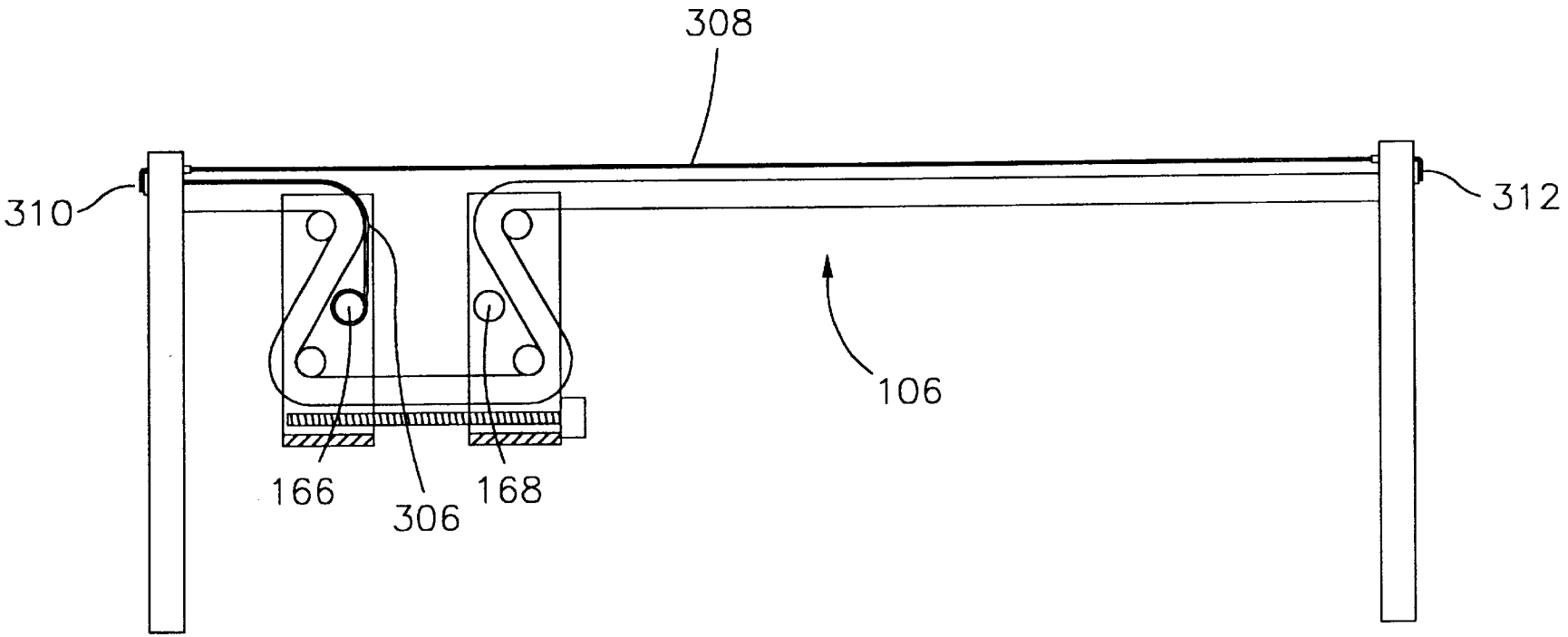
FIGS. 13–15 are schematic side views of the service bed of FIG. 1 illustrating a variant of the procedure encompassing deposition and removal of the strata.
Figure 14:
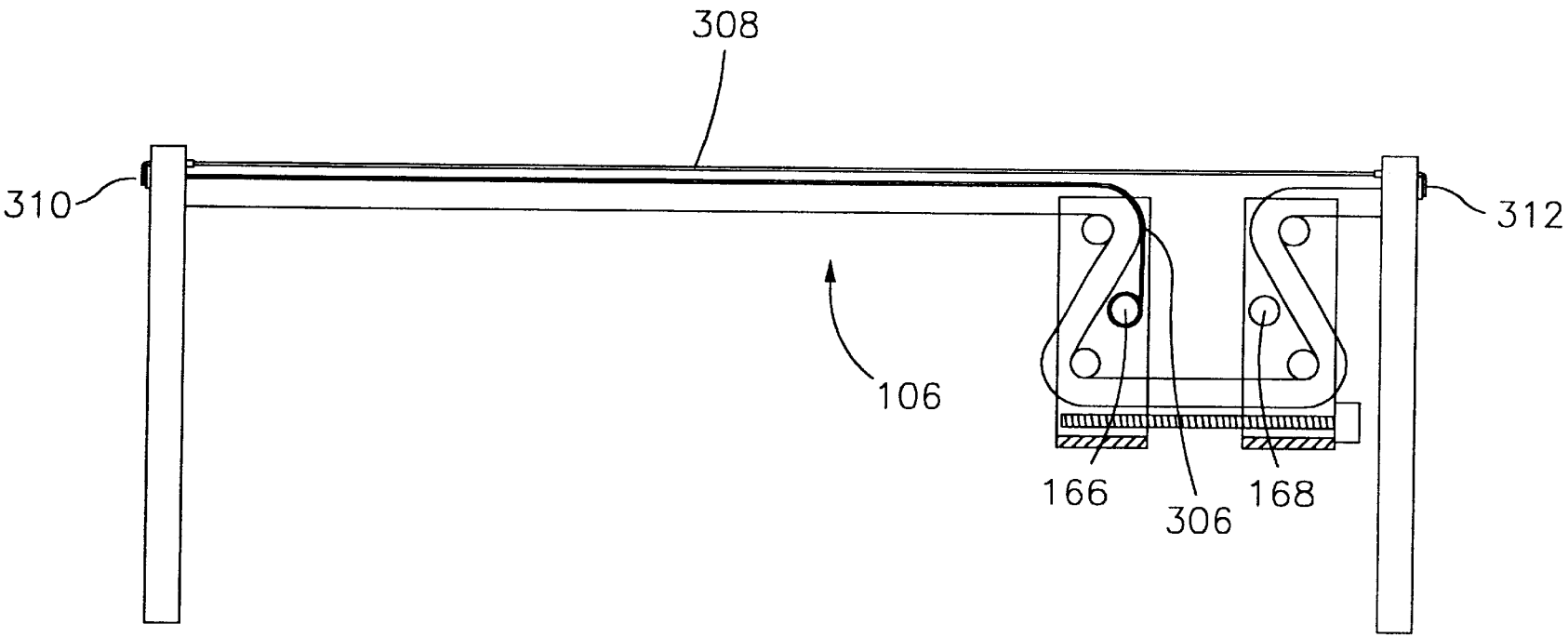
Figure 15:
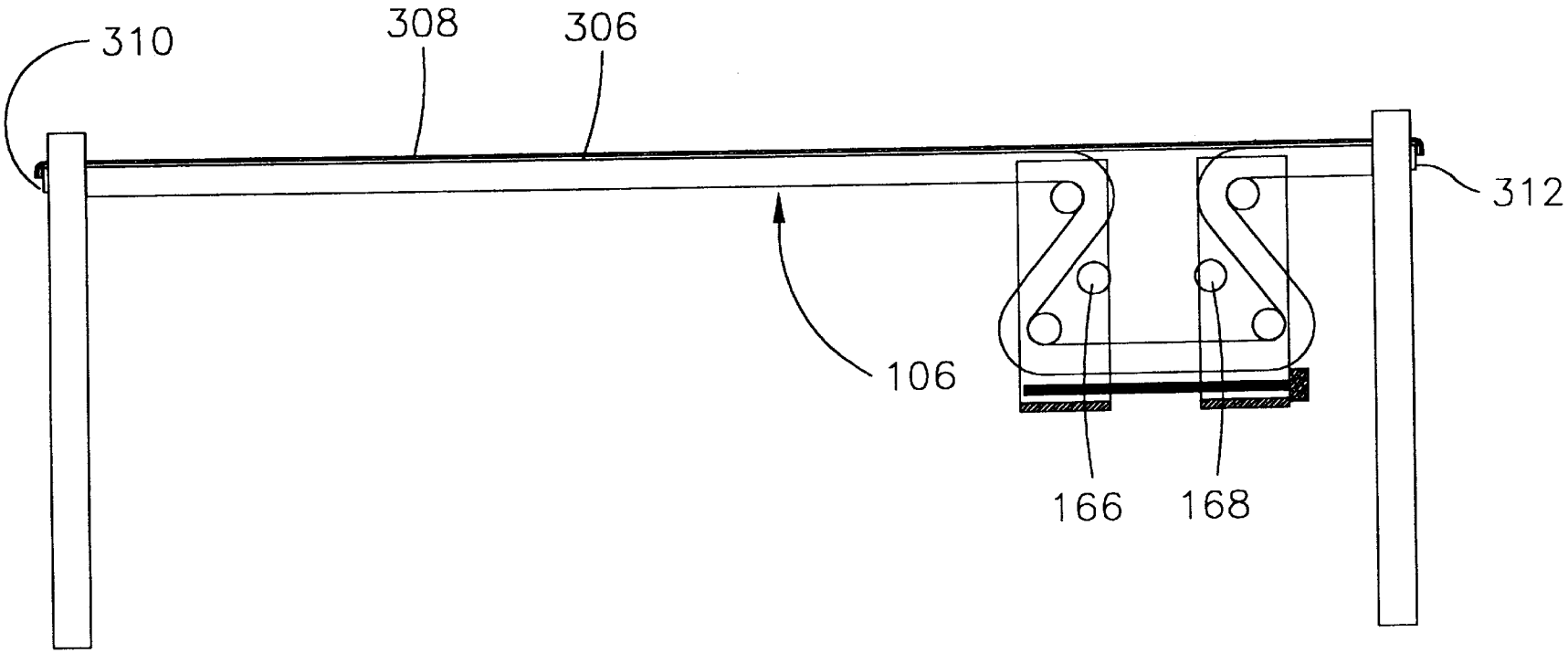

A number of variations with respect to deposition and removal of the strata are possible. For example, with guide mechanism 102 at the left end of the bed (FIG. 11), the end of stratum 308 may be decoupled from roller 168 and attached to chassis 100 along mounting region 310. The opposite end of stratum 308 is already attached to the chassis along mounting region 312. Once both ends of the stratum are attached to the chassis, any number of strata may be sequentially deposited between mattress 106 and stratum 308. For example, after both ends of stratum 308 have been attached to the chassis, as shown in FIG. 13, stratum 306 may then be deposited between mattress 106 and stratum 308, as illustrated in FIG. 14, by translating guide mechanism 102 to the right end of the bed. As evident from FIG. 15, both ends of stratum 306 may then be attached to the chassis along mounting regions 310 and 312. Additional strata may further be deposited between stratum 306 and mattress 106 in a similar manner.

Figure 16:
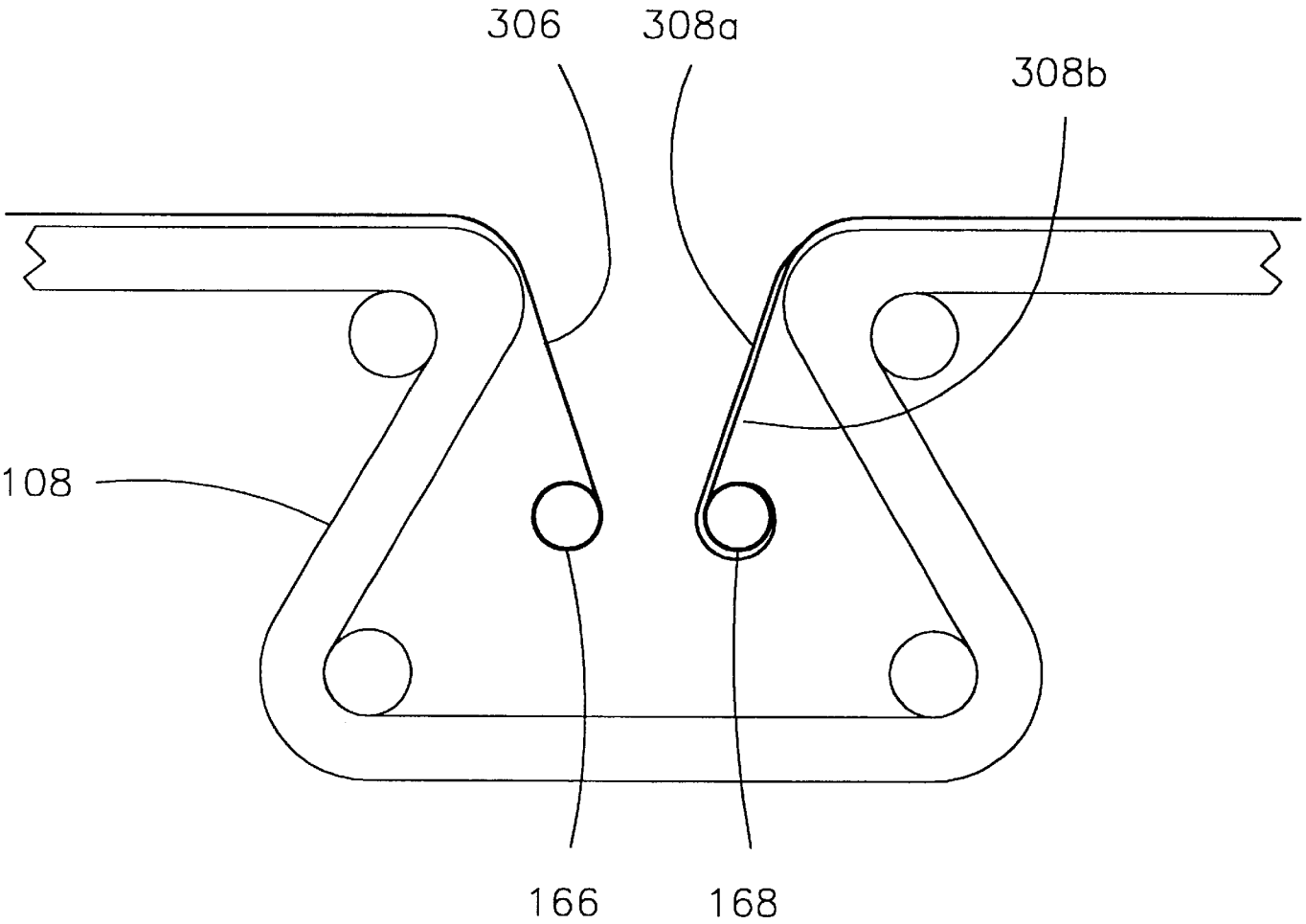
FIG. 16 is a schematic side view of the guide mechanism of FIG. 3.

Instead of linen sheets, strata 306 and 308 may comprise other items, such as thermo-control sheets, blankets (e.g., containing magnets), medicated treatment pads, mats, inflatable mattresses, and bathing devices. These articles are wound onto dispensing and collecting rollers 166 and/or 168 in a substantially-flat configuration and then are deposited between the occupant of the bed and the mattress as described above. Linen sheets and/or other articles may then be sequentially installed underneath, if needed. Moreover, a plurality of strata may be simultaneously deposited between the occupant of the bed and the mattress. To accomplish this, the plural strata (e.g., strata 308*a* and 308*b*) are wound on the same dispensing and collecting roller 166 or 168, as shown in FIG. 16.

Figure 17:
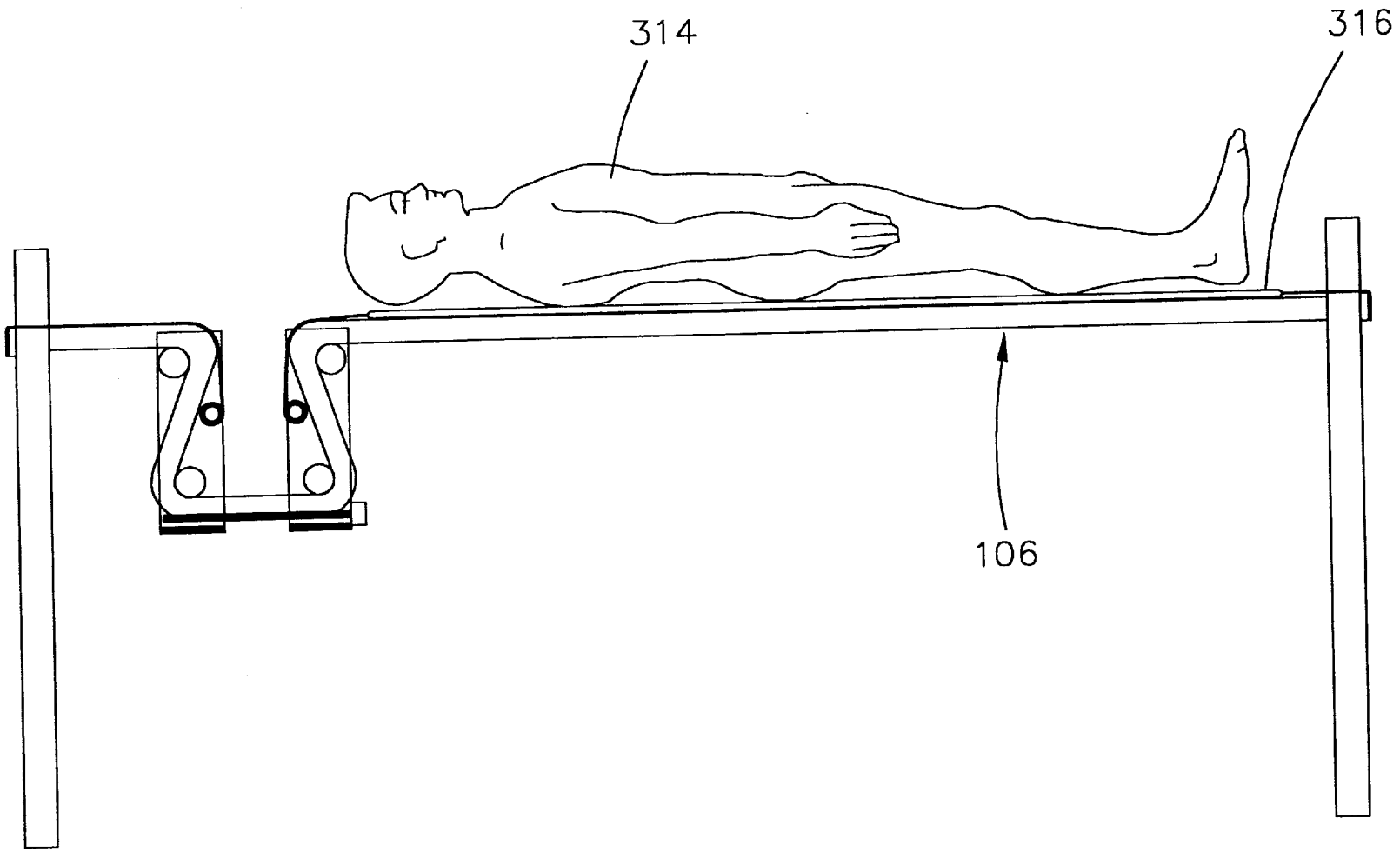
FIG. 17 is a schematic side view of the service bed of FIG. 1 illustrating a bathing device being deposited on the service bed.
Figure 18:
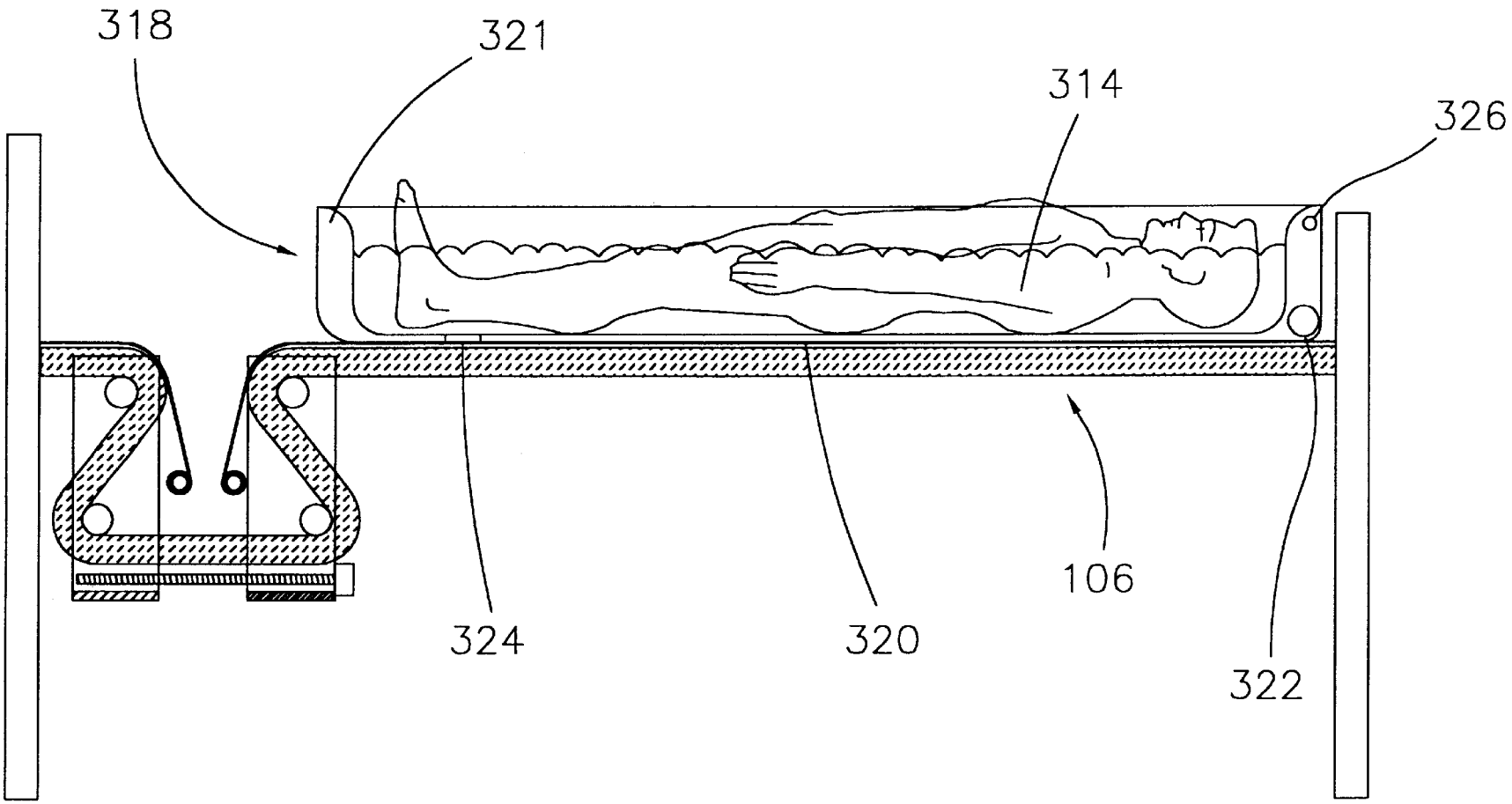
FIG. 18 is a schematic side view of the service bed of FIG. 1 supporting a bathing device which comprises an inflatable basin.
Figure 19:
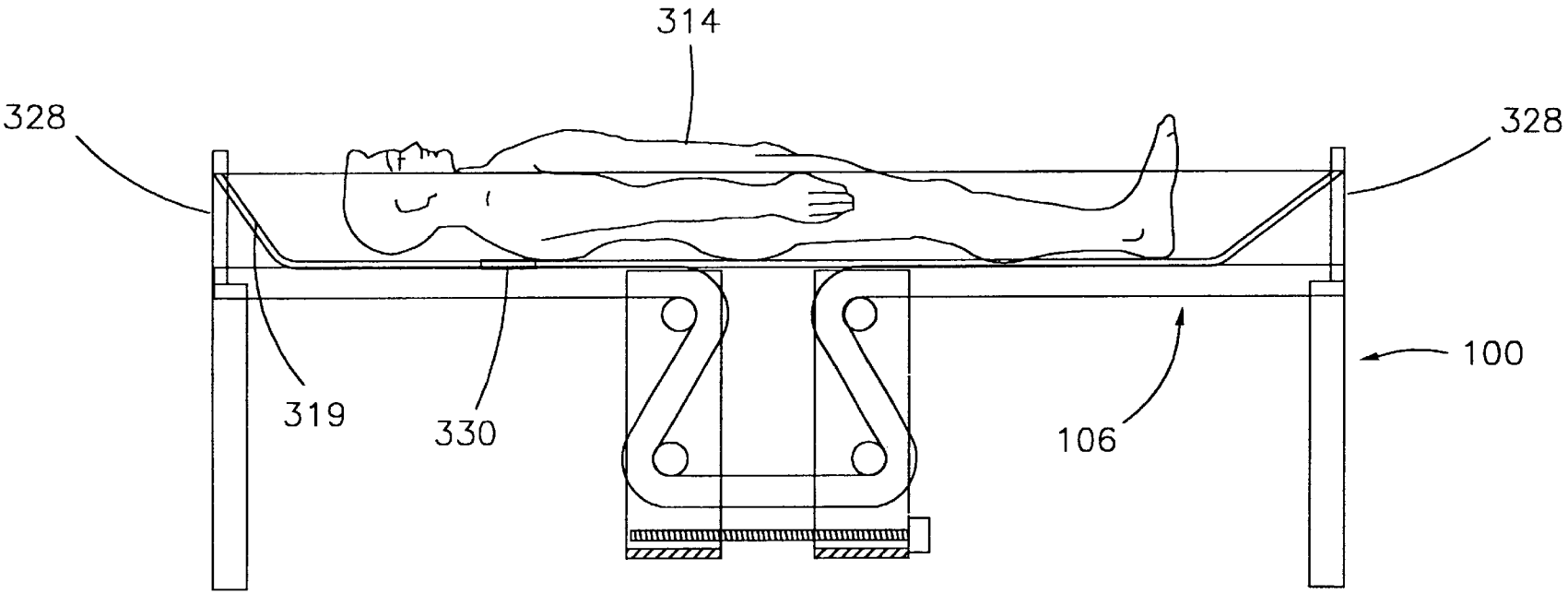
FIG. 19 is a schematic side view of the service bed of FIG. 1 supporting a bathing device which comprises a watertight membrane.

As stated above, a bathing device can be deposited between the mattress and the occupant in the form of a stratum. The bathing device, designated by reference numeral 316, is initially deposited between occupant 314 and mattress 106 in a substantially-flat configuration, as depicted in FIG. 17, and is then erected in a manner consistent with its design. For example, bathing device 316 may comprise an inflatable basin 318, shown in FIG. 18, or a watertight membrane 319, illustrated in FIG. 19. As apparent from FIG. 18, basin 318 includes a bottom portion 320 and a continuous inflatable wall 321. A pump 322 is used to inflate wall 321. Pump 322 may be built into wall 321 or may be separate therefrom. After wall 321 is inflated, the basin can be filled with water or a medicated solution. Bottom portion 320 contains a drain 324, through which the contents of the basin can discharged upon the completion of the bathing procedure or treatment. Wall 321 incorporates an air-release valve 326. As noted above with reference to FIG. 19, another embodiment of the bathing device is watertight membrane 319. After membrane 319 is deposited underneath occupant 314 in a manner described with reference to FIG. 17, it is unfolded and its corners are fastened to posts 328, attached to chassis 100. Erected thusly, membrane 319 can be filled with water or a medicated solution. The membrane also includes a drain 330.

Figure 20:
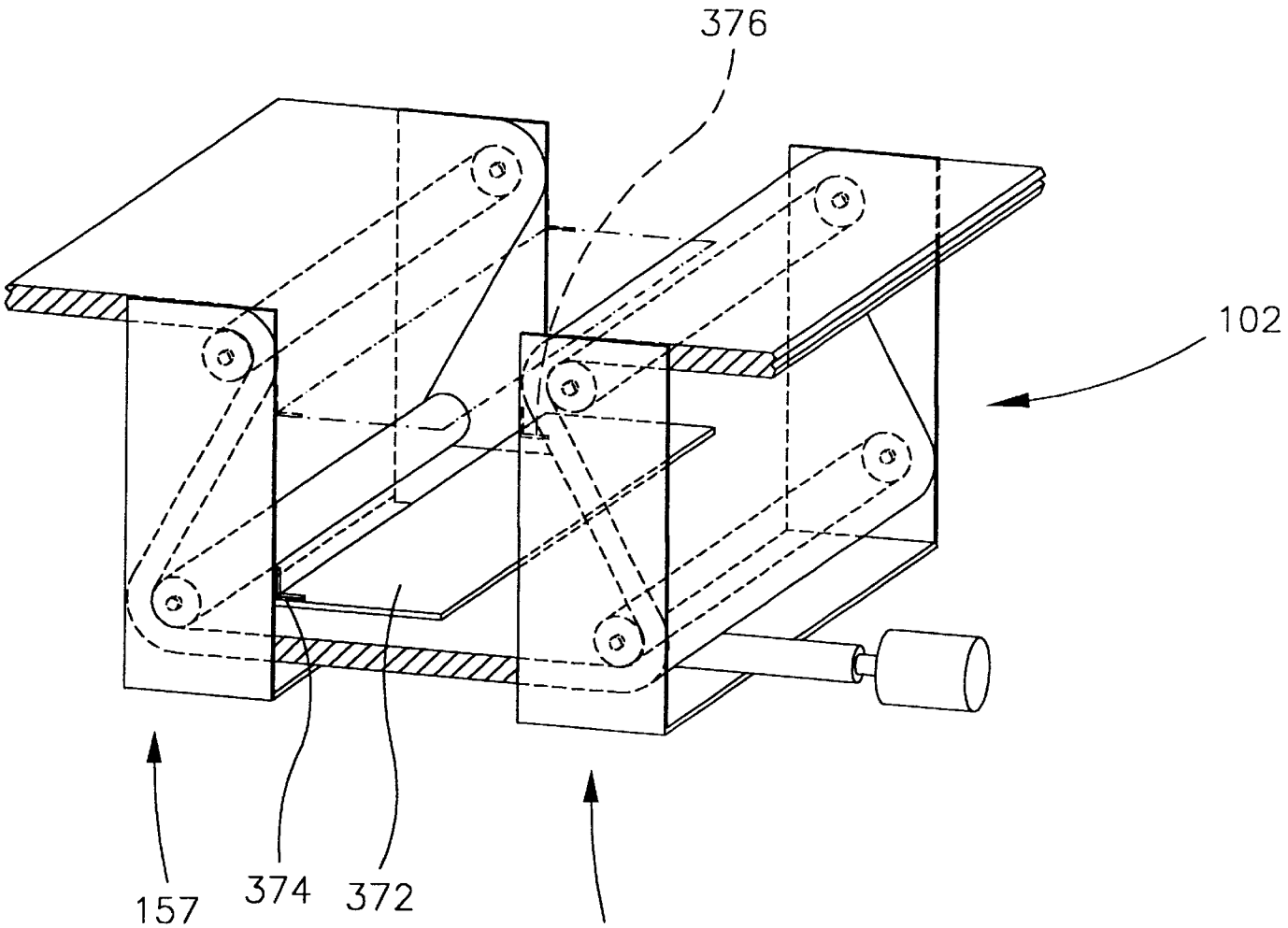
FIG. 20 illustrates the guide mechanism of FIG. 3 further including a mounting plate for monitoring and therapeutic devices.

To provide additional functionality to the service bed, a number of monitoring devices and therapeutic devices may be interchangeably installed in the space defined by the undulation of the mattress. As shown in FIG. 20, such devices can be affixed to a mounting plate 372, which is rigidly and removably attached to u-shaped member 157 of guide mechanism 102 using brackets 374 and 376. It will be apparent to one of ordinary skill in the art that plate 372 may be mounted to guide mechanism 102 in other ways, e.g., by attachment to u-shaped member 159. Furthermore, plate 372 may be height-adjustable, as illustrated.

Figure 21:
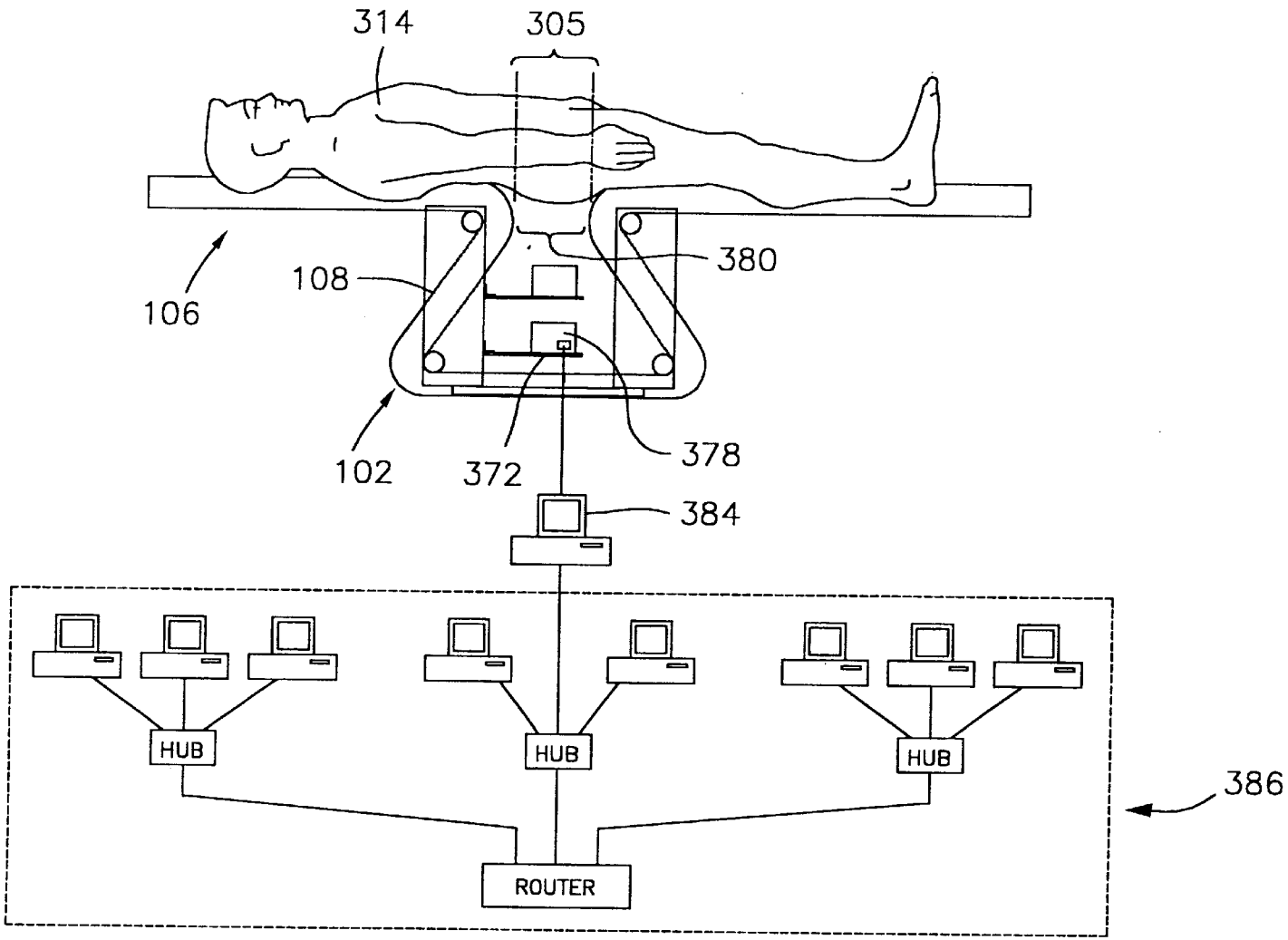
FIG. 21 is a schematic view illustrating the service bed of FIG. 1 further including a monitoring device linked to a computer terminal that is coupled with a computer network.

As stated above, mounting plate 372 may support a removably-installed commercially-available monitoring device 378 (FIG. 21), which may comprise, e.g., a still camera, a video camera, an infrared camera, a mirror or a set of mirrors, an electromagnetic-radiation receiver (e.g., a photographic plate or a fluorescent screen), an ultrasound machine, an infrared thermometer, or a line-sensor-element device (line scanner). As shown in FIG. 21, monitoring device 378 requires that span 305 be adjusted to provide an observation window adequate for monitoring an area of interest 380 of occupant 314.

Figure 22:
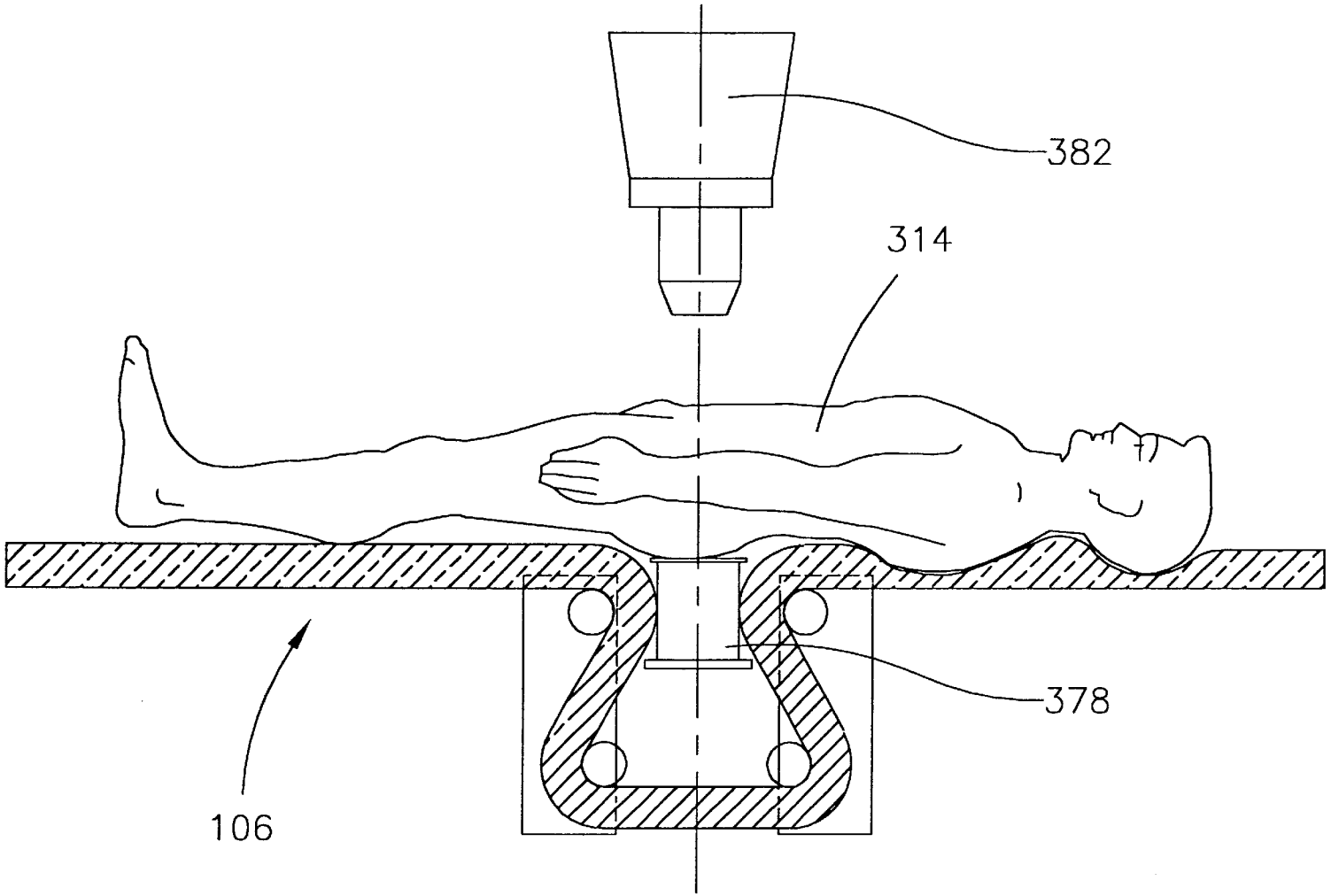
FIG. 22 is a schematic side view of the service bed of FIG. 1 further including a monitoring device comprising an electromagnetic-radiation receiver.

Static monitoring of occupant 314 may be performed once guide mechanism 102 has been positioned in the desired location beneath the occupant, such as area of interest 380, and the requisite observation window for monitoring device 378 has been provided by adjusting span 305. For example, during static monitoring, snap shots of area 380 may be obtained using a still camera; a video camera may be used to record the image of area 380 or to produce a real-time image of the area to be displayed on a video screen (not shown); an infrared camera may be used to generate a thermal image of area 380; a mirror or a system of mirrors may be employed for purposes of visual observation of area 380; an infrared thermometer may be used to measure skin temperature of a particular location within area 380; and a line scanner having a scan line parallel to the head-to-toe line of occupant 314 may be utilized to generate a monochrome (or color) image of area of interest 380. Data collected with the help of the foregoing techniques may then be used to evaluate area 380 for the purposes of early detection and prevention of skin disorders such as bed sores, ulcers, abrasions, lesions, melanomas, and other cancerous formations. Static monitoring of occupant 314 in the area of interest 380 may also be performed with an ultrasound machine, which is useful in detecting deep-tissue and organ disorders. Furthermore, as illustrated in FIG. 22, monitoring device 378 executed in the form of an electromagnetic-radiation receiver (e.g., a photographic plate or a fluorescent screen) may be used in conjunction with an electromagnetic-energy (e.g., x-ray) source 382 to provide static monitoring in the area of interest 380 by generating radiographs useful in diagnosing internal abnormalities so that appropriate therapeutic action can be taken.

To perform dynamic monitoring of occupant 314, span 305 is adjusted to provide the requisite observation window for monitoring device 378 and guide mechanism 102 is then translated relative to occupant 314 in a manner consistent with the medical needs of the occupant (FIG. 21). For example, monitoring device 378 executed as a mirror or a system of mirrors may be used to visually evaluate the condition of the skin along the underside of occupant 314 by translating guide mechanism 102 along a scanning segment. It should be noted that the scanning segment may be as long as the body of the occupant, if required. Furthermore, a video camera or an infrared camera may be used to record images of the underside of occupant 314 while guide mechanism 102 moves relative to occupant 314 along the scanning segment. Similarly, a line scanner having a scan line perpendicular to the head-to-toe line of occupant 314 may be utilized to generate a monochrome (or color) images of the underside of the occupant along the scanning segment. It should be understood that the dynamic monitoring of the occupant may be performed using isolated passes of monitoring device 378 relative to the occupant or may require continuous cycling of the monitoring device. An ultrasound machine may be used in a similar manner for diagnosing internal abnormalities.

Figure 23:
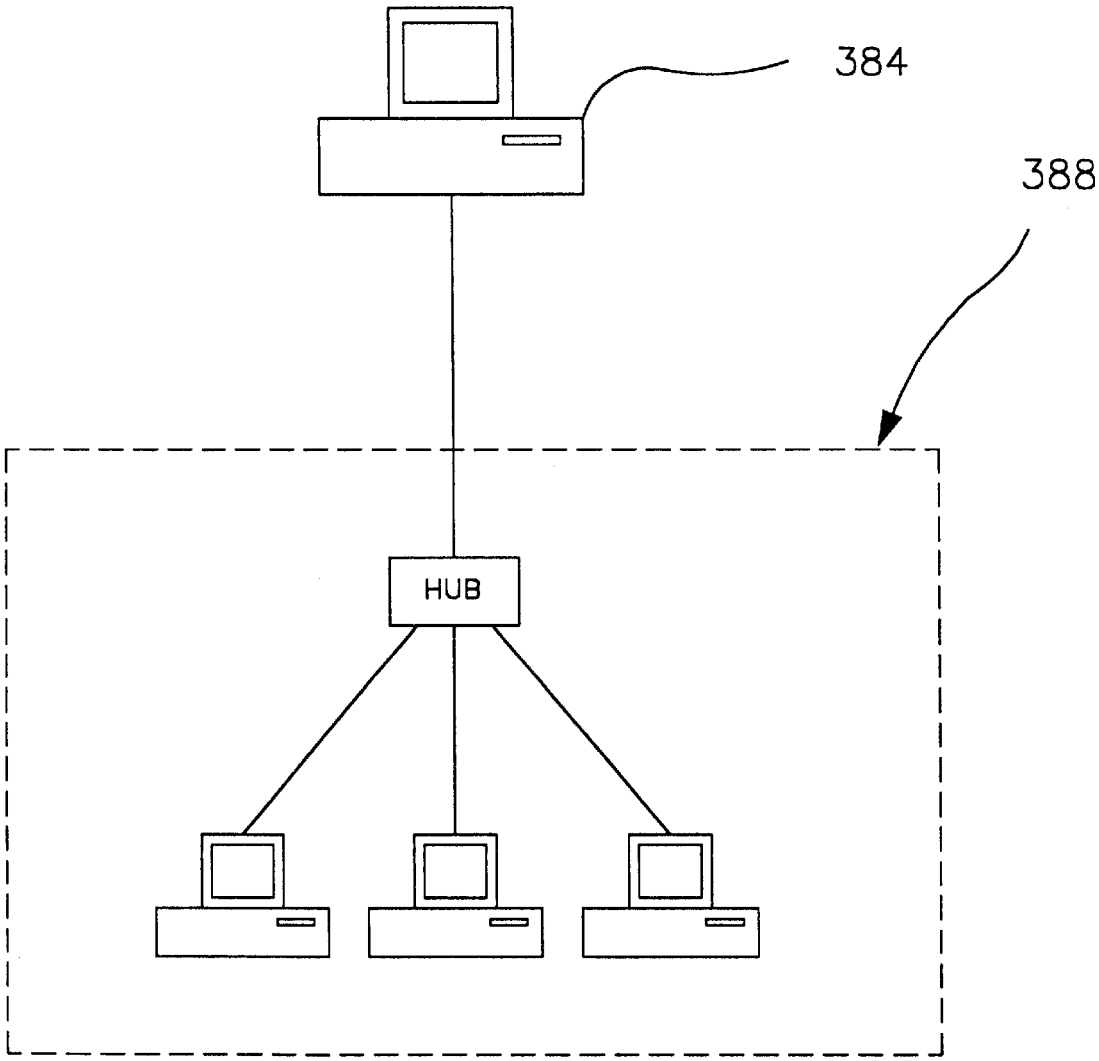
FIG. 23 is a schematic diagram of one type of a computer network capable of being coupled with the computer terminal linked with the monitoring device of FIG. 21.
Figure 23A:
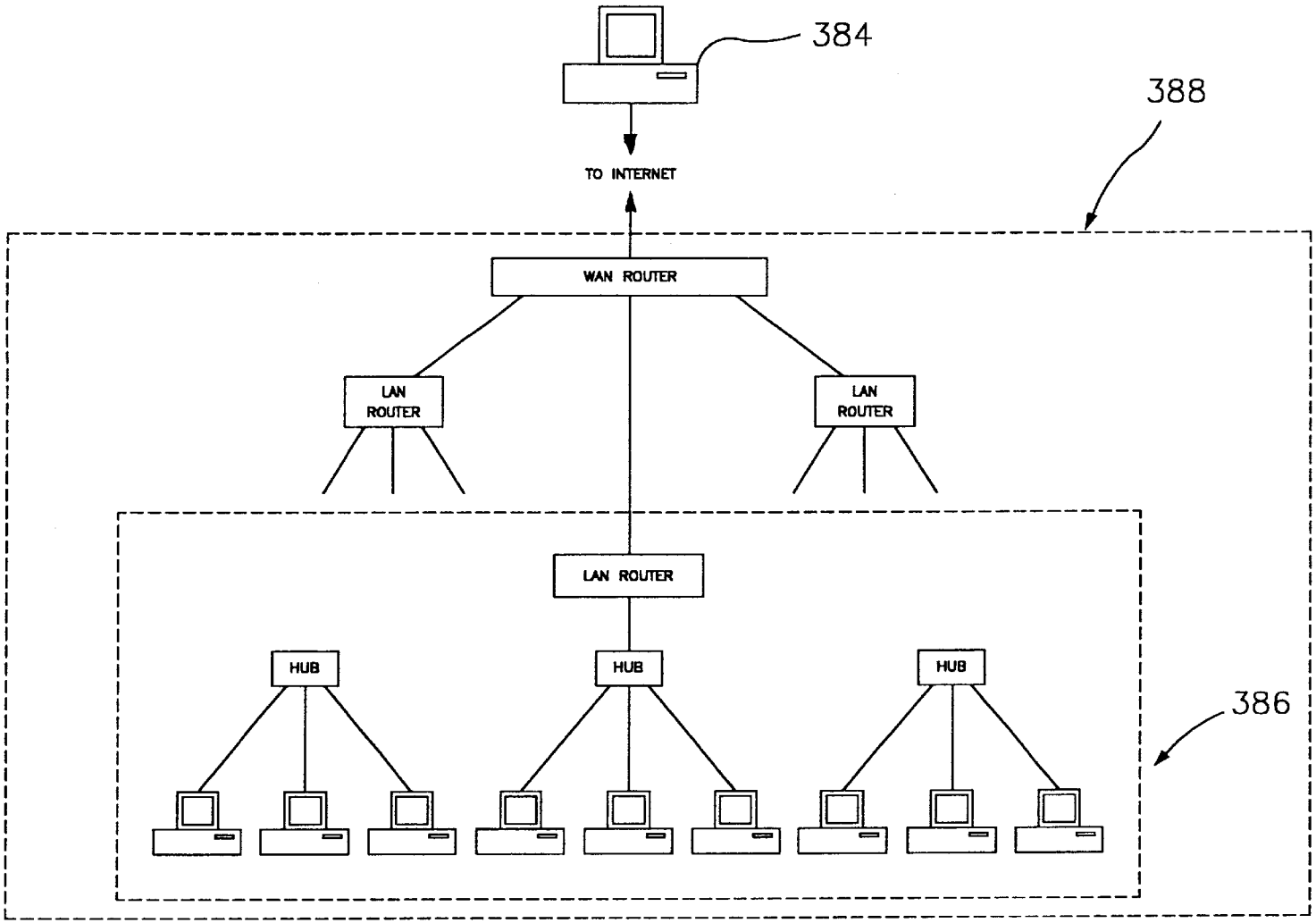
FIG. 23*a* is a schematic diagram of another type of a computer network capable of being coupled with the computer terminal linked with the monitoring device of FIG. 21.
Figure 24:
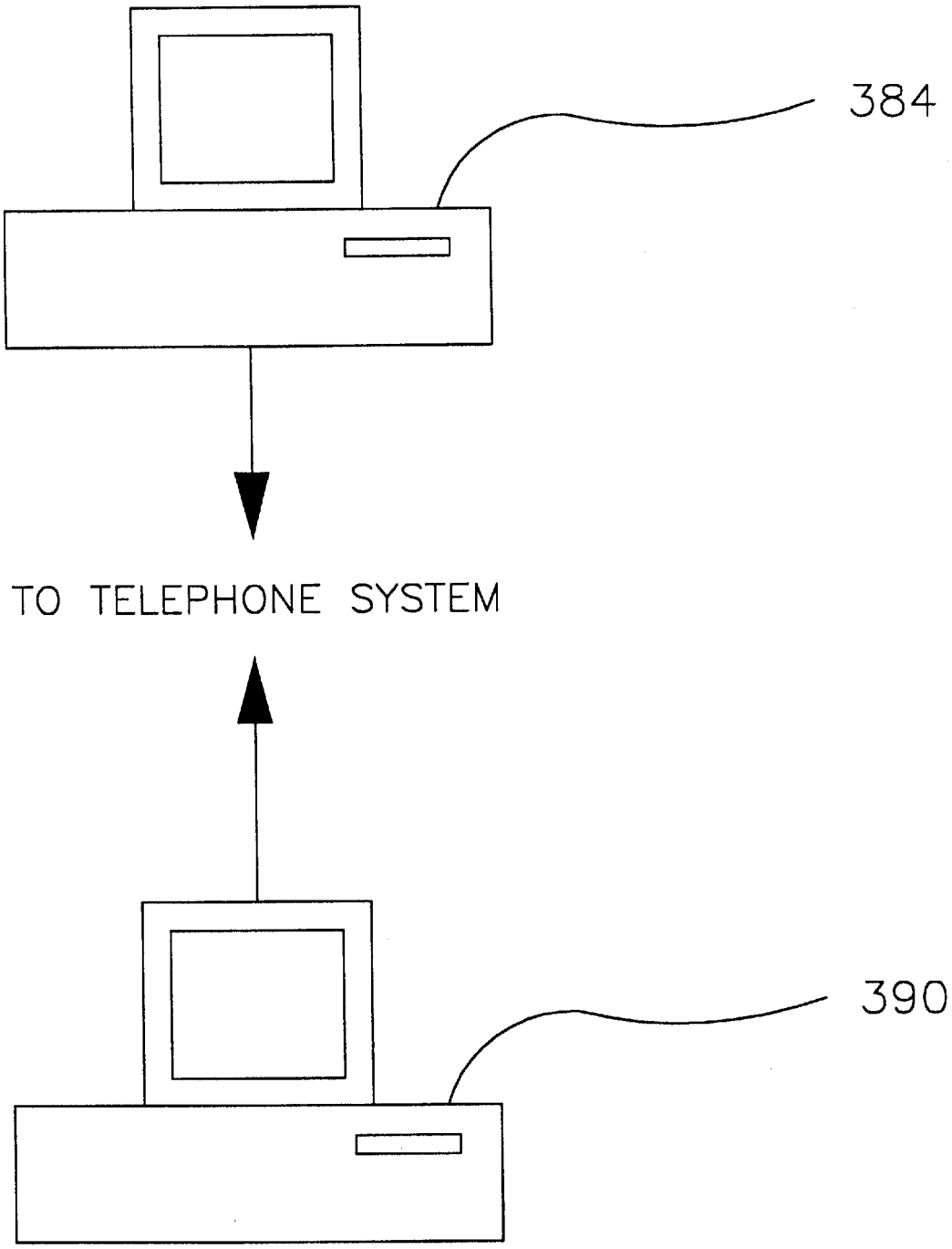
FIG. 24 is a schematic diagram illustrating an alternative type of networked connection for the computer terminal linked with the monitoring device of FIG. 21.

Data obtained by using static and/or dynamic monitoring of occupant 314 may be transmitted to a data terminal 384 (e.g., a digital computer), which is coupled with a computer network, e.g., a local area network (LAN) 386 (FIG. 23). Alternatively, as shown in FIG. 23*a*, data terminal 384 may be connected to LAN 386 through a wide area network (WAN) 388. As illustrated in FIG. 24, data terminal 384 may also be connected to another computer, e.g., a data terminal 390, using a circuit-switched network, such as the telephone system. Those skilled in the art will appreciate that network connections may be provided not only by dedicated data lines, but also using cellular, personal communication systems (PCS), microwave, or satellite networks. The above-described communication systems permit remote monitoring of occupant 314 (FIG. 21) by medical personnel, even if the patient and the medical staff are geographically separated, as would be the case when the service bed is used in a home-care environment.

Figure 25:
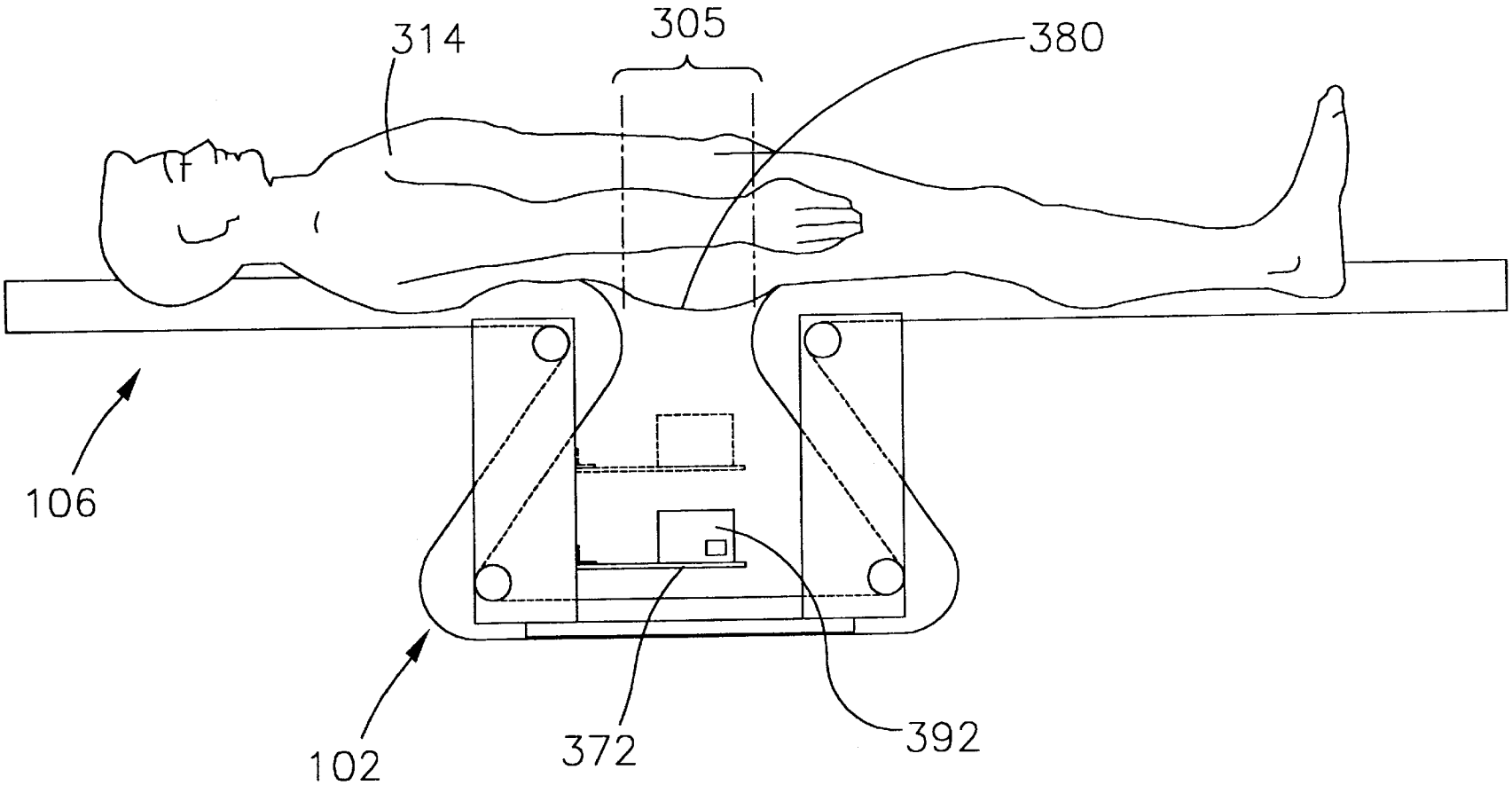
FIG. 25 is a schematic view illustrating the service bed of FIG. 1 further including a therapeutic device.

Mounting plate 372 may also support a removably-installed commercially-available therapeutic device 392 (FIG. 25), which may comprise, e.g., a thermostatically-controlled fan, a medication-delivery system, a light source, or a physical-therapy stimulator. As shown in FIG. 25, therapeutic device 392 requires that span 305 be adjusted to provide an access window adequate for treating area of interest 380 of occupant 314.

Therapeutic device 392 may be used to statically treat occupant 314 after guide mechanism 102 has been positioned in the desired location beneath the occupant, such as area of interest 380, and the requisite access window for therapeutic device 392 has been provided by adjusting span 305. For example, during static therapy, a thermostatically-controlled fan may be used to dry, cool, or heat area 380; a medication-delivery system may be employed to administer topical treatments or injections; a light source may be used to deliver beneficial doses of electromagnetic radiation; and a physical-therapy stimulator, such as a massaging device, may be utilized to stimulate the tissues of occupant 314 to restore circulation and decrease pain.

To perform dynamic treatment of occupant 314, span 305 is adjusted to provide the requisite access window for therapeutic device 392. Guide mechanism 102 is then translated relative to occupant 314 in a manner consistent with the particular medical needs of the occupant. For example, therapeutic device 392, executed as a thermostatically-controlled fan, may be used to dry, cool, or heat the skin along the underside of occupant 314 by translating guide mechanism 102 along a particular treatment segment. It should be noted that the treatment segment may be as long as the body of the occupant, if required. Similarly, a light source may be used to deliver beneficial doses of electromagnetic radiation while guide mechanism 102 moves relative to occupant 314 along the treatment segment. It should be understood that the dynamic treatment of the occupant may be performed using an isolated pass of therapeutic device 392 relative to the occupant or may require continuous cycling of the therapeutic device.

Figure 26:
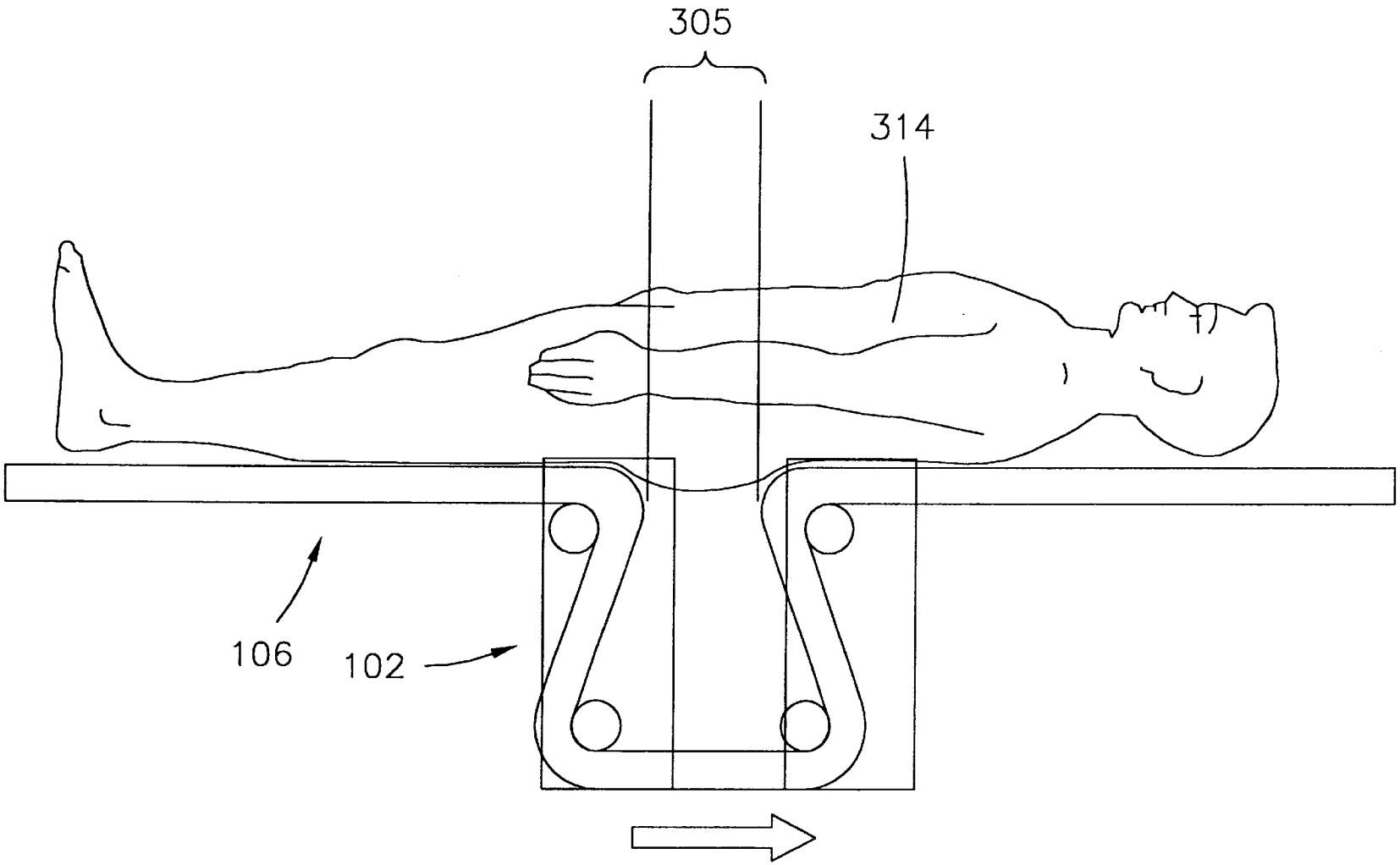
FIGS. 26–27 are schematic side views of the service bed of FIG. 1 illustrating a procedure intended to promote blood circulation and lymphatic return in the tissues of the occupant of the bed.
Figure 27:
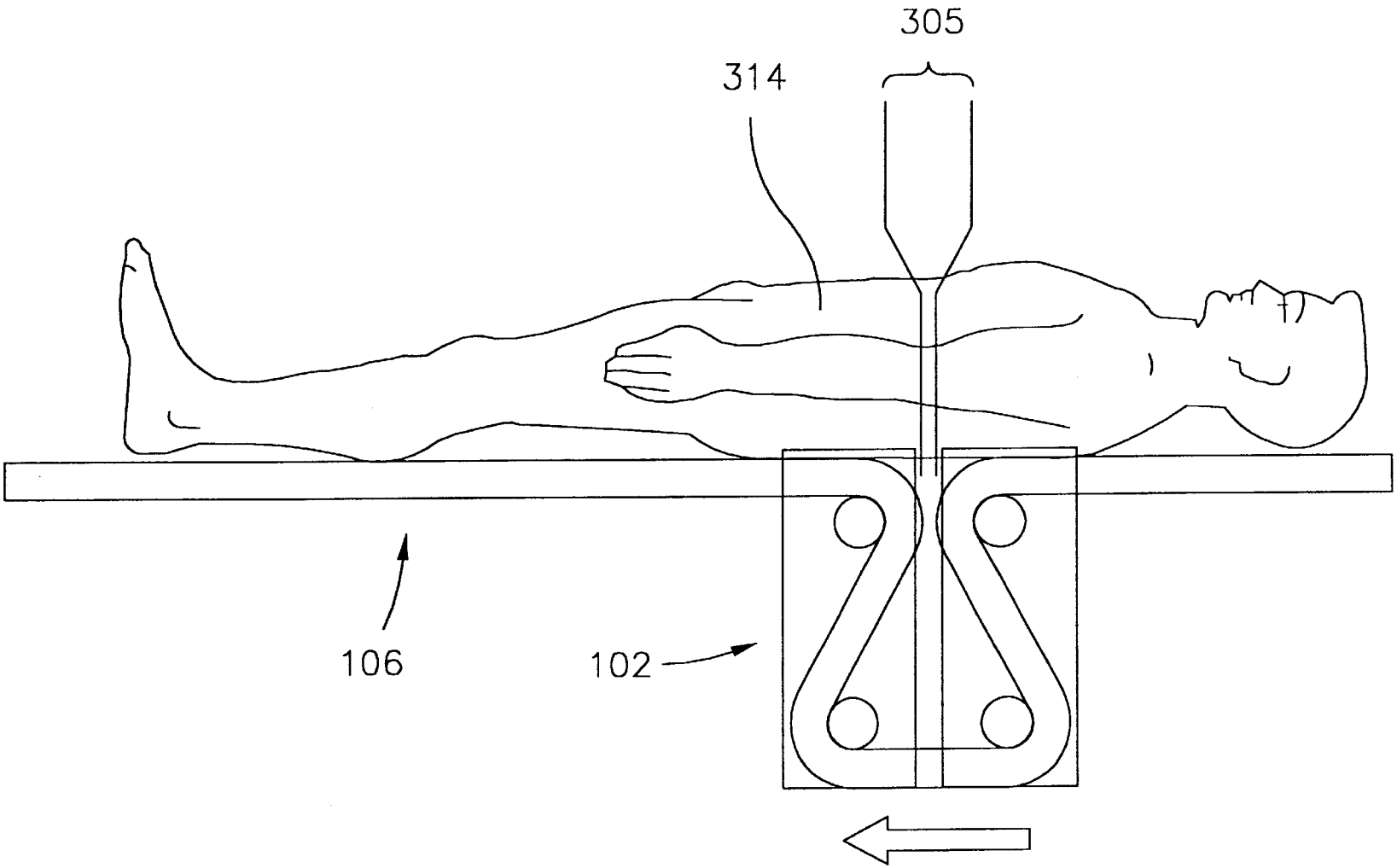

Another medical procedure amenable to implementation by the service bed according to the above-described embodiment of the invention, includes maintaining adequate blood circulation and improving lymphatic return in the tissues of occupant 314. To promote useful movement of tissue fluids toward the heart of the occupant, span 305 is adjusted so that it is within the specific range previously described and mechanism 102 is translated in the direction shown in FIG. 26 from the initial position at the feet of occupant 314 toward the final position at the head of the occupant in a forward cycle having a period from, e.g., about one minute to about one hour. When mechanism 102 reaches the right end of the bed, span 305 is adjusted to the lower limit of the specific range discussed above and the return cycle, shown in FIG. 27, is initiated, whereby mechanism 102 is translated to the left side of the bed. The return motion of guide mechanism 102 should take place at the maximum attainable speed to discourage flow of blood and lymphatic fluids away from the heart of the occupant.

Figure 28:
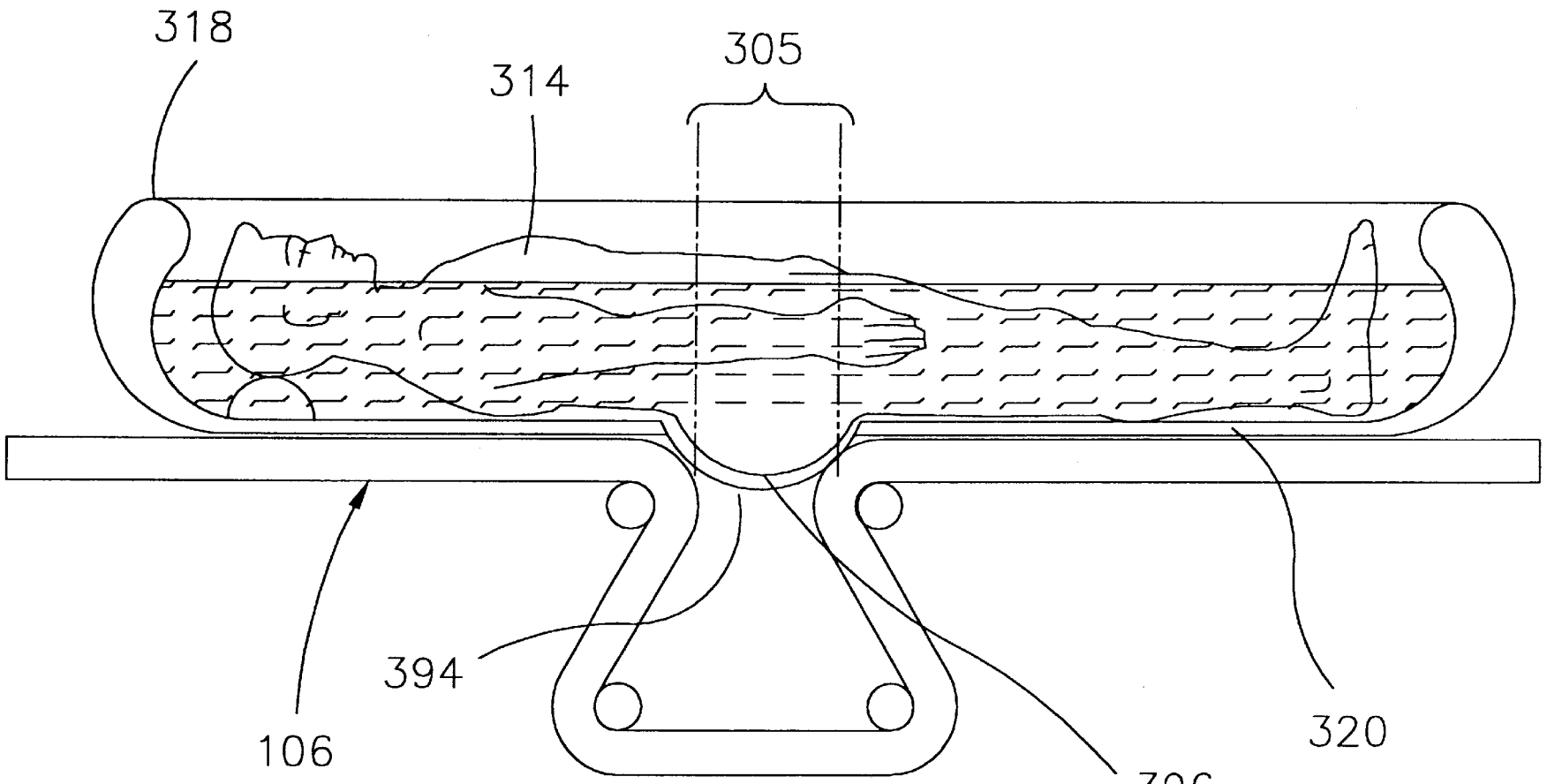
FIG. 28 shows how the effects of the procedure illustrated with respect to FIGS. 26–27 can be magnified through the use of hydraulic forces.

FIG. 28 illustrates that the effect of the procedure described above may be magnified through the use of hydraulic forces by placing occupant 314 in, e.g., basin 318 filled with water. As apparent from FIG. 28, when span 305 is adjusted such that it is within the previously-described specific range, hydrostatic pressure of water creates a depression 394 in bottom portion 320 of basin 318. When guide mechanism 102 is in its forward cycle, the movement of the guide mechanism creates a inverted wave 396 which uses hydraulic advantage to enhance the beneficial circulation of blood and tissue fluids. The aforementioned hydraulic advantage is proportional to the velocity of mechanism 102 with respect to occupant 314.

Figure 29:
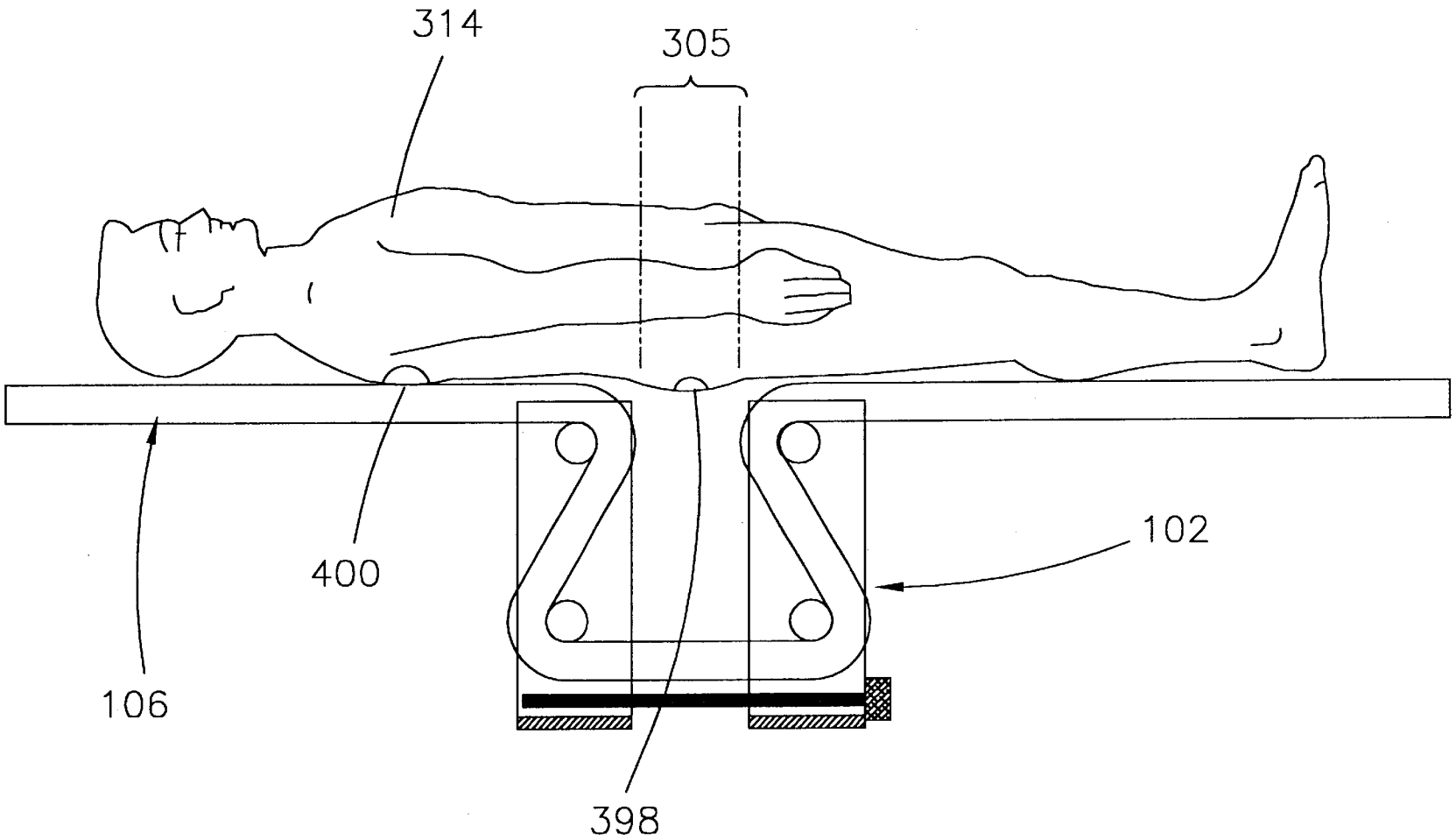
FIG. 29 is a schematic side view of the service bed of FIG. 1 wherein the procedure being implemented involves total relief of pressure on a desired area of interest of the occupant of the bed.

Yet another medical procedure capable of being implemented by the service bed according to the above-described embodiment of the present invention involves total relief of pressure on any desired area of interest along the underside of occupant 314, as illustrated in FIG. 29, and the capability of guide mechanism 102 for cycling between any number of such areas. For example, to provide total relief of pressure around locality 398, which could comprise, e.g., a bed sore or a burn, guide mechanism 102 is positioned under locality 398 and span 305 is adjusted to provide an adequate non-contact area around the locality. Guide mechanism 102 remains in this position for a duration of time (e.g., from about one minute to about an hour) sufficient to restore circulation and cellular metabolism to the affected tissues. Guide mechanism 102 may be cycled between localities 398 and 400 to alternatingly provide pressure relief thereto.

Figure 30:
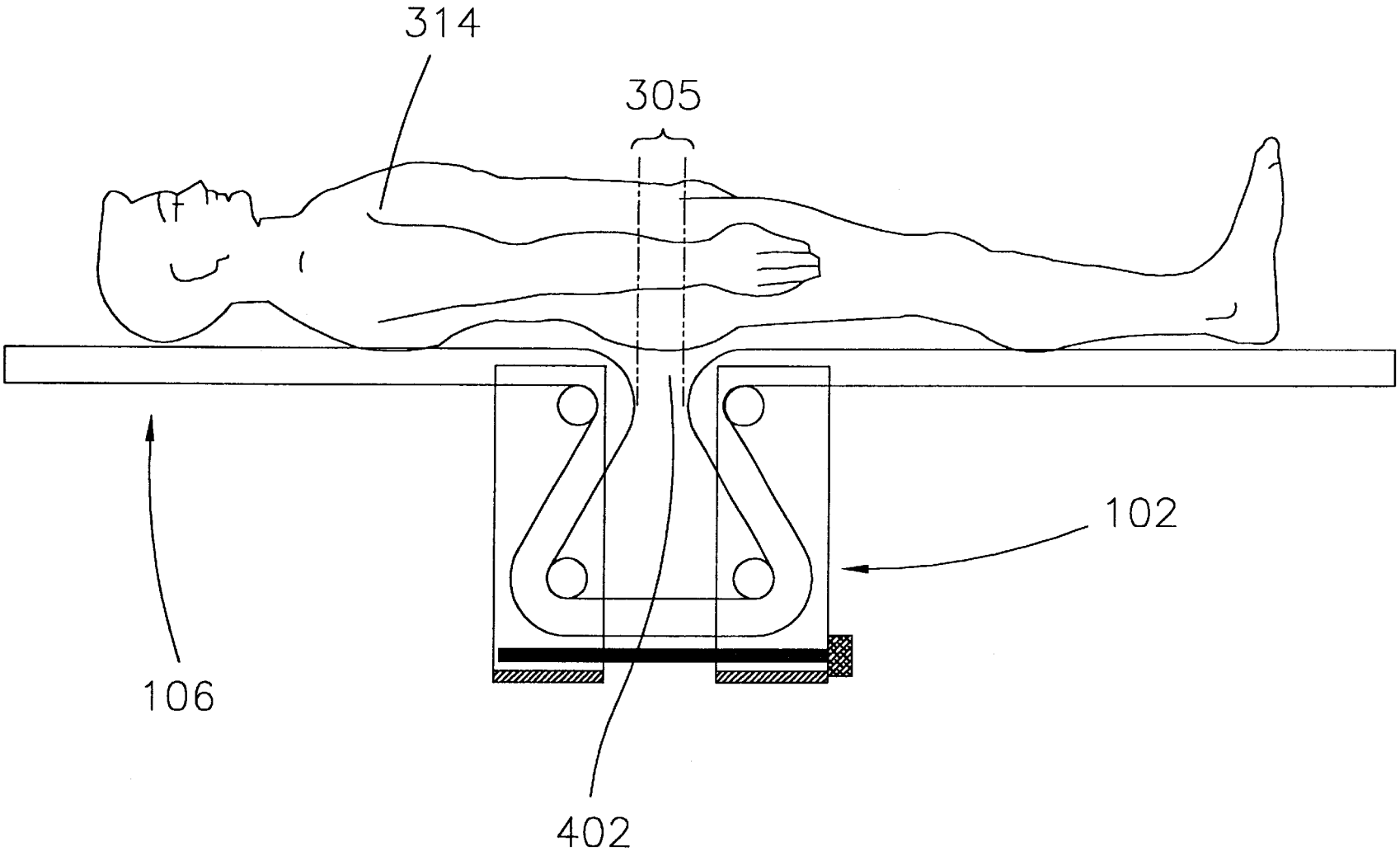
FIG. 30 is a schematic side view of the service bed of FIG. 1 wherein the guide mechanism is positioned such that a colonic procedure may be performed on the occupant of the bed.

As illustrated in FIG. 30, guide mechanism 102 may also be positioned in the area of interest 402 and span 305 adjusted to provide sufficient access underneath patient 314 so that, e.g., a colonic procedure may be performed.

Figure 31:
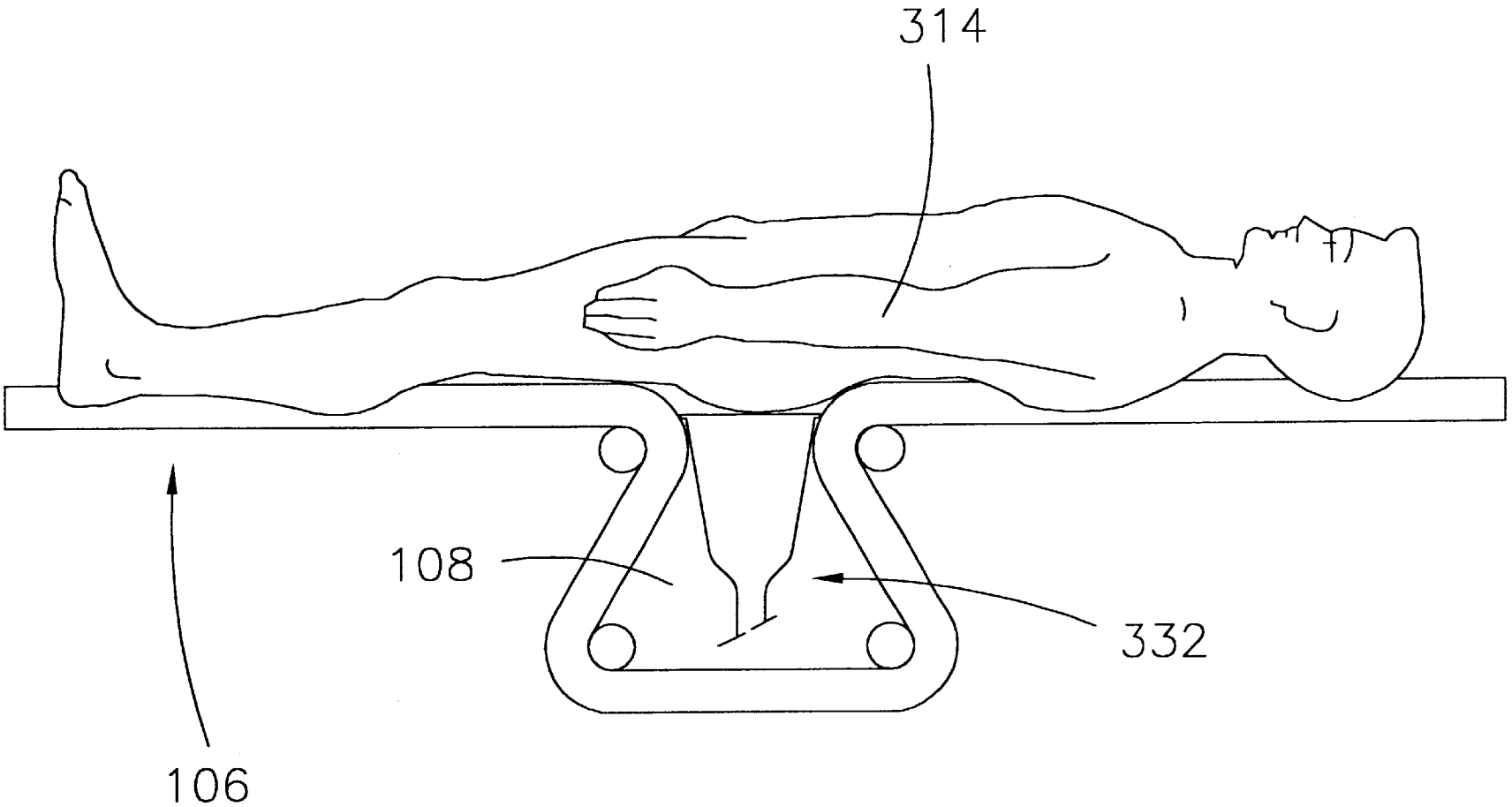
FIG. 31 is a schematic side view of the service bed of FIG. 1 incorporating a toileting facility.
Figure 32:
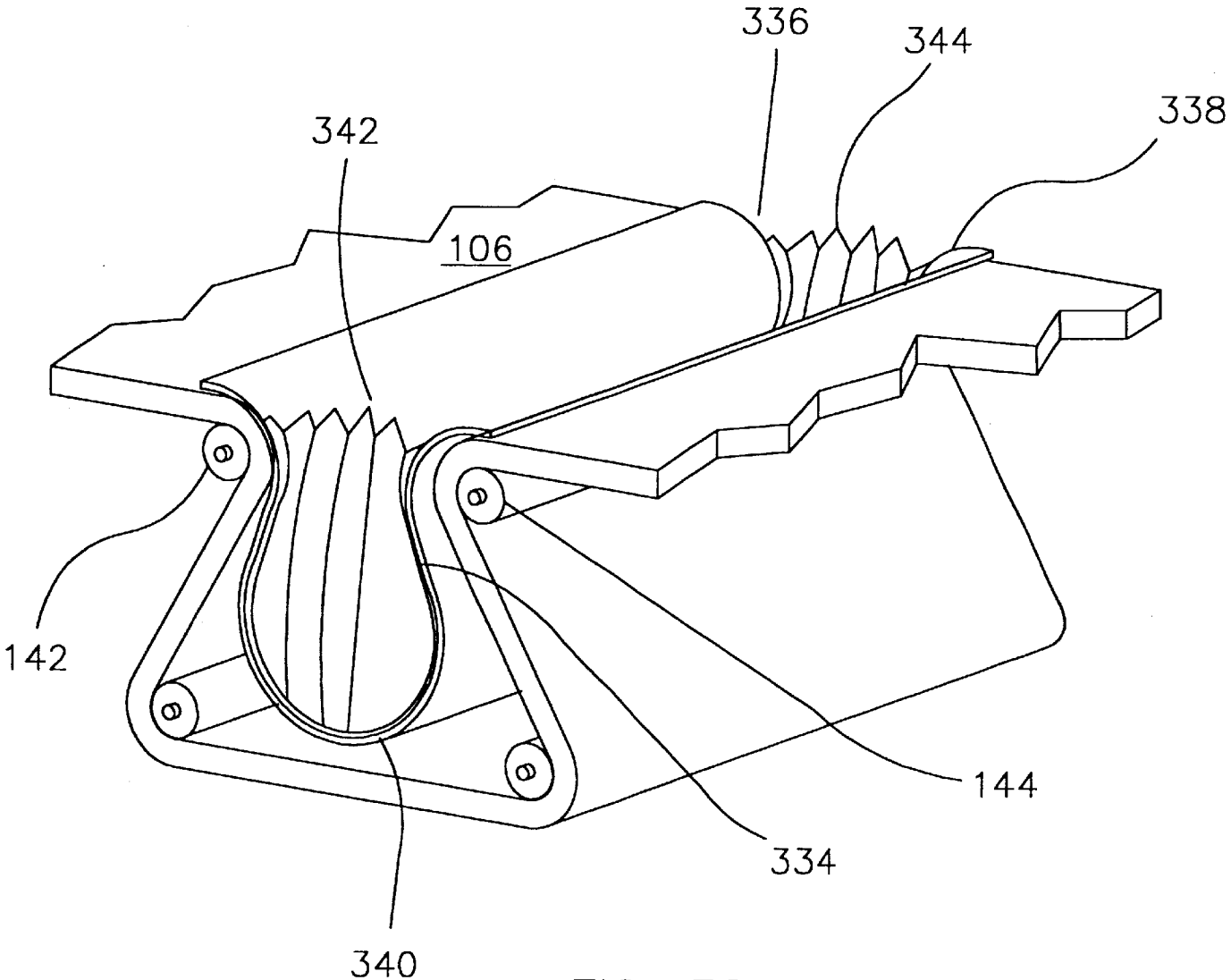
FIG. 32 is a perspective view of one embodiment of the toileting facility illustrated in FIG. 31.
Figure 33:
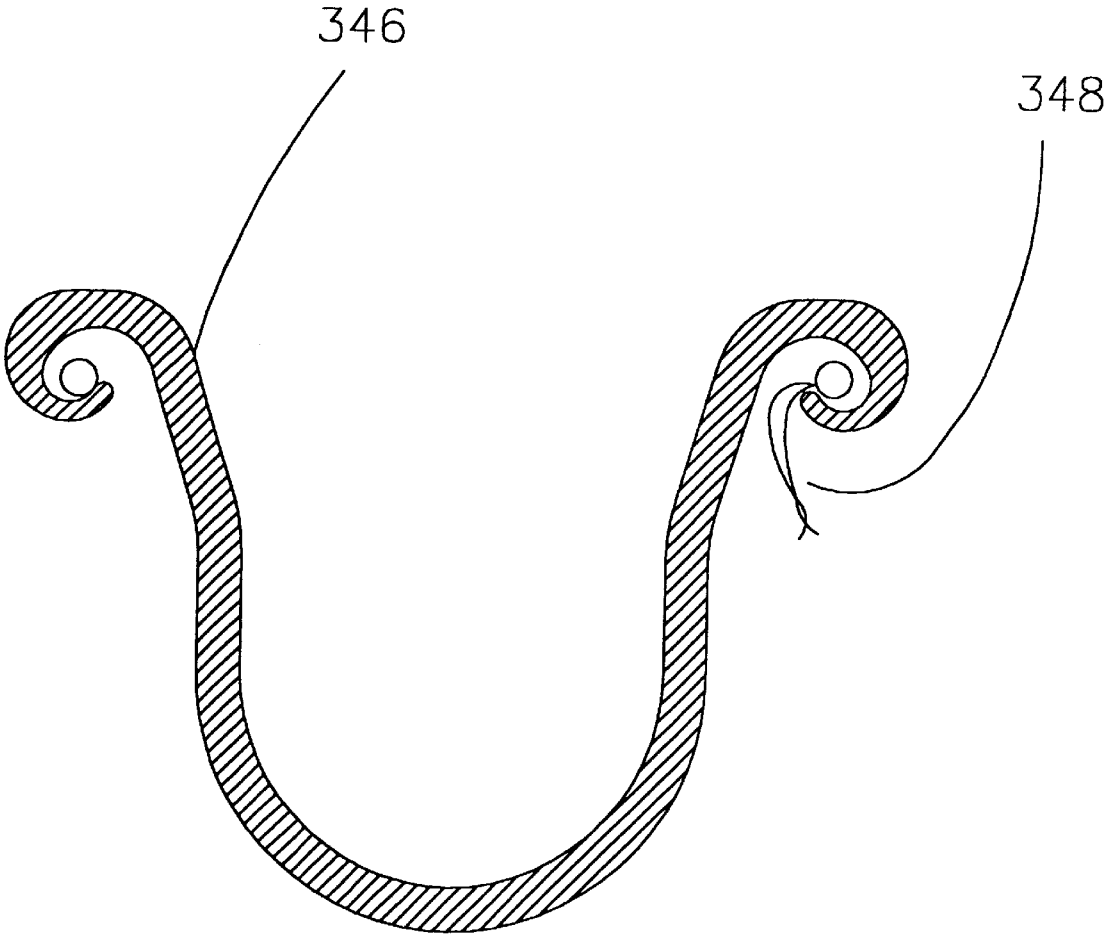
FIG. 33 is a sectional view of a liner which may be placed inside the toileting facility of FIG. 31.

As shown in FIG. 31, the design of the service bed enables to effectively address the occupant's need to urinate and defecate without leaving the bed by allowing a toileting facility 332 to be installed in the valley defined by undulation 108. The facility may comprise a liquid-proof receptacle 334 (FIG. 32), having curved shoulders 336 and 338 designed to mate with and be supported by curves in mattress 106 corresponding to guide rollers 142 and 144. Shoulders 336 and 338 are joined by a flexible spring element 340, biasing the shoulders away from each other. Receptacle 334 further includes expandable side portions 342 and 344, each of which is hermetically attached to element 340. A disposable liquid-proof liner 346 (FIG. 33) may be placed inside receptacle 334 (FIG. 32) so that urine, feces, and any excess sanitation or medical products applied to the occupant during hygienic procedures can be captured therein. As shown in FIG. 33, liner 346 may include a closure 348, comprising, e.g., a pull cord or a draw string, which is used to seal the liner 346. It will be apparent to one of ordinary skill in the art that receptacle 334 (FIG. 32) need not possess side portion 342 and 344 when liner 346 is utilized.

Figure 34:
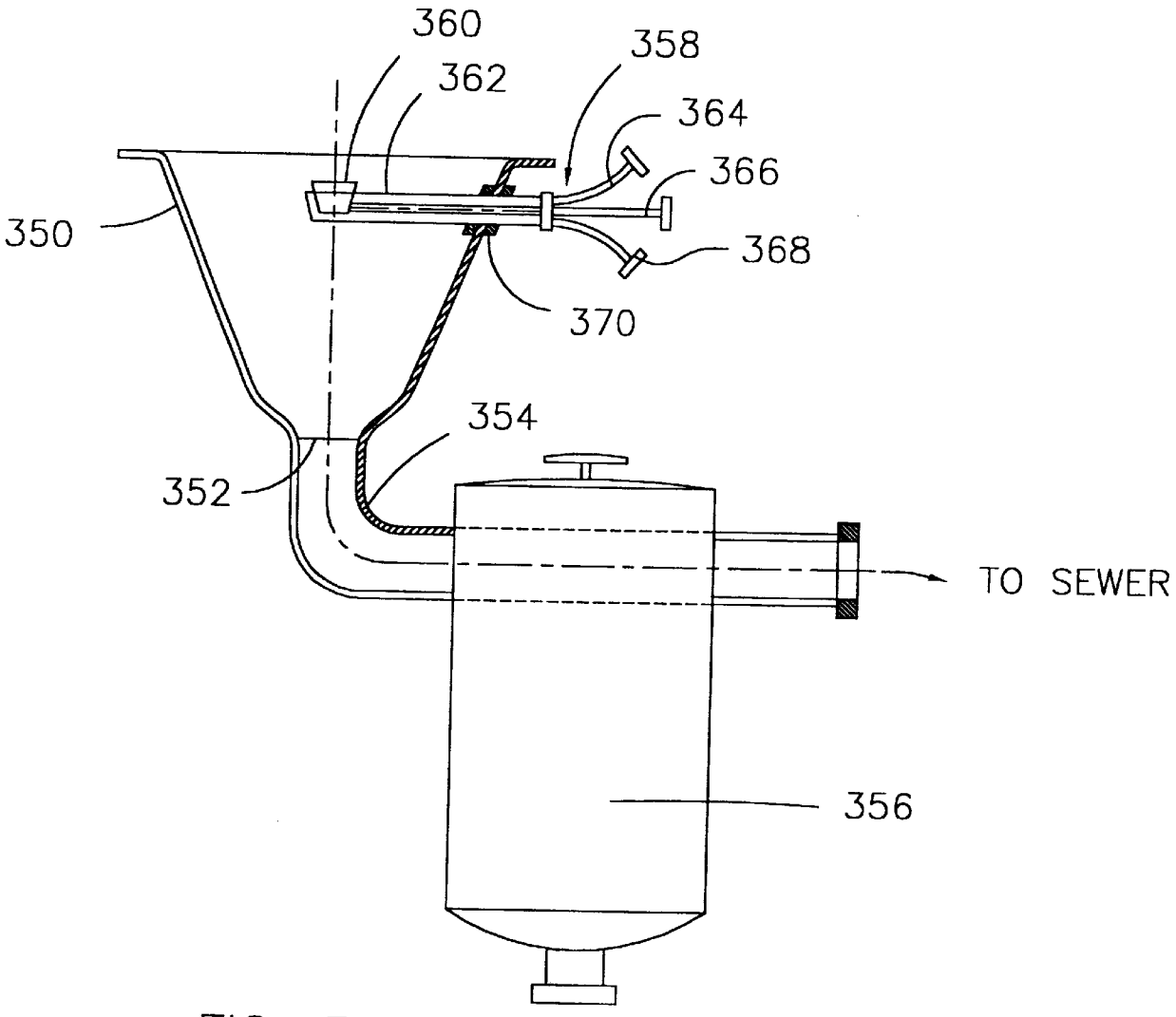
FIG. 34 is a side view of another embodiment of the toileting facility illustrated in FIG. 31.

Another embodiment of the facility may comprise a multi-functional sanitation system illustrated in FIG. 34. The system includes a receptacle 350, constructed in substantially the same manner as receptacle 334 described above with reference to FIG. 32. Receptacle 350 has a drain opening 352, which is in fluid communication with a discharge pipe 354. The discharge pipe may be connected to a septic tank 356, or, alternatively, to a sewer system (not shown). Receptacle 350 incorporates a retractable auxiliary system 358, which includes a fluid-supply nozzle 360 and an evacuation duct 362. Nozzle 360 is connected to a fluid-delivery system comprising a liquid supply 364 and a gas supply 366. Evacuation duct 362 is connected to a vacuum supply 368. Receptacle 350 has a sleeve 370, which movably supports auxiliary system 358. Sleeve 370 allows system 358 to be advanced toward the center of receptacle 350 and to be retracted therefrom, as needed.

Figure 35:
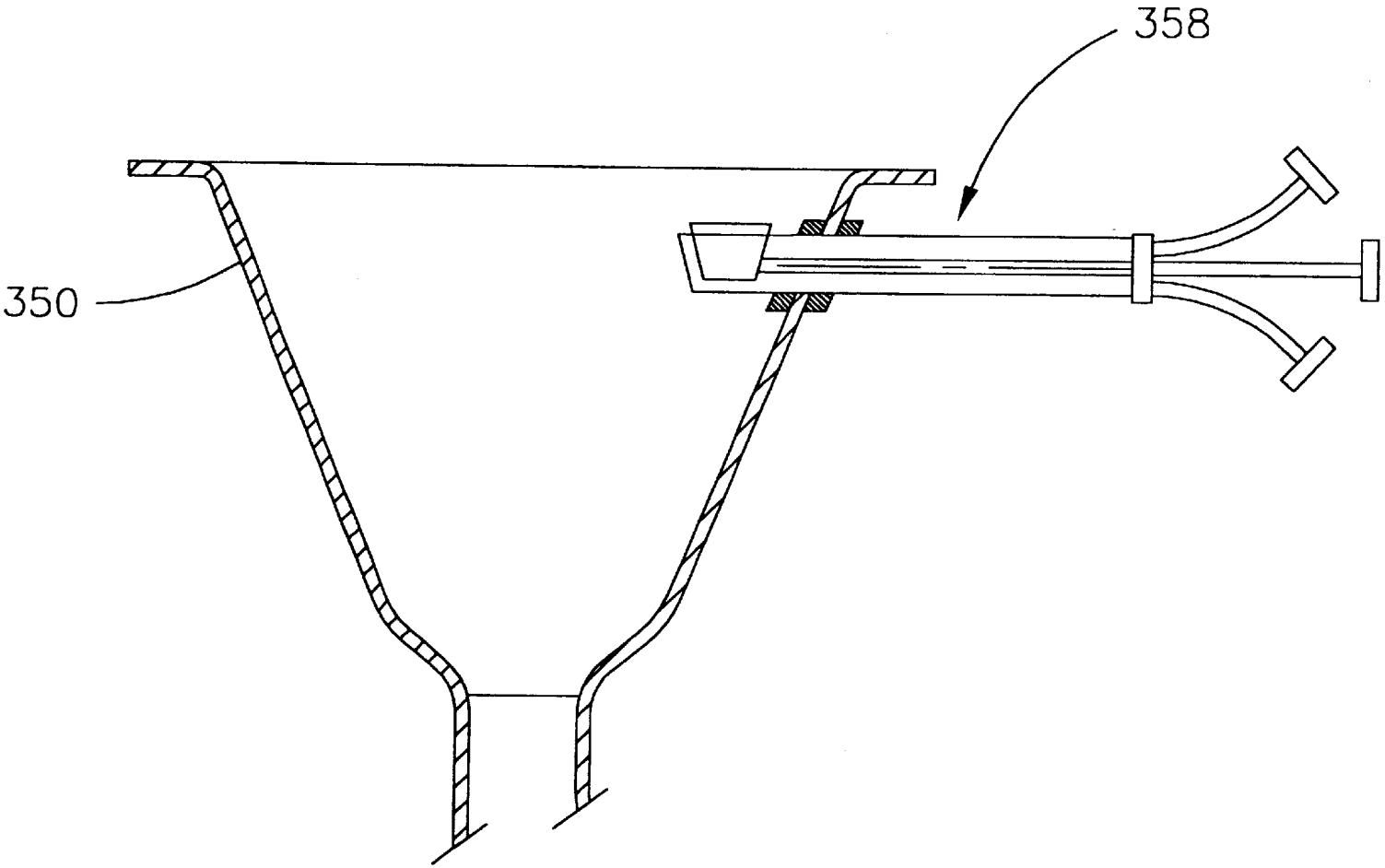
FIG. 35 is a detail view of a portion of the toileting facility illustrated in FIG. 34.

In operation, auxiliary system 358 is retracted as shown in FIG. 35 while receptacle 350 is being used by the occupant of the bed (not shown) to urinate or defecate. Duct 362 may be used to evacuate the air from the receptacle during and immediately after defecation. The urine and feces are directed via discharge pipe 354 (FIG. 34) into septic tank 356 or into the sewer system (not shown). When the receptacle is no longer in use for the purposes of waste elimination, system 358 is advanced into the receptacle so that nozzle 360 may supply temperature-controlled cleansing fluids to the area of interest, as well as a drying agent in the form of a temperature-controlled gaseous stream after the cleansing operation has been completed.

Figure 36:
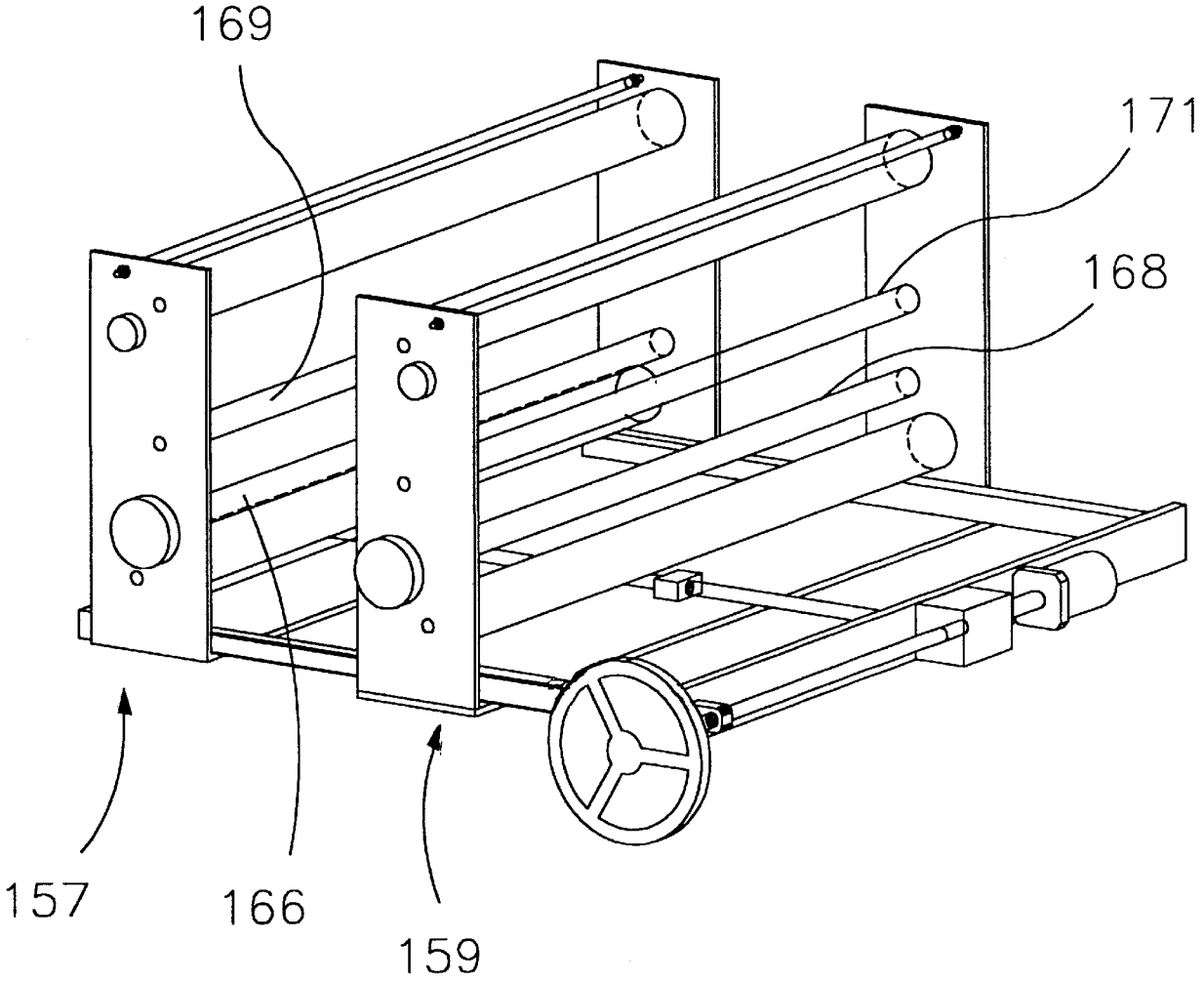
FIG. 36 is a perspective view of the guide mechanism illustrated in FIG. 3 including additional dispensing and collecting rollers.

Many other modifications of the service bed, some of which are described herein, are possible. For instance, additional dispensing and collecting rollers 169 and 171 may be positioned as shown in FIG. 36. If yet additional pairs of dispensing and collecting rollers (not shown) are required, they can be mounted on u-shaped members 157 and 159 in a similar manner. Such additional pairs of dispensing and collecting rollers permit supplementary strata (not shown) to be deposited between the occupant of the bed and the mattress.

Figure 37:
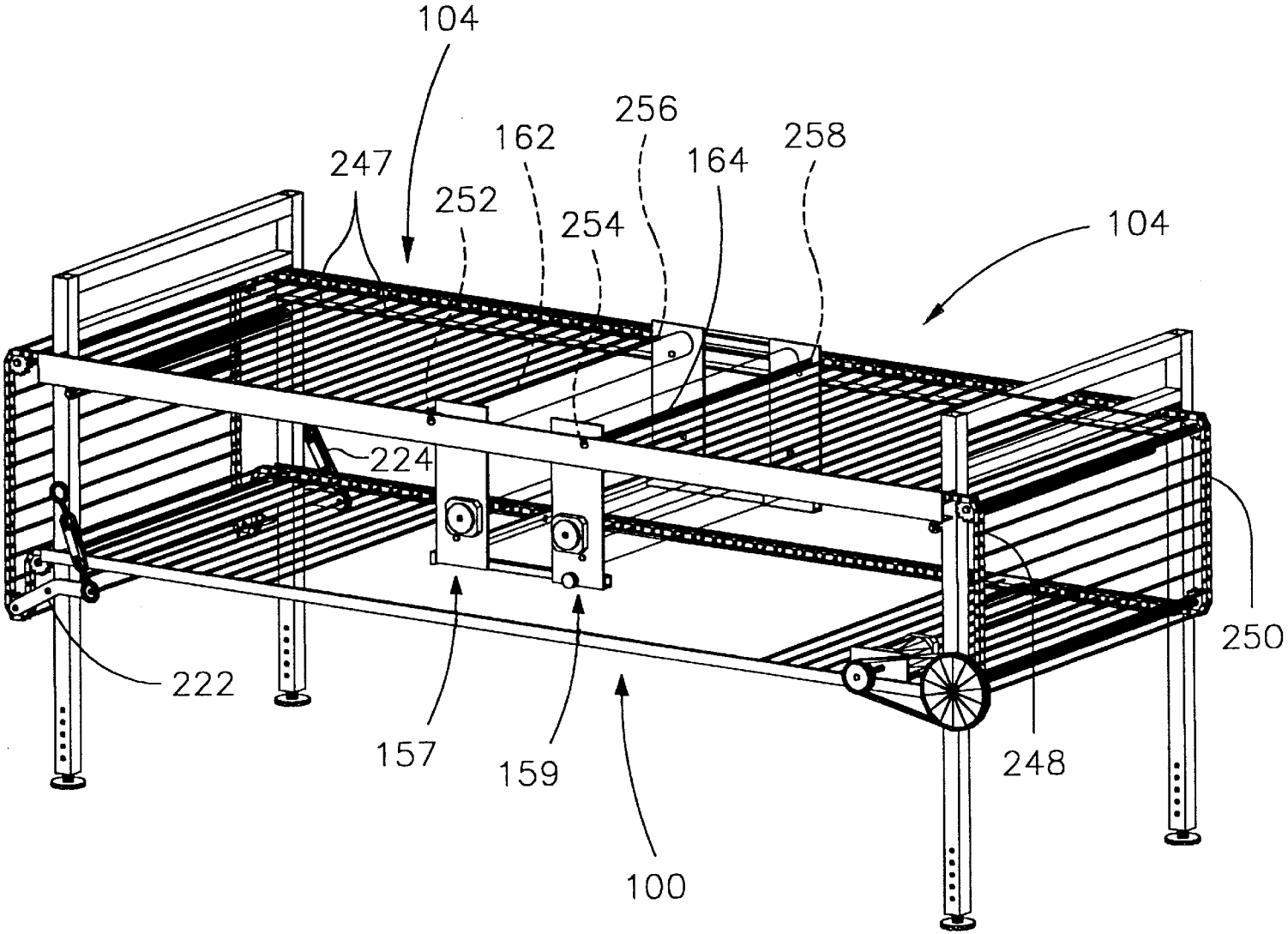
FIG. 37 is a perspective view of another embodiment of the carrier of the service bed illustrated in FIG. 1.

Alternatively, the drive train of carrier 104 may comprise two split roller chains 248 and 250, as shown in FIG. 37. Chain 248 has ends 252 and 254, attached to u-shaped members 157 and 159, respectively. Similarly, chain 250 has ends 256 and 258, attached to u-shaped members 157 and 159, respectively. Ends 252 and 256 are attached to u-shaped member 157 using mounting rod 162, whereas ends 254 and 258 are attached to u-shaped member 159 using mounting rod 164. Chain tensioners 222 and 224 compensate for the slack resulting in chains 248 and 250 due to movement of member 159 away from member 157.

Figure 38:
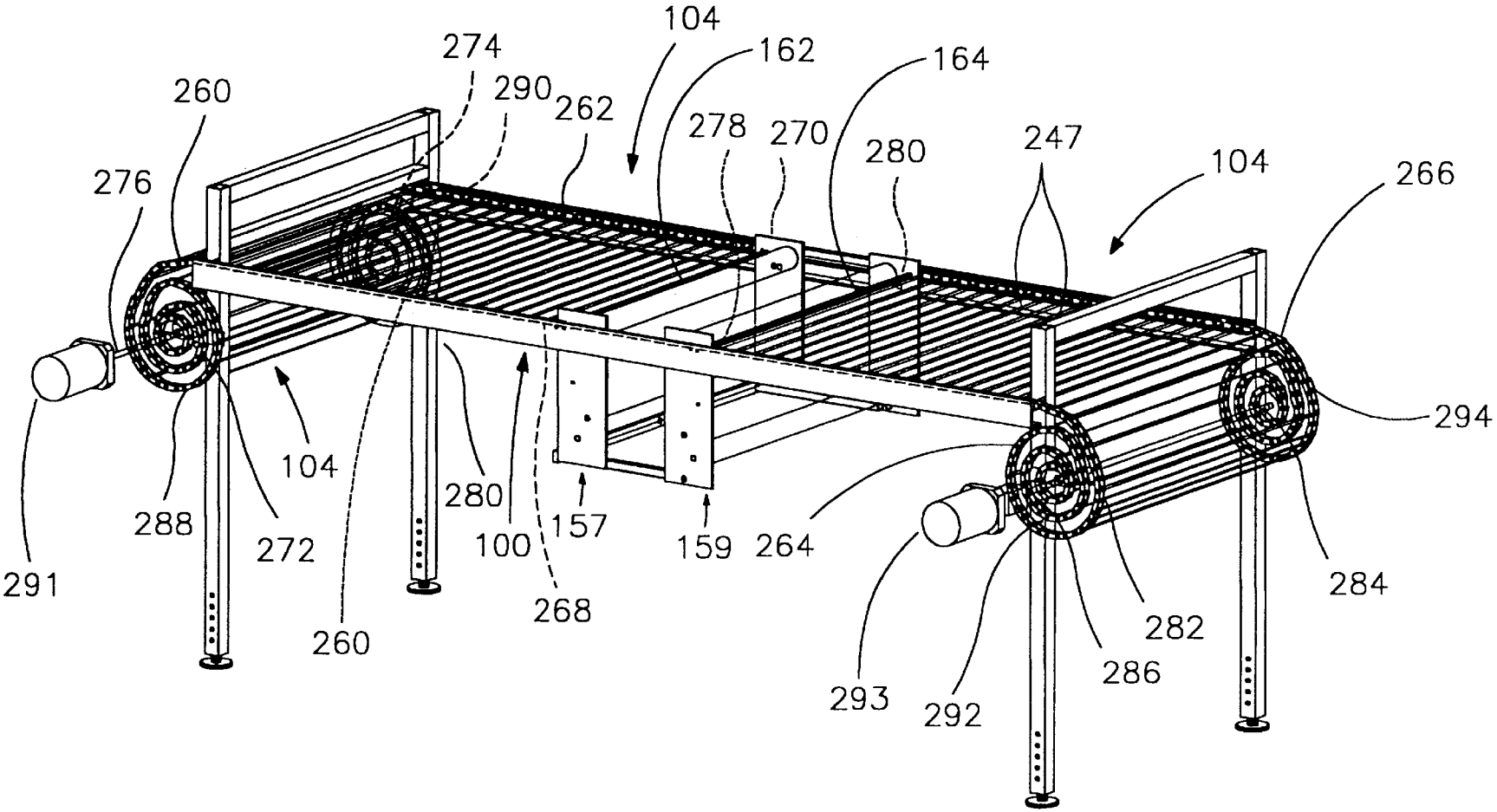
FIG. 38 is a perspective view of yet another embodiment of the carrier of the service bed illustrated in FIG. 1.

In yet another embodiment of the present invention, illustrated in FIG. 38, the drive train of carrier 104 may include four roller chains 260, 262, 264, and 266. Chains 260 and 262 have proximal ends 268 and 270, respectively, attached to u-shaped member 157 by means of mounting rod 162, as well as distal ends 272 and 274, respectively, attached to a shaft 276, which is rotationally supported by chassis 100. Chains 264 and 266 have distal ends 278 and 280, respectively, attached to u-shaped member 159 by means of mounting rod 164, as well as proximal ends 282 and 284, respectively, attached to a shaft 286, which is rotationally supported by chassis 100. Distal ends of chains 260 and 262 are convoluted into spirals 288 and 290 around shaft 276, whereas proximal ends of chains 264 and 266 are convoluted into spirals 292 and 294 around shaft 286. Shafts 276 and 286 are driven by motors 291 and 293, respectively.

Figure 39:
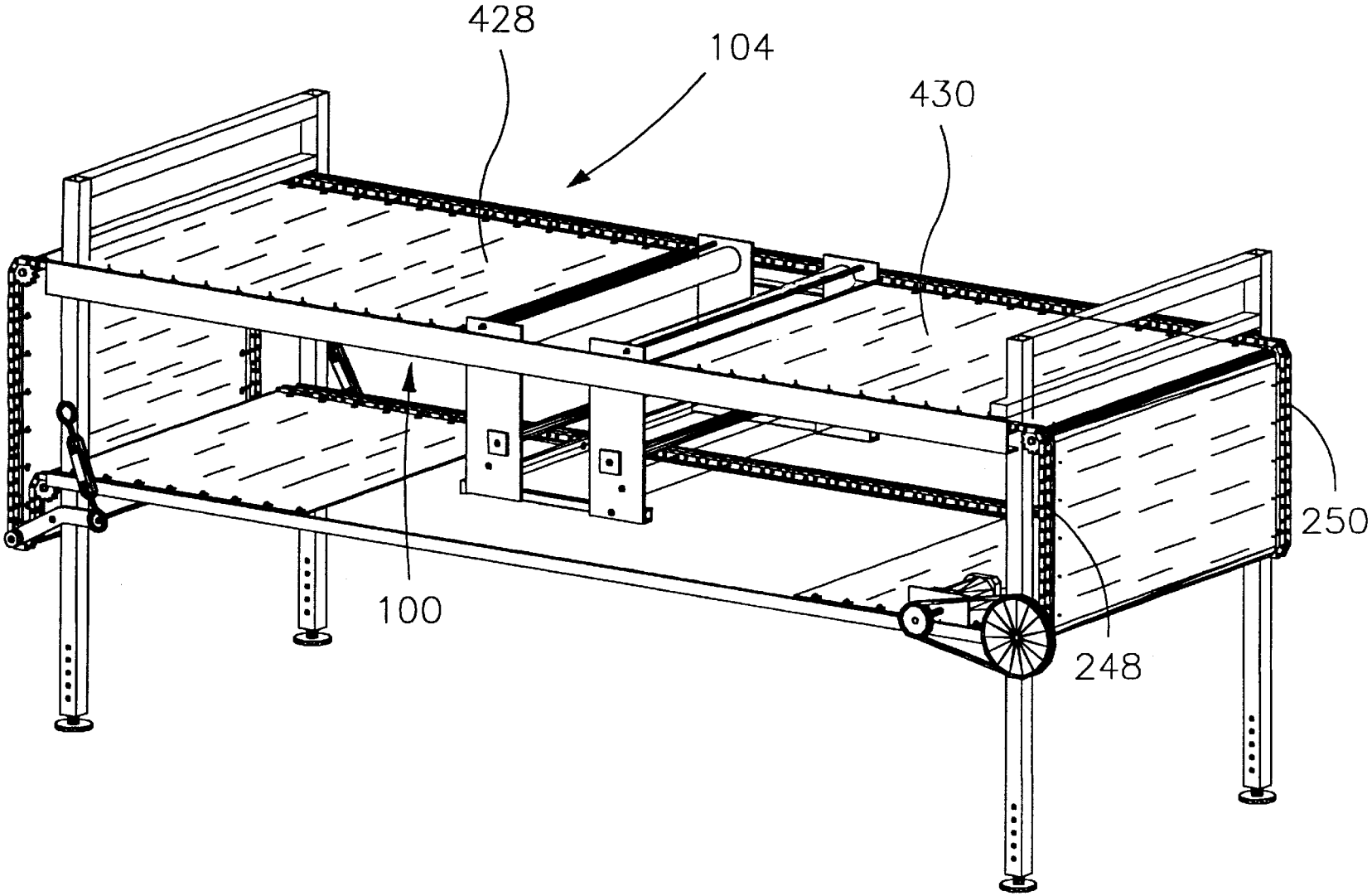
FIG. 39 is a perspective view of yet another embodiment of the carrier of the service bed illustrated in FIG. 1.
Figure 40:
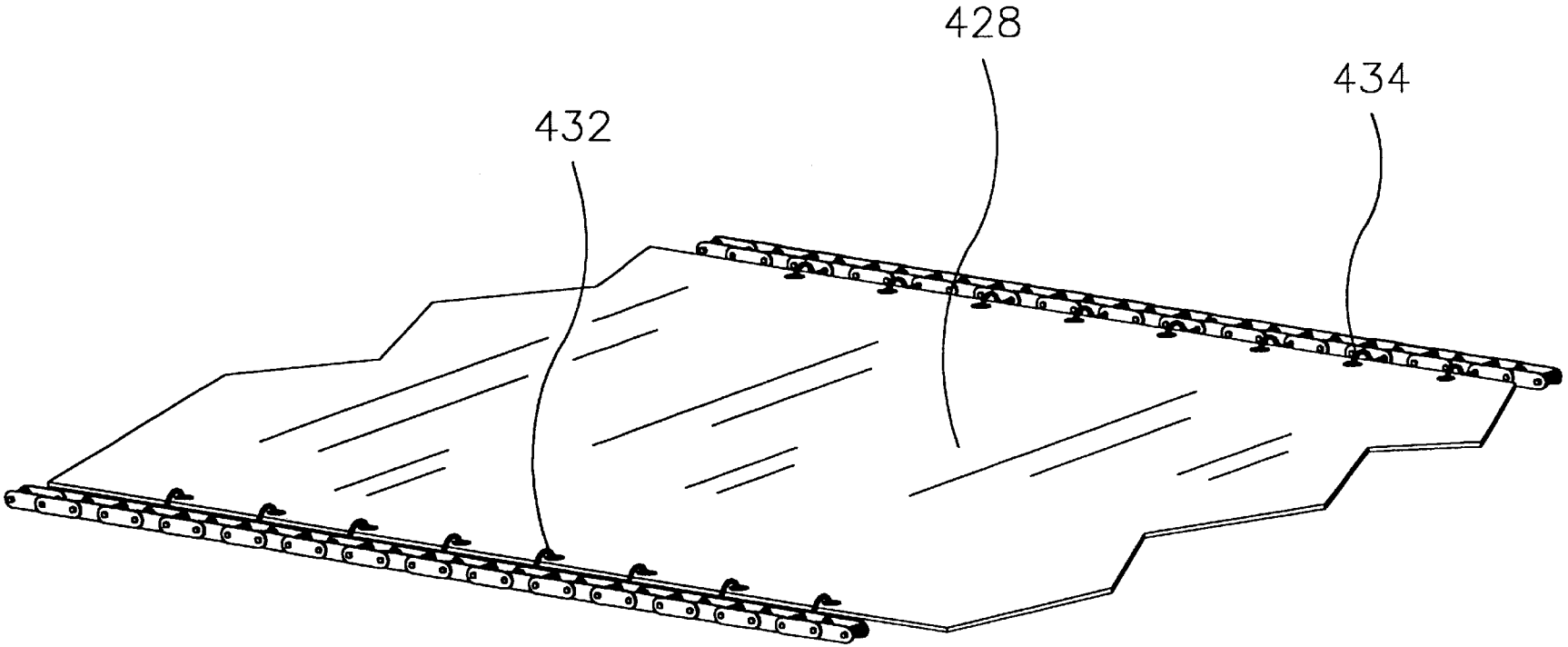
FIG. 40 is a detail view of a portion of the carrier illustrated in FIG. 39.

As shown in FIGS. 39 and 40, bearing bridges of carrier 104 may comprise two continuous sheets 428 and 430, mounted to chains 248 and 250, using, e.g., hook fasteners 432 that mate with openings 434 located at the periphery of sheets 428 and 430. Other chain configurations described above and alternative known fastening methods of sheets 428 and 430 to the chains may also be utilized. Sheets 428 and 430 should be made of a thin, flexible material having a high strength and a low coefficient of friction. For example, the sheets could be constructed from high-density polyethylene.

Figure 41:
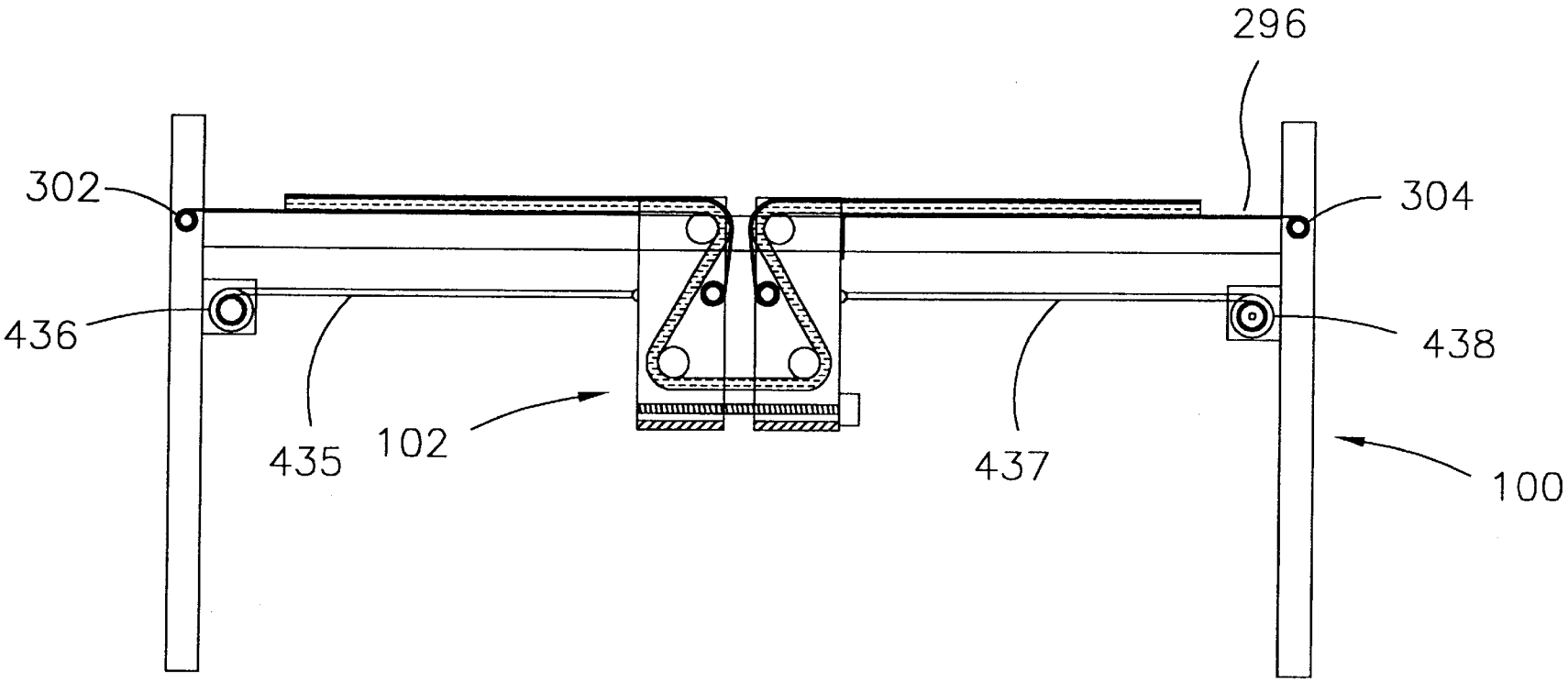
FIG. 41 is a schematic side view of another embodiment of the service bed according to the present invention.

In yet another embodiment of the invention, carrier 104 described with reference to FIG. 6 may be omitted, as illustrated in FIG. 41. Winches 436 and 438, attached to chassis 100, may be used to translate guide mechanism 102 relative to the chassis using cables 435 and 437. As in the previous embodiments of the invention, the longitudinal ends of base layer 296 are attached to chassis 100 using tensioners 302 and 304.

Figure 42:
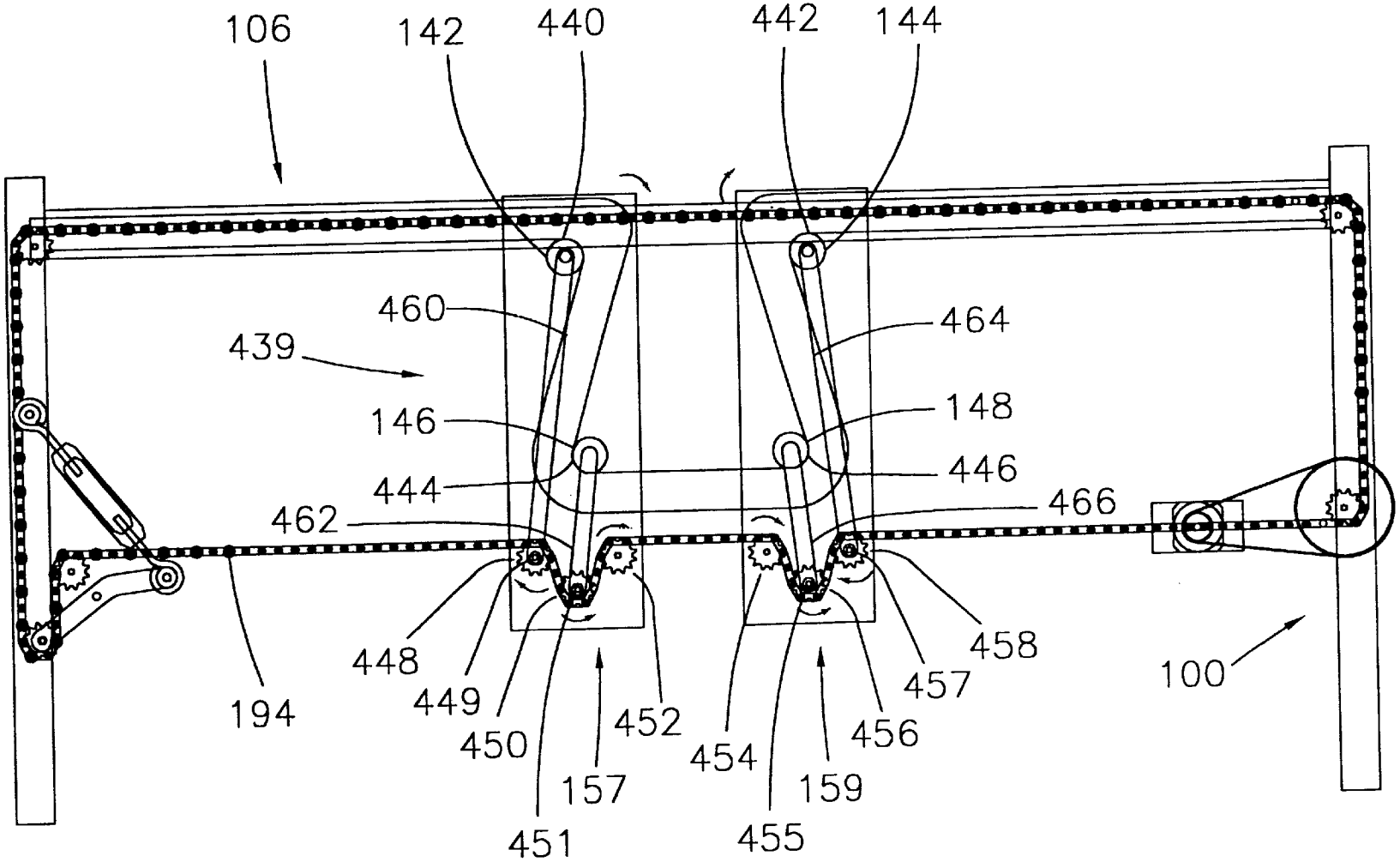
FIG. 42 is a schematic side view of another embodiment of the service bed having a guide mechanism with rollers being rotationally coupled with the drive train of the carrier.

An alternative embodiment of the invention, a guide mechanism 439, illustrated in FIG. 42, includes driven pulleys 440, 442, 444, and 446, rigidly attached to guide rollers 142, 144, 146, and 148, respectively. Drive sprockets 448 and 450, as well as idler sprocket 452, are rotationally supported by unshaped member 157. Drive sprockets 458 and 456, as well as idler sprocket 454, are rotationally supported by unshaped member 159. Drive pulleys 449 and 451 are integral with drive sprockets 448 and 450. Drive pulleys 455 and 457 are integral with drive sprockets 456 and 458. Sprockets 448, 450, 452, 454, 456, and 458 all engage chain 194. Pulleys 440 and 448 are coupled together using drive belt 460, whereas pulleys 444 and 451 are coupled together using drive belt 462. Similarly, pulleys 442 and 457 are coupled together using drive belt 464, whereas pulleys 446 and 455 are coupled together using drive belt 466. During translation of guide mechanism 439 relative to chassis 100, chain 194 engages sprockets 448, 450, 456, and 458, which, in turn, drive rollers 142, 146, 148, and 144, respectively, in appropriate directions via their corresponding pulleys, allowing mechanism 439 to guide mattress 106 more efficiently. Those skilled in the art will appreciate that the diameters of the rollers and the gear ratios between the drive and the driven sprockets are selected such that the tangential speed of rollers 142, 144, 146, and 148 corresponds to the speed of guide mechanism 102 relative to chassis 100.

Figure 43:
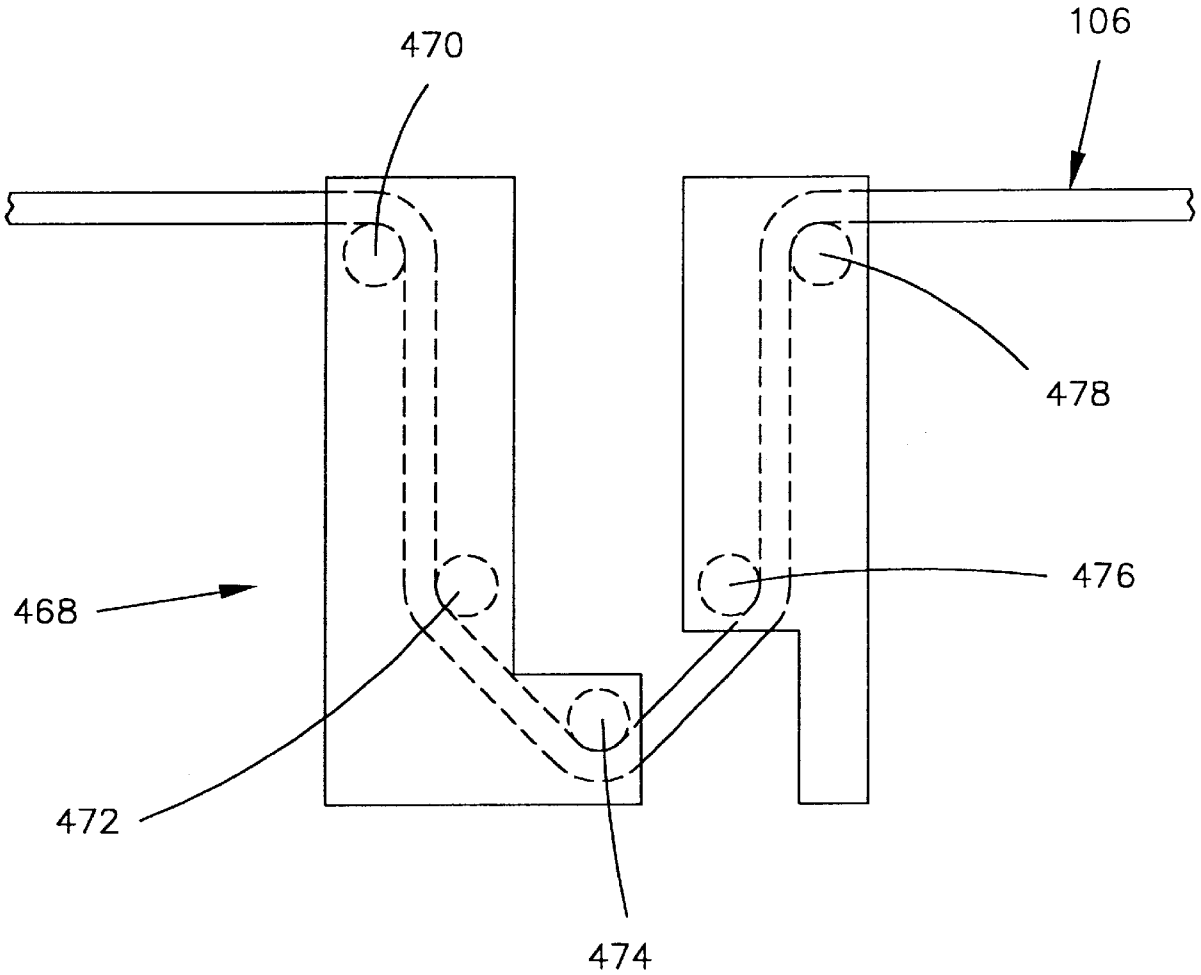
FIGS. 43–45B are schematic side views illustrating alternative embodiments of the guide mechanism of the service bed according to the present invention.
Figure 44:
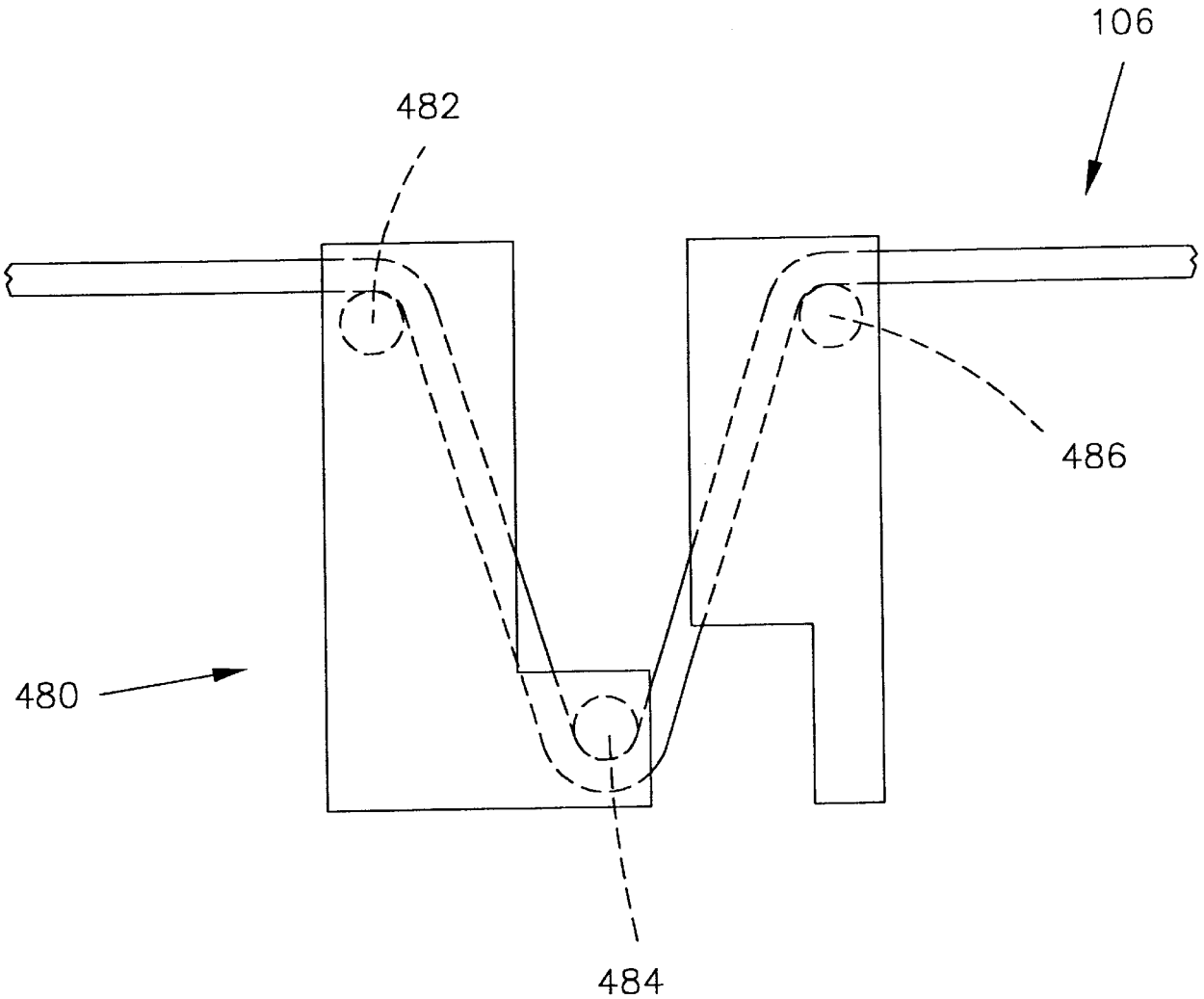
Figure 45:
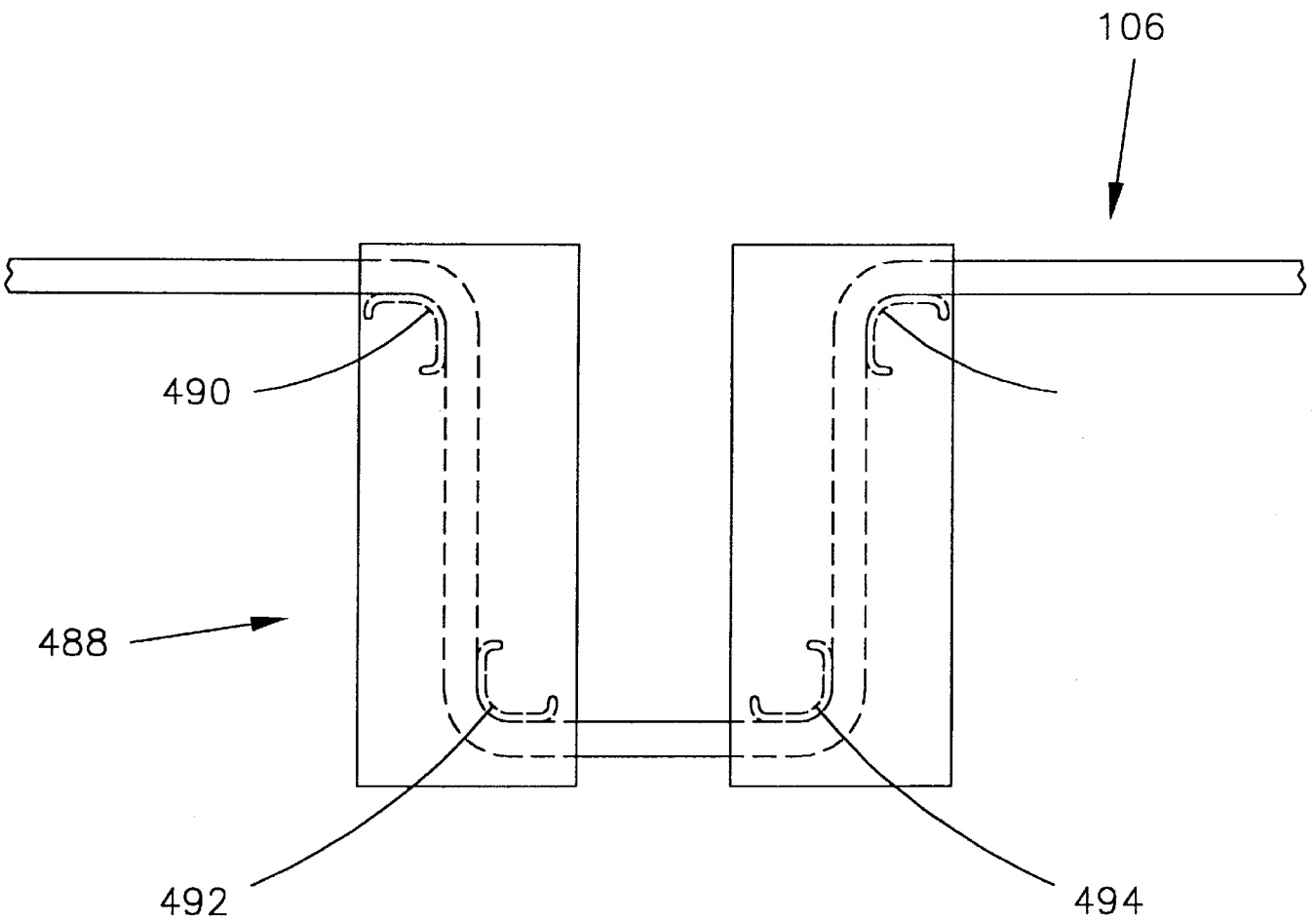
Figure 45B:
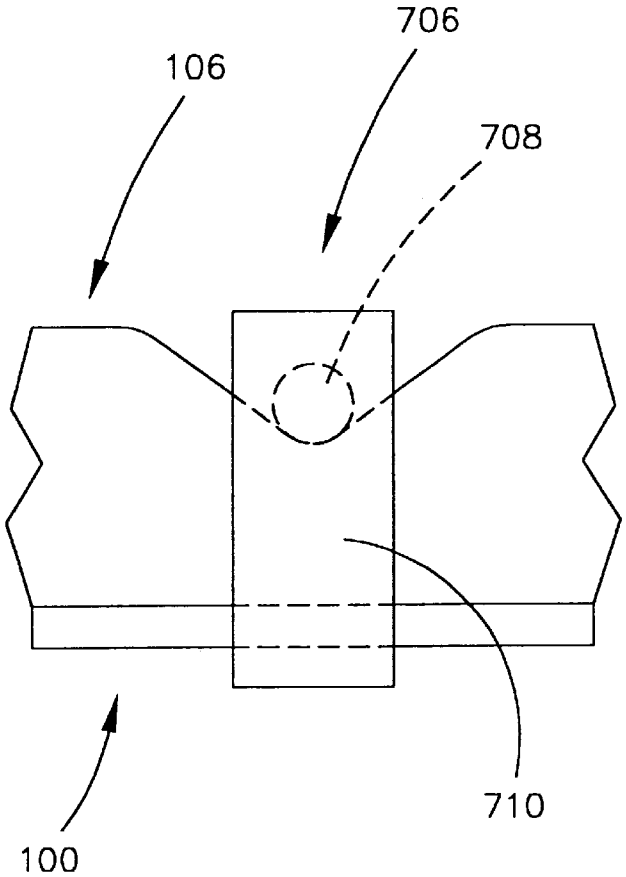
Figure 45A:
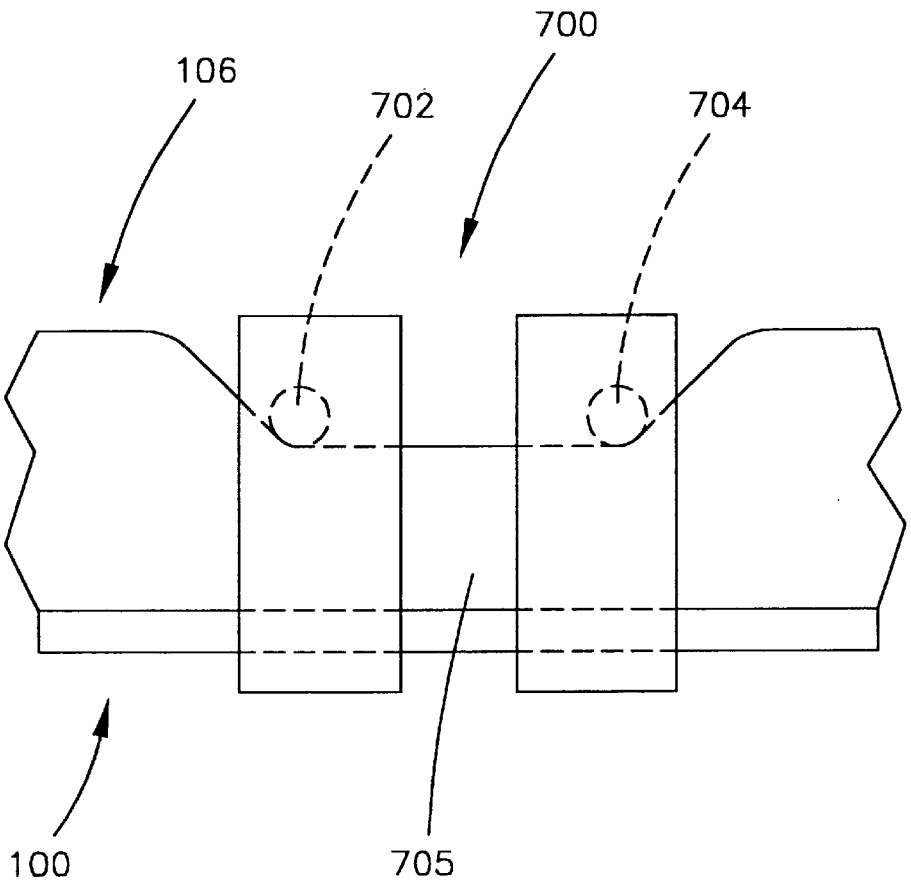

The design of the guide mechanism may encompass a number of variations, some of which are shown in FIGS. 43 through 45B. For example, FIG. 43 illustrates a guide mechanism 468 having five guide rollers 470, 472, 474, 476, and 478 for routing mattress 106. As apparent from FIG. 44, guide mechanism 480 uses three guide rollers 482, 484, and 486 for routing mattress 106. Guide mechanism 488, depicted in FIG. 45, routes mattress 106 using low-friction guides 490, 492, 494, and 496. FIG. 45A shows a guide mechanism 700 having two guide rollers 702 and 704. As mattress 106 is routed through guide mechanism 700, it is compressed between chassis 100 and the rollers of the guide mechanism, forming an undulation 705 in the mattress. FIG. 45B illustrates a guide mechanism 706, which includes a guide roller 708. As mattress 106 is routed through guide mechanism 706, it is compressed between chassis 100 and roller 708, forming an undulation 710.

Figure 46:
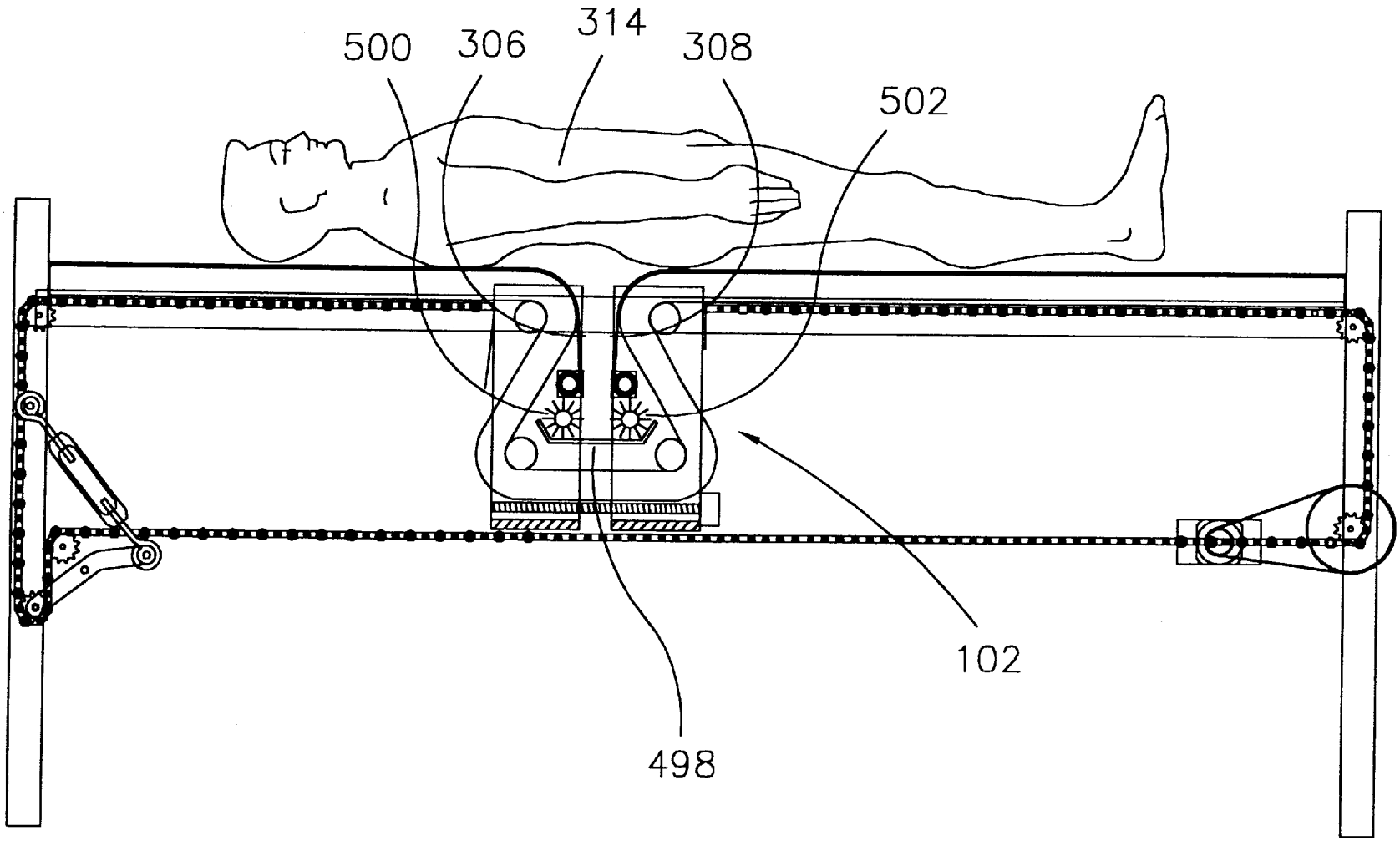
FIG. 46 is a schematic side view of the service bed illustrated in FIG. 37 further including a sanitation tray and rotary brushes.

To maintain sanitary conditions and to enhance comfort of occupant 314, a sanitation tray 498 can be mounted to guide mechanism 102, as shown in FIG. 46. The function of the tray is to collect any debris, e.g., crumbs, born by the surfaces of strata (e.g., linen sheets) 306 and 308. Rotary brushes 500 and 502, mounted above tray 498, may also be employed to dislodge debris from surfaces of the strata and may include a vacuum assist (not shown).

Figure 47:
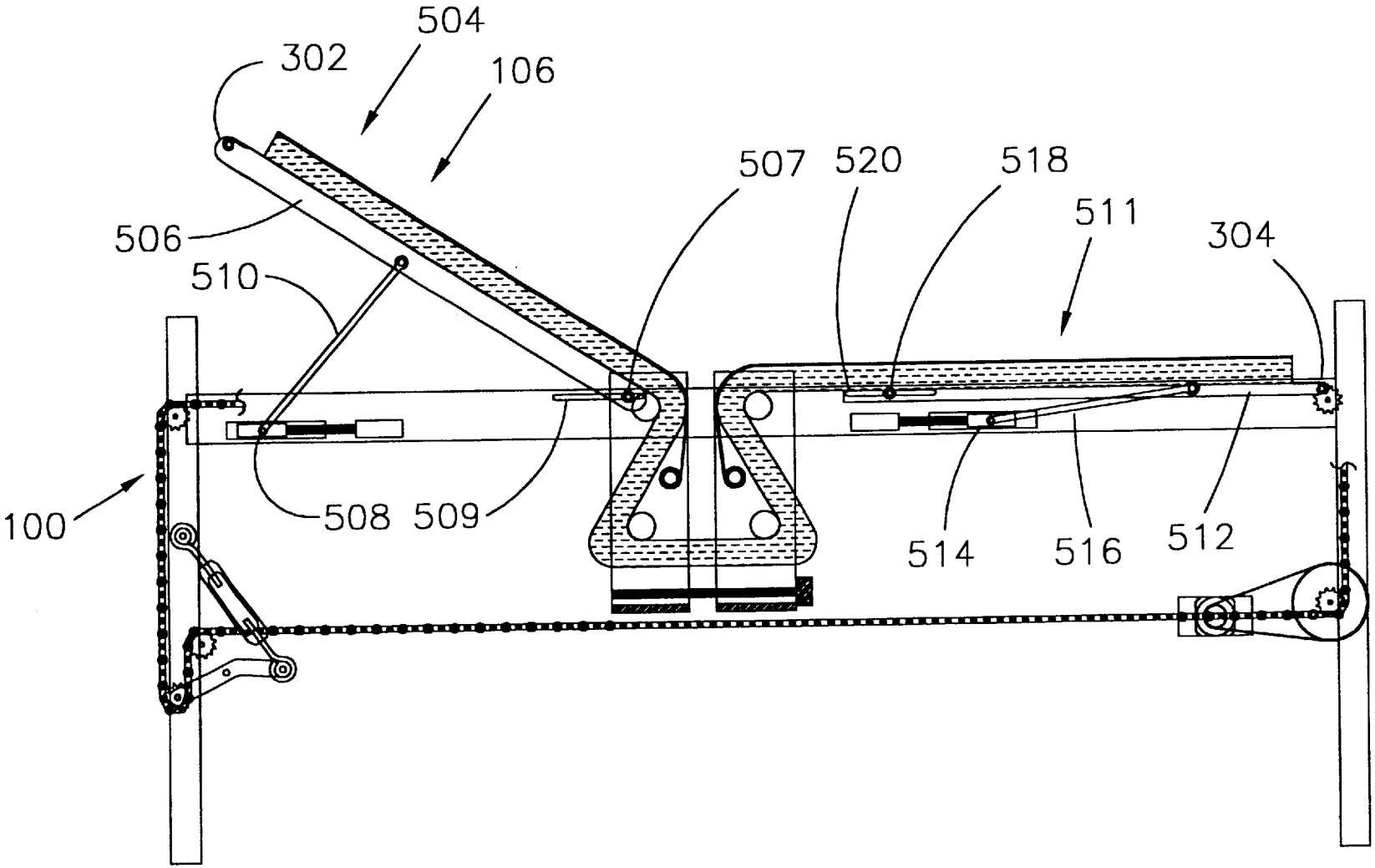
FIG. 47 is a schematic side view of another embodiment of the service bed incorporating tilt mechanisms.

In yet another embodiment of the present invention, the service bed includes tilt mechanisms 504 and 511, depicted in FIG. 47. Tilt mechanism 504 comprises a support member 506, pivotally attached to chassis 100 at a point 507. Pivot point 507 can be moved with respect to chassis 100 along a slot 509 and anchored in a different location along the slot using a screw-type fastener (not shown). Support member 506 incorporates tensioner 302, which is coupled to one of the longitudinal ends of mattress 106. A linear actuator 508, including a motor 513, is utilized for pivoting support member 506 up toward vertical and back down to horizontal position via a swivel arm 510. Linear actuator 508 incorporates limit switches 499 and 501. The range of motion available to tilt mechanism 504 is about ninety degrees up from horizontal. Tilt mechanism 511, which is identical to mechanism 504, is located at the opposite end of the bed and is shown in a folded-down position. Mechanism 511 includes a support member 512, having a tensioner 304 which is coupled to the other longitudinal end of mattress 106. A linear actuator 514, including a motor 515, is utilized for pivoting support member 512 up toward and back down to horizontal position via a swivel arm 516. Linear actuator 514 incorporates limit switches 503 and 505. Support member 512 is pivotally mounted to chassis 100 at a point 518, movable with respect to the chassis along slot 520. Pivot point 518 may be anchored at any point along slot 520 using a screw-type fastener (not shown). Both mechanisms may be tilted up simultaneously, if required.

Figure 48:
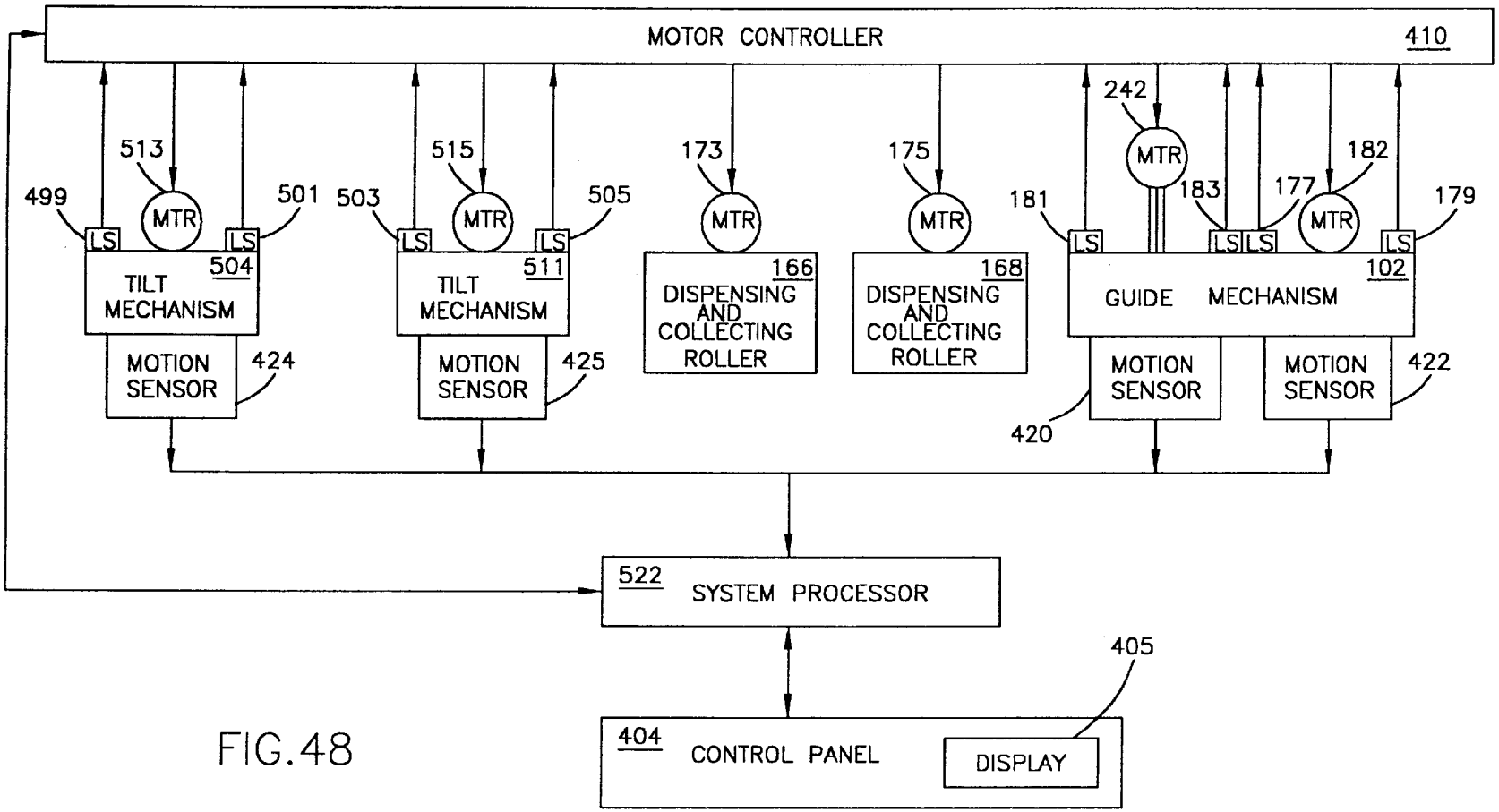
FIG. 48 is a block diagram of an automated control system of the service bed of FIG. 1 according to one embodiment of the invention.

FIG. 48 is a block diagram of an automated control system of the service bed according to one embodiment of the invention. The control system includes a motor controller 410 coupled with a system processor 522 for controlling the motion of motors 173, 175, 182, 242, 513, and 515. As previously described, motors 173 and 175 are provided for activating dispensing and collecting rollers 166 and 168, respectively; motor 182 is employed for controlling the span of guide mechanism 102; motor 242 is utilized for positioning guide mechanism 102 relative to the chassis of the bed; and motors 513 and 515 are used for controlling tilt mechanisms 504 and 511, respectively.

Guide mechanism 102 includes motion sensors 420 and 422 and limit switches 177, 179, 181, and 183. Sensor 420 is used to detect movement of mechanism 102 relative to the chassis of the bed (not shown in FIG. 48), whereas sensor 422 is employed for detecting movement associated with the change in the span of guide mechanism 102. Limit switches 181 and 183 demarcate the motion boundaries of mechanism 102 relative to the chassis. Similarly, limit switches 177 and 179 delimit motion associated with the change in the span of guide mechanism 102.

Tilt mechanisms 504 and 511 include motion sensors 424 and 425, respectively, used to detect pivotal movement of these mechanisms. Tilt mechanisms 504 and 511 also include limit switches 499, 501 and 503, 505, respectively, for demarcating the boundaries of the mechanisms' movement.

The output signals of motion sensors 420, 422, 424, and 425 are directed to system processor 522, which is electrically coupled with a control panel 404 having a display 405. In one embodiment, the motion sensors may comprise quadrature optical detectors. The output signals of limit switches 177, 179, 181,183, 499, 501, 503, and 505 are directed to motor controller 410. The limit switches may have, for example, a mechanical or an optical configuration.

System processor 522 (FIG. 49) comprises a central processing unit (CPU) 426 coupled with a clock 524, a motor-controller interface 525, a battery-backed CMOS memory 526, a flash memory 528, a motion-sensor interface 529, a network-communication port 532, a control-panel interface 531, and a timer/counter 530. Clock 524 is coupled with timer-counter 530. Those skilled in the art will appreciate that flash memory 528 could be replaced with, for example, programmable read-only memory (PROM), erasable programmable read-only memory (EPROM), or electrically-erasable programmable read-only memory (EEPROM). Similarly, memory 526 may comprise random access memory (RAM) of a static type.

Specific operation sequences for motors 173, 175, 182, 242, 513 and 515, corresponding to various medical and nursing procedures amenable to implementation by the service bed, may be programmed into memory 526 via control panel 404 to be executed by system processor 522 either on demand or at specific pre-programmed times. The ability of the processor 522 to carry out the programmed sequences is optimized by the signals received from motion sensors 420, 422, 424, and 425 as well as by signals from the above-recited limit switches coupled with the processor via motor controller 410. In an alternative embodiment of the invention, the control panel may be replaced by a hand-held device such as a personal digital assistant (PDA), a hand-held computer (not shown) capable of maintaining communication with the system processor via an infrared link, or a personal computer coupled with a computer network, such as those disclosed with reference to FIGS. 23, 23*a,* and 24, above.

Figure 50:
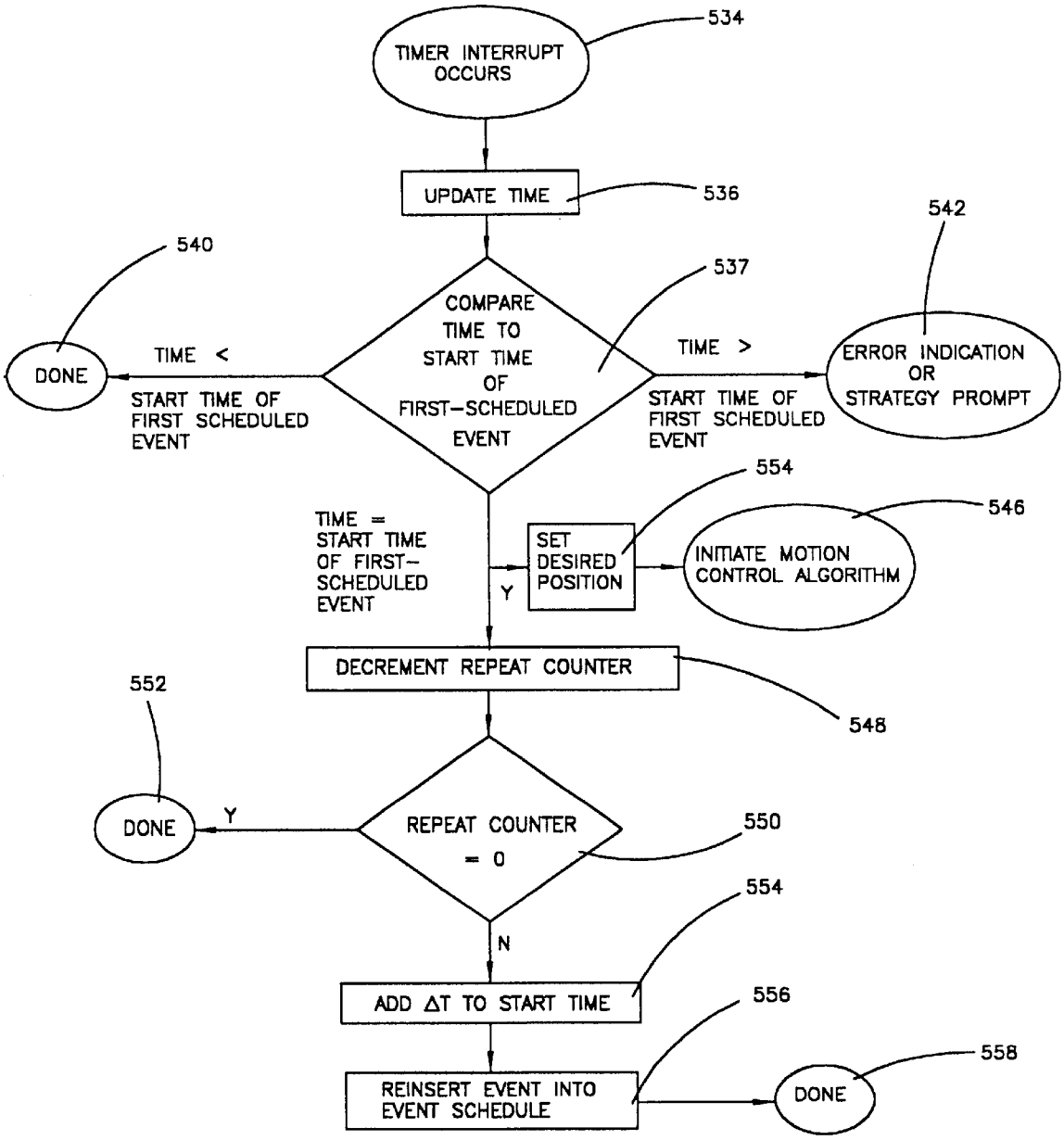
FIG. 50 is a flowchart of a scheduling algorithm utilized by the control system of FIG. 48.

FIG. 50 is a flowchart of a scheduling algorithm that comprises one of a series of generalized algorithms capable of being utilized by the system of FIG. 48 for controlling the motion of motors 173, 175, 182, 242, 513, and 515, associated with the earlier-disclosed subsystems of the service bed, to enable the implementation of various medical and nursing procedures described, e.g., with reference to FIGS. 10–16, above.

The execution of the algorithm of FIG. 50 is initiated when a timer interrupt occurs within the system (block 534). Following a time-update operation (block 536), the system makes a comparison (block 537) of the current time with the start time of a first-scheduled event 538 (FIG. 51), which is pointed to by an event-schedule data structure 539. Data structure 539 comprises a scheduled list of events sorted by start time, each event including a plurality of program variables, e.g., START TIME of the event, SUBSYSTEM ID (identification of a particular subsystem of interest), DESIRED POSITION of the subsystem of interest, PERIOD OF REPETITION (ΔT) of the event, and REPEAT COUNTER.

Referring back to FIG. 50, If the current time is less than the start time of the first-scheduled event in data structure 539 (FIG. 51), execution of the algorithm is terminated (block 540). If the current time is greater than the start time of the first-scheduled event (i.e., the event did not occur as scheduled), the system will issue an error indicator or a strategy prompt (block 542), alerting the system operator via display 405 of control panel 404 (FIG. 48). The visual prompt may be accompanied by an audible alarm signal, when required. Referring back to FIG. 50, if the current time is equal to the start time of the first-scheduled event, the system sets the desired position (block 544) and initiates a motion-control algorithm (block 546), which is described in detail below with reference to FIG. 52.

As apparent from FIG. 50, the system next decrements the repeat counter (block 548) and checks the value of the repeat counter (block 550). If the repeat counter equals to zero, execution of the algorithm is terminated (block 552). Otherwise, the period of repetition (ΔT) is added to the start time of the event (block 554) comprising entry 538 (FIG. 51), the event is reinserted into the event schedule 539 of FIG. 51 (block 556), and execution of the algorithm is terminated (block 558).

Figure 52:
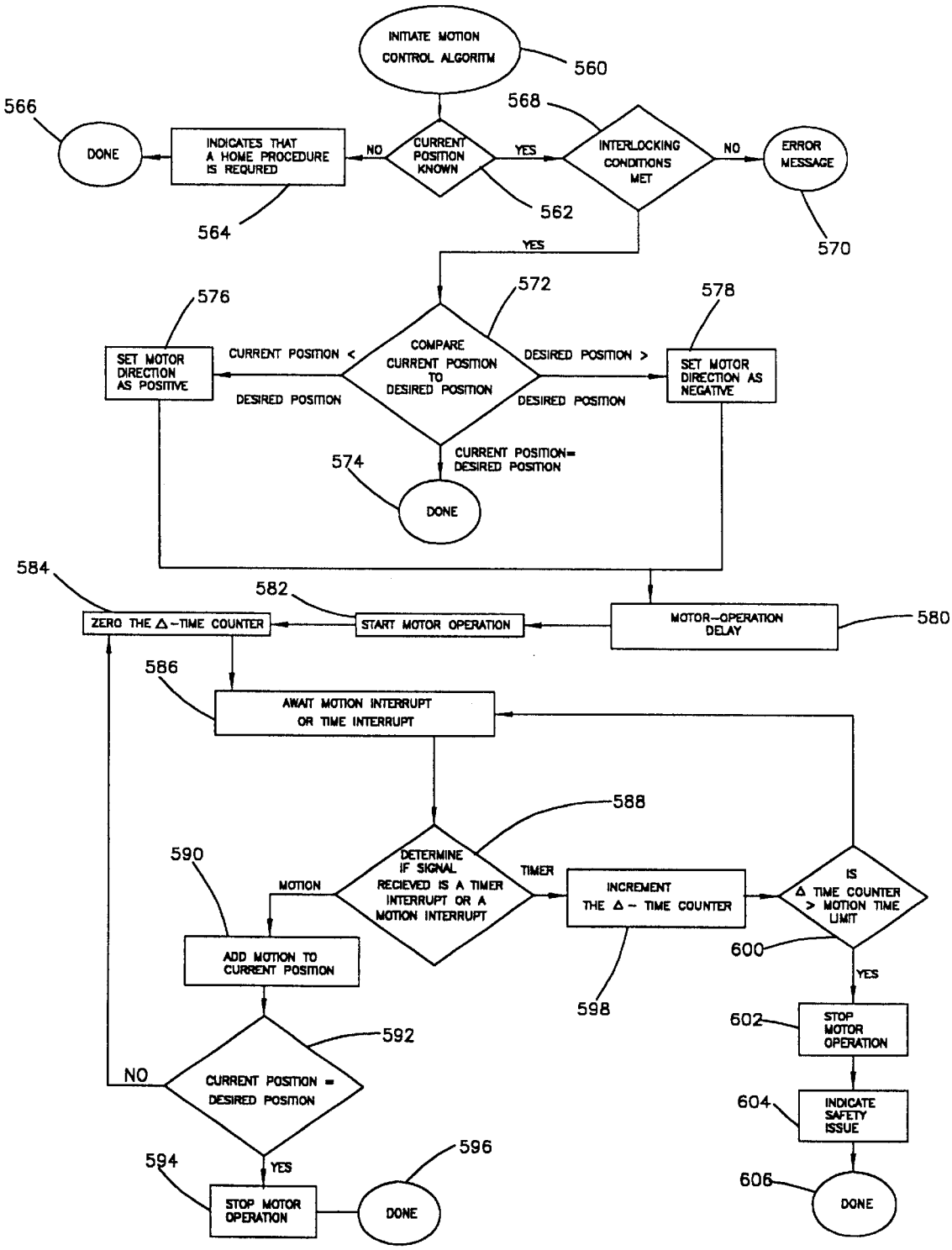
FIG. 52 is a flowchart of a motion-control algorithm utilized by the control system of FIG. 48.

FIG. 52 is a flowchart of a motion-control algorithm which may be initiated by the system during the execution of the scheduling algorithm, as illustrated by block 546, FIG. 50. After the motion-control algorithm of FIG. 52 is initiated (block 560), the system proceeds to ascertain whether the current position of the subsystem of interest is known (block 562) by checking the value of the CURRENT POSITION variable stored in the motion-subsystem data structure 561 illustrated in FIG. 53. Other program variables capable of being stored in data structure 561 may be, but are not limited to, MOTION TIME LIMIT (a maximum time allotted for the subsystem of interest to perform a discrete motion), MAXIMUM POSITION capable of being attained by the subsystem of interest, DESIRED POSITION of the subsystem of interest, MOTION FLAG indicating presence of motion of the subsystem of interest, and INTERLOCKING CONDITIONS to be satisfied before the subsystem of interest can be set in motion.

Figures 54, 55:
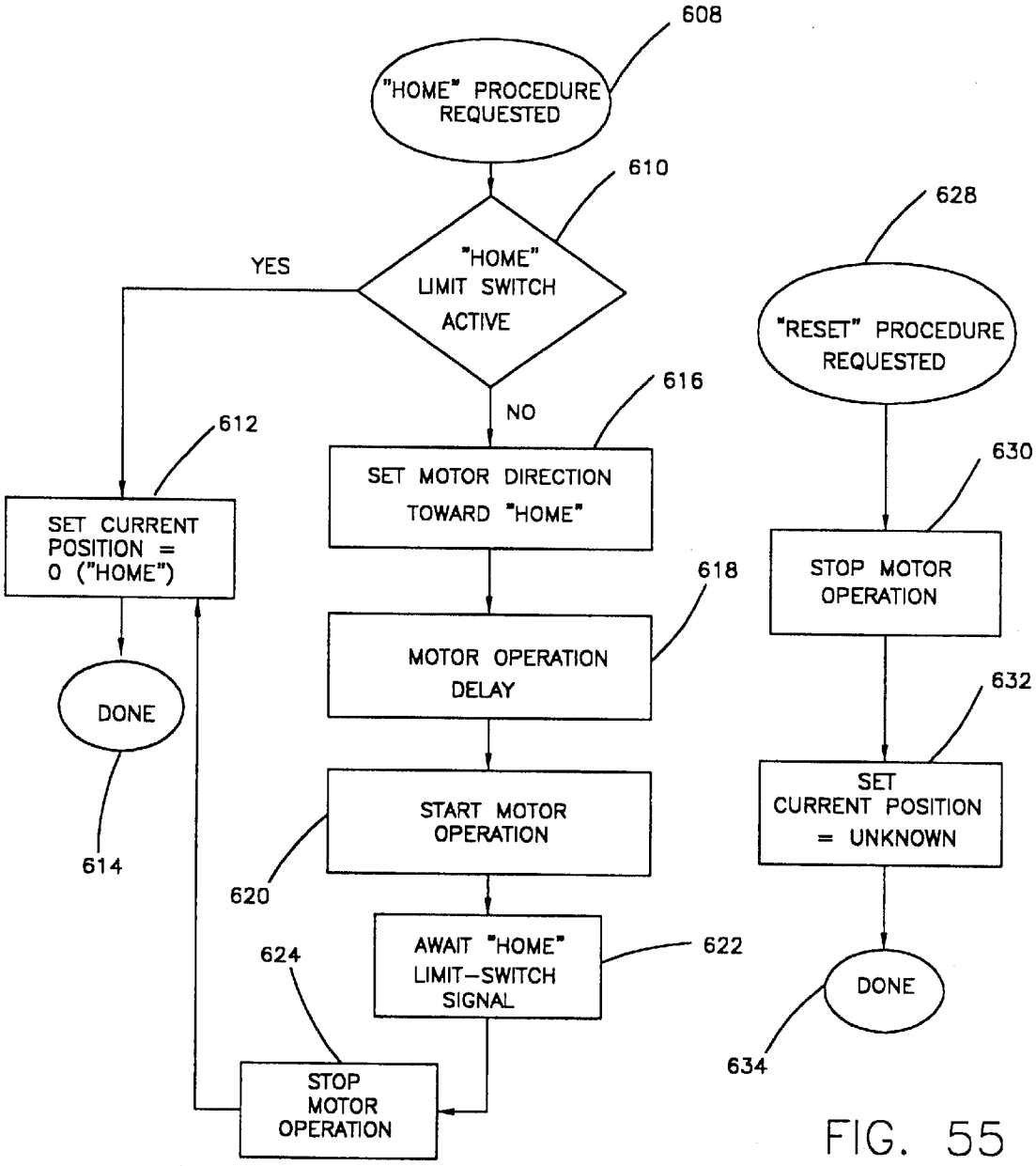
FIG. 54 is a flowchart of a "home" algorithm utilized by the control system of FIG. 48.
FIG. 55 is a flowchart of a "reset" algorithm utilized by the control system of FIG. 48.

If the current position is unknown, the system operator is prompted via display 405 of control panel 404 (FIG. 48) that a "home" procedure, described below with reference to FIG. 54, is required (block 564) and execution of the algorithm is terminated (block 566). If the current position is known, the system proceeds to verify whether interlocking conditions have been met (block 568). Those skilled in the art will appreciate that multiple interlocking conditions may be associated with each subsystem of the service bed. Failure to satisfy the interlocking conditions will prevent normal operation of the subsystem of interest, either because of hardware conflicts with other subsystems or due to safety considerations concerning the occupant of the bed. If any of the interlocking conditions are not met, an error message is displayed to the system operator (block 570) via display 405 of control panel 404 (FIG. 48). Alternatively, if all the interlocking conditions have been satisfied, the current position of the subsystem of interest is compared with its desired position (block 572).

If the current position of the subsystem of interest is the same as its desired position, execution of the algorithm is terminated (block 574). Alternatively, the direction of rotation of the motor corresponding to the subsystem of interest will be set as positive (block 576) if the current position of the subsystem is less than its desired position or as negative (block 578) if the current position is greater than the desired position. Once the motor direction is set, the system executes a motor-operation delay (block 580) to prevent the motor from rotating before it responds to the signal which sets the direction of motor rotation. Block 582 indicates the start of motor operation. After the value of the Δ-time counter is set to zero (block 584), the system is instructed to await either a motion interrupt (from a motion sensor) or a timer interrupt (block 586) and to identify the incoming signal (block 588). If a motion interrupt is received first, the value represented thereby is added to the current position of the subsystem of interest (block 590).

The current position of the subsystem of interest is then compared with its desired position (block 592). If the current position equals the desired position, motor operation is halted (block 594) and execution of the algorithm is terminated (block 596). Otherwise, the system resumes the execution of the algorithm at block 584.

Returning to block 588, if a timer interrupt is received first, the system increments the Δ-time counter (block 598) and ascertains whether the value of the Δ-time counter exceeds the value of the MOTION TIME LIMIT variable (block 600), stored in data structure 561 (FIG. 53). If the Δ-time counter is less than the value of the MOTION TIME LIMIT variable, the system resumes the execution of the algorithm at block 586. Otherwise, motor operation is halted (block 602), the system indicates the presence of a safety issue (block 604) to the operator via display 405 of control panel 404 (FIG. 48), and execution of the algorithm is terminated (block 606). Those skilled in the art will appreciate that a variety of safety issues may arise, whereby the operation of the motor associated with the subsystem of interest may become in some way impaired. To prevent any safety hazards that may be associated with such a condition, it is essential that the operation of the subsystems of interest is timely halted when a potential safety issue is identified. Moreover, the system operator should be apprised of the possible safety concern.

FIG. 54 is a flowchart of a "home" algorithm whose execution may be initiated by the system operator if the current position of the subsystem of interest is unknown. After the "home" procedure is requested by the system operator (block 608), the system determines if the limit switch of the subsystem of interest corresponding to the zero or "home" position of that subsystem is active (block 610). If that is the case, the current position of the subsystem of interest is set to be zero or "home" (block 612) and execution of the algorithm is terminated (block 614). Otherwise, direction of motor rotation is set toward the "home" position (block 616). Once the motor direction is set, the system executes a motor-operation delay (block 618) to prevent the motor from rotating before it responds to the signal which sets the direction of motor rotation. Block 620 indicates the start of motor operation, following which the system awaits a signal from the "home" limit switch (block 622). Once this signal is received, motor operation is halted (block 624) and the system resumes the execution of the algorithm at block 612.

FIG. 55 is a flowchart of a "reset" algorithm whose execution may be initiated by the system operator. After a "reset" procedure is requested (block 628), motor operation is halted (block 630), the value of the CURRENT POSITION variable in data structure 561 (FIG. 53) is set to "unknown" (block 632), and the execution of the algorithm is terminated (block 634). The "reset" procedure allows the control system to prevent any positioning errors associated with unforeseen events such as, e.g., a power failure.

Figure 49:
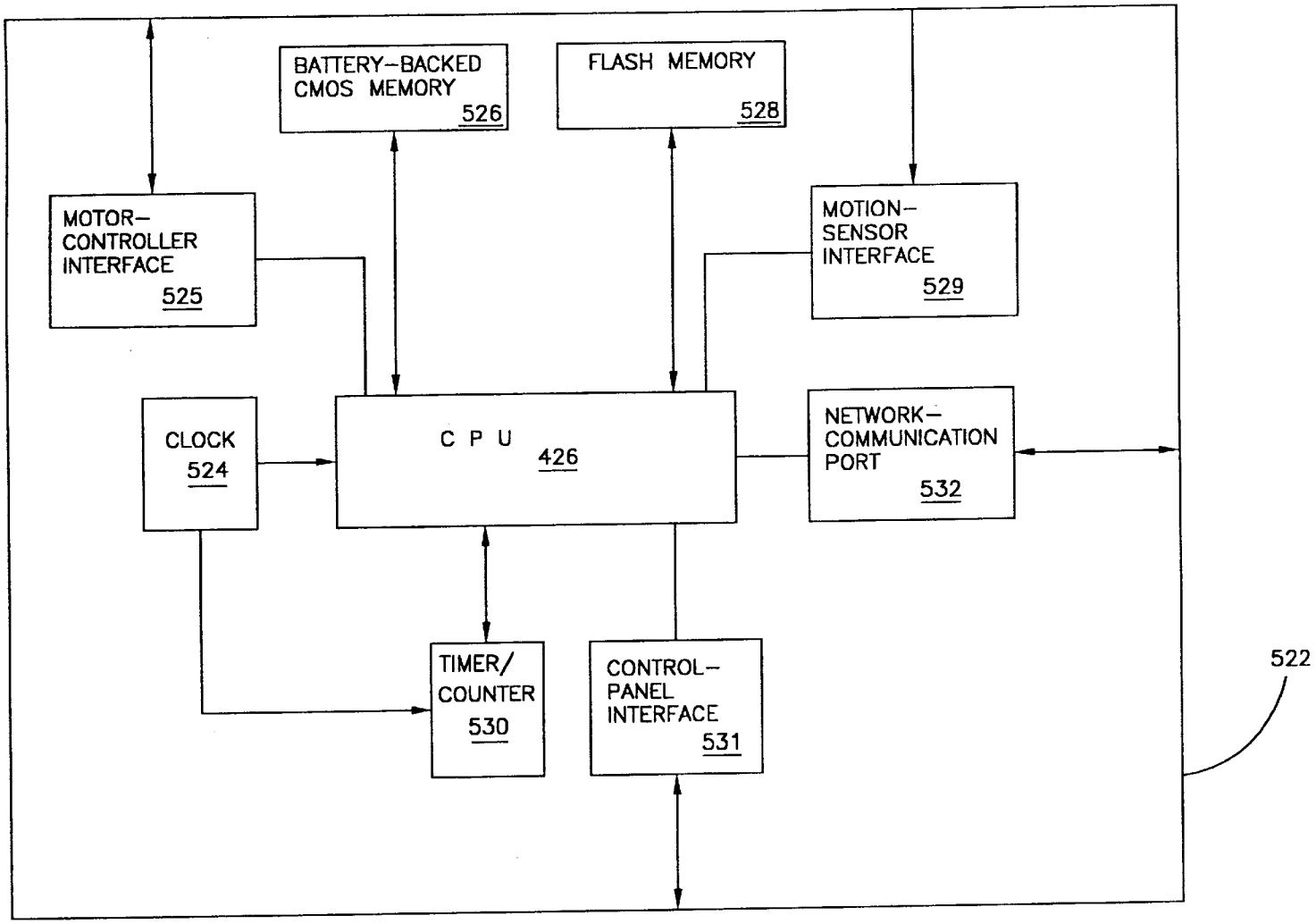
FIG. 49 is a block diagram of the system processor incorporated in the control system of FIG. 48.
Figure 51:
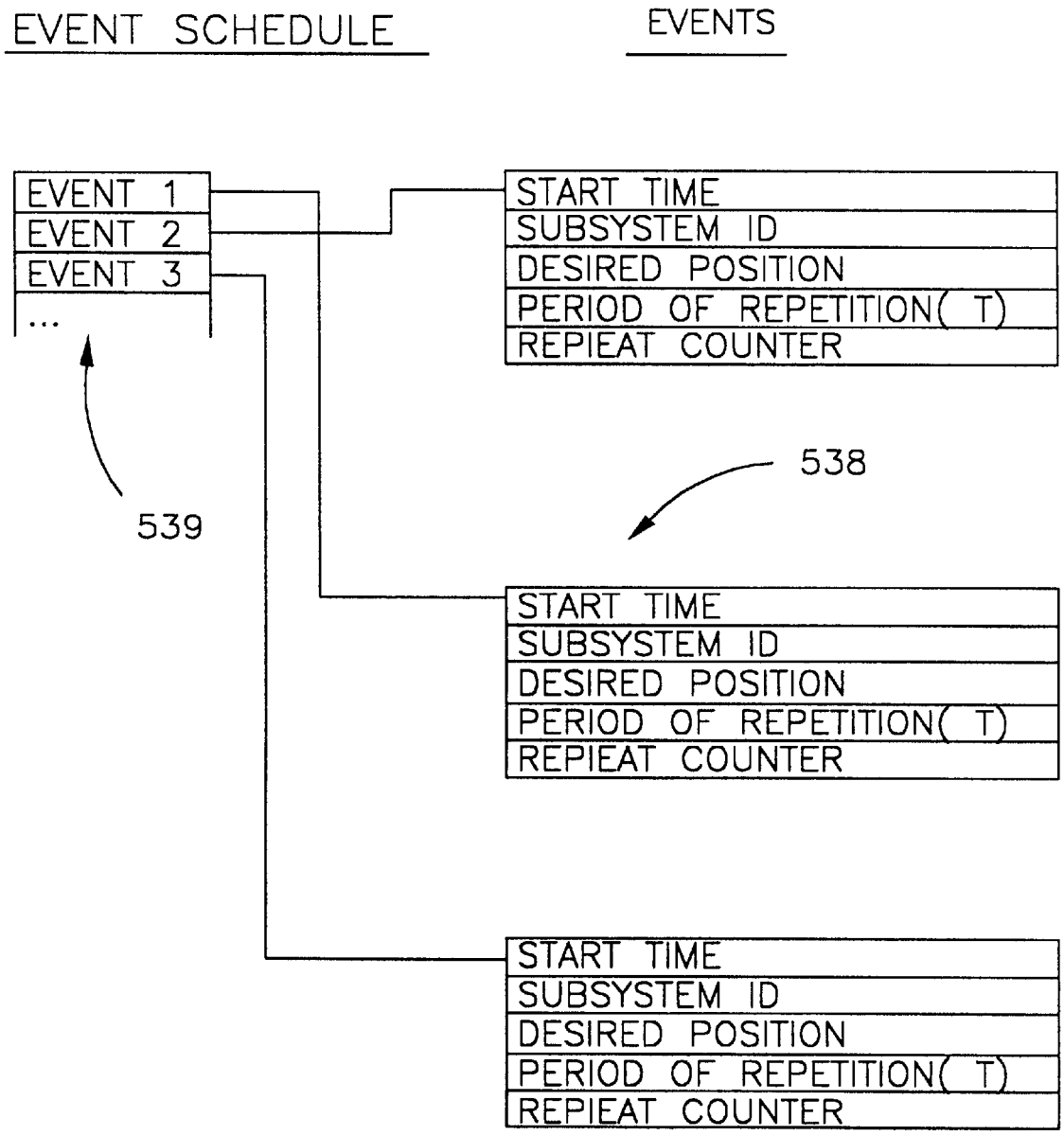
FIG. 51 represents an event-schedule data structure utilized by the control system of FIG. 48.

Those skilled in the art will appreciate that the algorithms discussed above with reference to FIGS. 50, 52, 54, and 55 may be stored in flash memory 528 (FIG. 49), whereas data structures 539 and 561, illustrated in FIGS. 51 and 53, respectively, may be stored in battery backed CMOS memory 526 (FIG. 49).

The above configurations of the service bed according to the present invention are given only as examples. Therefore, the scope of the invention should be determined not by the illustrations given, but by the appended claims and their equivalents.

The invention claimed is:

1. A platform for supporting an occupant, said platform comprising:

a chassis whereto a mattress is attached; and an adjustable guide mechanism movably supported by said chassis said adjustable guide mechanism defining an adjustable continuously movable gap longitudinally movable relative to said chassis the mattress having an adjustable undulation formed by routing the mattress through said gap in said adjustable guide mechanism, the undulation in said mattress being continuously-movable relative to said chassis in concert with longitudinal movement of said adjustable guide mechanism.

2. The platform of claim 1 further including at least one tensioner attached to said chassis and coupled with the mattress.

3. The platform of claim 1 further comprising a carrier movably mounted on said chassis and movable relative to the mattress supported by said carrier.

4. The platform of claim 3 wherein said carrier includes a plurality of bearing elements and a drive train, said plurality of bearing elements mounted to said drive train, said adjustable guide mechanism attached to said drive train.

5. The platform of claim 4 wherein said adjustable guide mechanism comprises a plurality of guides.

6. The platform of claim 5 wherein said drive train is operatively coupled with each of said plurality of guides.

7. The platform of claim 5 wherein at least two of said plurality of guides have a continuously-variable gap therebetween, the undulation in said mattress through said guide mechanism having a continuously-variable span responsive to said continuously-variable gap between said plurality of guides.

8. The platform of claim 7 wherein said adjustable guide mechanism includes at least one collector and at least one dispenser within said undulation, said at least one collector and said at least one dispenser responsive to the movement of said adjustable guide mechanism relative to said chassis, said at least one dispenser releasably coupled with at least one first stratum to be installed between the mattress and the occupant, said at least one collector receivably coupled with at least one second stratum located between the mattress and the occupant, the first and the second strata removably attached to said chassis.

9. The platform of claim 8 wherein, with the weight of the occupant on the mattress, said at least one dispenser is capable of installing the first stratum and said at least one collector is capable of removing the second stratum substantially without moving the occupant and substantially without frictional movement of the first and the second strata relative to the occupant.

10. The platform of claim 1 further including a monitoring device disposed in the undulation of said mattress in said adjustable guide mechanism.

11. The platform of claim 10 further including a computer network coupled with said monitoring device.

12. The platform of claim 1 further including a theraputic device disposed in the undulation of said mattress in said adjustable guide mechanism.

13. The platform of claim 1 further including a facility disposed in the undulation of said mattress in said adjustable guide mechanism.

14. The platform of claim 1 further including a sanitation tray disposed in the undulation of said mattress in said adjustable guide mechanism.

15. The platform of claim 14 further including brushes disposed in the undulation of said mattress in said adjustable guide mechanism above said sanitation tray.

16. The platform of claim 1 wherein said chassis further includes at least one tilt mechanism.

17. The platform of claim 1 further including an automated control system.

18. The platform of claim 17 further including a computer network coupled to said automated control system.

19. A bed for supporting an occupant, said bed comprising:

a chassis;

a mattress attached to said chassis; and at least one adjustable guide mechanism movably supported by said chassis said adjustable guide mechanism defining an adjustable continuously movable gap longitudinally movable relative to said chassis the mattress having an adjustable undulation formed by routing said mattress through said gap in said adjustable guide mechanism, said adjustable undulation in said mattress continuously-movable relative to said chassis in concert with longitudinal movement of said adjustable guide mechanism.

20. The bed of claim 19 further comprising a carrier movably mounted on said chassis, said carrier movable relative to said mattress, said adjustable guide mechanism attached to said carrier, said matterss supported by said carrier.

21. The bed of claim 20 wherein said adjustable guide mechanism comprises a plurality of adjustable guides, at least two of said plurality of adjustable guides having a continuously adjustable gap therebetween, said undulation in said mattress having a continuously-variable span corresponding to said continuously adjustable gap.

22. The bed of claim 21 further comprising dispensing and collecting means in said undulation in said mattress for installing at least one first stratum between said mattress and the occupant and for removing at least one second stratum installed between said mattress and the occupant, said dispensing and collecting means attached to said adjustable guide mechanism and responsive to the movement of said adjustable guide mechanism relative to said chassis, the first and the second strata removably attached to said chassis.

23. The bed of claim 22 wherein, with the weight of the occupant on said mattress, said dispensing and collecting means is capable of installing the first stratum and removing the second stratum substantially without moving the occupant and substantially without frictional movement of the first and the second strata relative to the occupant.

24. The bed of claim 23 further including a monitoring device disposed in said undulation of said mattress in said adjustable guide mechanism.

25. The bed of claim 24 further including a computer network coupled with said monitoring device in said undulation of said mattress in said adjustable guide mechanism.

26. The bed of claim 23 further including a therapeutic device disposed in said undulation of said mattress in said adjustable guide mechanism.

27. The bed of claim 23 further including a facility disposed in said undulation of said mattress in said adjustable guide mechanism.

28. The bed of claim 23 further including a sanitation tray disposed in said undulation of said in said adjustable guide mechanism.

29. The bed of claim 28 further including brushes disposed in said undulation of said mattress in said adjustable guide mechanism above said sanitation tray.

30. The bed of claim 23 wherein said chassis further includes at least one tilt mechanism.

31. The bed of claim 23 further including an automated control system.

32. The bed of claim 31 further including a computer network coupled to said automated control system.

33. A method of gaining access to and relieving pressure from at least one desired location under an occupant of a surface, said method comprising:

providing means for creating an adjustable undulation in said surface, and said adjustable undulation having a continuously variable span and being continuously-movable relative to the occupant, translating said adjustable undulation to said at least one desired location substantially without moving the occupant and substantially without frictional movement of said surface relative to the occupant, and adjusting said continuously-variable span of said adjustable undulation substantially without moving the occupant to provide a space of sufficient size to gain access to said at least one desired location and to relieve pressure therefrom.

34. A method of removing at least one first stratum located between a surface and an occupant whose weight is on the surface and installing at least one second stratum between the occupant and the surface, substantially without moving the occupant and substantially without frictional movement at the first and the second strata relative to the occupant, the method comprising:

providing an undulation in said surface, said undulation continuously-movable relative to the occupant;

translating said undulation between one end and a second end of said surface relative to the occupant;

fixing a first end of said first stratum to said one end of said surface between said surface and said occupant;

locating a second end of said first stratum in said undulation in said surface, said fixing and locating of said first and second ends of said first stratum maintaining said first stratum in tension and responsive to translation of said undulation;

fixing a first end of said second stratum to said second end of said surface between said surface and said occupant;

locating a second end of said second stratum in said undulation in said surface, said fixing and locating of said first and second ends of said second stratum maintaining said second stratum in tension and responsive to translation of said undulation;

responsive to said translation of said undulation, collecting said at least one first stratum into said undulation under tension and dispensing said at least one second stratum from said undulation under tension to remove said at least one first stratum and install said at least one second stratum between said occupant and the surface; and maintaining a separation between said first and said second stratum within said undulation to avoid contact between said strata.

35. A method of promoting circulation of blood and tissue fluids of patient resting on a surface, the method comprising:

providing an undulation in said surface, said undulation continuously-movable relative to the patient and having a continuously-variable span, said undulation being movable along said surface substantially without moving the patient and substantially without frictional movement between the patient and said surface;

adjusting said continuously-variable span to be within a specific range;

translating said undulation toward the head of the patient and at a first predetermined speed;

adjusting said continuously-variable span to be at the lower limit of said specific range; and translating said undulation toward the feet of the patient at a second predetermined speed.

* * * * *